US011766883B2

(12) United States Patent
Pfeffer et al.

(10) Patent No.: US 11,766,883 B2
(45) **Date of Patent: *Sep. 26, 2023**

(54) PRINTER

(71) Applicant: VIDEOJET TECHNOLOGIES INC., Wood Dale, IL (US)

(72) Inventors: Gary Pfeffer, Nottingham (GB); Keith Buxton, Mapperly Plains (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/174,897

(22) Filed: Feb. 12, 2021

(65) Prior Publication Data

US 2022/0274430 A1 Sep. 1, 2022

Related U.S. Application Data

(63) Continuation of application No. 16/309,747, filed as application No. PCT/GB2017/051760 on Jun. 16, 2017, now Pat. No. 10,933,668.

(30) Foreign Application Priority Data

| | | |
|---|---|---|
| Jun. 17, 2016 | (GB) | 1610627 |
| Sep. 14, 2016 | (WO) | PCT/GB2016/052843 |
| Jan. 20, 2017 | (GB) | 1701018 |

(51) Int. Cl.
*B41J 25/312* (2006.01)
*B41J 2/325* (2006.01)
(Continued)

(52) U.S. Cl.
CPC ..... *B41J 25/312* (2013.01); *B41J 2/035* (2013.01); *B41J 2/17556* (2013.01); *B41J 2/325* (2013.01); *B41J 25/316* (2013.01)

(58) Field of Classification Search
CPC ..... B41J 25/312; B41J 2/035; B41J 2/17556; B41J 2/325; B41J 25/316
See application file for complete search history.

(56) References Cited

U.S. PATENT DOCUMENTS

| | | | |
|---|---|---|---|
| 7,150,572 B2 | 12/2006 | McNestry et al. | |
| 10,933,668 B2 * | 3/2021 | Pfeffer | B41J 2/325 |

(Continued)

FOREIGN PATENT DOCUMENTS

| | | |
|---|---|---|
| CN | 1473110 A | 2/2004 |
| CN | 202473025 U | 10/2012 |

(Continued)

OTHER PUBLICATIONS

CN Application 201780050556.3 English Translation of Search Report, dated May 11, 2020, 3 pages.

(Continued)

*Primary Examiner* — Geoffrey S Mruk
(74) *Attorney, Agent, or Firm* — Wolter Van Dyke Davis, PLLC; Robert L. Wolter

(57) ABSTRACT

A printer comprising a printhead configured to selectively cause a mark to be created on a substrate. The printer comprises a stepper motor having an output shaft coupled to the printhead, the stepper motor being arranged to vary the position of the printhead relative to a printing surface against which printing is carried out, and to control the pressure exerted by the printhead on the printing surface. The printer further comprises a sensor configured to generate a signal indicative of an angular position of the output shaft of the stepper motor. The printer further comprises a controller arranged to generate control signals for the stepper motor so as to cause a predetermined torque to be generated by the stepper motor; said control signals being at least partially based upon an output of said sensor.

23 Claims, 11 Drawing Sheets

(51) Int. Cl.

| | |
|---|---|
| ***B41J 25/316*** | (2006.01) |
| ***B41J 2/035*** | (2006.01) |
| ***B41J 2/175*** | (2006.01) |

(56) References Cited

U.S. PATENT DOCUMENTS

| | | | | |
|---|---|---|---|---|
| 11,571,919 | B2 * | 2/2023 | Pfeffer | B41J 2/17556 |
| 2013/0271548 | A1 | 10/2013 | Morgan et al. | |
| 2016/0185146 | A1 | 6/2016 | McNestry et al. | |
| 2019/0047296 | A1 | 2/2019 | Buxton et al. | |

FOREIGN PATENT DOCUMENTS

| | | | |
|---|---|---|---|
| CN | 103917374 | A | 7/2014 |
| CN | 105408121 | A | 3/2016 |
| GB | 2369602 | A | 6/2002 |
| GB | 2519371 | A | 4/2015 |
| JP | S62251175 | A | 10/1987 |
| JP | 2007185966 | A | 7/2007 |
| WO | 2002022371 | A2 | 3/2002 |
| WO | 2008107647 | A1 | 9/2008 |
| WO | 2013025746 | A1 | 2/2013 |
| WO | 2017046585 | A1 | 3/2017 |
| WO | 2017216573 | A2 | 12/2017 |

OTHER PUBLICATIONS

CN Application 201780050556.3 English Translation of Search Report, dated Feb. 23, 2021, 2 pages.

EP Application 20210285.1 Extended Search Report, dated Apr. 23, 2021, 8 pages.

PCT/GB2017/051760 International Search Report and Written Opinion, dated Mar. 21, 2018, 14 pages.

PCT/GB2017/051760 International Preliminary Report on Patentability, dated Dec. 18, 2018, 8 pages.

Search Report for GB1701018.2, dated Jul. 14, 2017, 10 pages.

Ahad Golipour, "Optimizing speed and angle control of stepping motor by using field oriented control", Journal of Artificial Intelligence in Electrical Engineering, vol. 3, No. 11, Dec. 2014 (Year: 2014).

Shah, "Field Oriented Control of Step Motors", Jun. 2000 (Year: 2000).

Kim et al "Design and Implementation of Simple Field-Oriented Control for Permanent Magnet Stepper Motors Without DQ Transformation", IEEE Transactions on Magnetics, vol. 47, No. 10, Oct. 2011 (Year: 2011).

* cited by examiner

PRINTER

The present invention relates to a printer. More particularly, but not exclusively, the invention relates to apparatus and methods for controlling the pressure exerted by a printhead on a printing surface against which printing is to take place.

Thermal transfer printers use an ink carrying ribbon. In a printing operation, ink carried on the ribbon is transferred to a substrate which is to be printed. To effect the transfer of ink, a print head is brought into contact with the ribbon, and the ribbon is brought into contact with the substrate. The print head contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

In some thermal transfer printers, printing is effected by use of a stationary printhead, past which ribbon and substrate are moved. This operation may be referred to as "continuous" printing. Here the print speed is defined by the speed of movement of the substrate and ribbon past the stationary printhead. However, in an alternative printing technique (so-called "intermittent" printing), the substrate and ribbon are held stationary and the printhead is moved relative to the stationary substrate and ribbon. Here the print speed is defined by the speed of movement of the printhead relative to the stationary ribbon and substrate.

Direct thermal printers also use a thermal printhead to generate marks on a thermally sensitive substrate. A print head is brought into direct contact with the substrate. When printing elements of the print head are heated, whilst in contact with the substrate, marks are formed on the regions of the substrate which are adjacent to printing elements which are heated.

It is known that various factors affect print quality. For example it is important that the printhead is properly positioned relative to the printing surface and also important that the printhead applies an appropriate pressure to the printing surface and the ribbon and substrate which is sandwiched between the printhead and the printing surface.

Movement of the printhead relative to the printing surface (i.e. towards and away from the printing surface) is, in some prior art printers, effected pneumatically by an air cylinder which presses the printhead into contact with the printing surface and any substrate and ribbon located between the printhead and the printing surface. Such an arrangement is effective but has associated disadvantages. In particular, it is usually not readily possible to vary the pressure applied by the printhead during printing operations, and use of the printer requires an available supply of compressed air.

It is an object of some embodiments of the present invention to provide a novel printer which obviates or mitigates at least some of the disadvantages set out above.

According to a first aspect of the invention there is provided a printer comprising: a printhead configured to selectively cause a mark to be created on a substrate; a first motor coupled to the printhead and arranged to vary the position of the printhead relative to a printing surface against which printing is carried out to thereby control the pressure exerted by the printhead on the printing surface; and a controller arranged to control the first motor. The controller is arranged to control the magnitude of current supplied to windings of the first motor so as to cause a predetermined pressure to be exerted by the printhead on the printing surface.

Control of the magnitude of current supplied to windings of the first motor allows the first motor to be controlled in a torque controlled manner so as to generate a predetermined output torque. Such a generated torque can be converted (via a suitable mechanical coupling) to a predetermined force (corresponding for a particular area to a predetermined pressure) which is to be exerted by the printhead on the printing surface during printing operations. That is, by torque-controlling the first motor, accurate control of the printing pressure can be realised.

The controller may be arranged to control the first motor in first and second operating modes. In the first operating mode, the controller may be arranged to control the magnitude of current supplied to windings of the first motor so as to cause a predetermined pressure to be exerted by the printhead on the printing surface. In the second operating mode, the controller may be arranged to control the angular position of an output shaft of the first motor so as to control the position of the printhead relative to the printing surface.

The first operating mode may be referred to as a torque-controlled mode. That is, in the first operating mode, torque may be the dominant control parameter. The torque generated by the first motor may have a known relationship with the current supplied to the windings of the first motor. The pressure exerted by the printhead on the printing surface may have a known relationship with the torque generated by the first motor. Thus, by controlling the magnitude of current supplied to windings of the first motor it is possible to control the pressure exerted by the printhead on the printing surface.

The second operating mode may be referred to as a position-controlled mode. That is, in the second operating mode, position may be the dominant control parameter. More particularly, the angular position of the output shaft of the first motor may be a controlled parameter. It will be appreciated that in a position-controlled mode, torque generated by the motor may still be controlled. For example, in a position-controlled mode the torque generated by the motor may be controlled so as to cause the output shaft of the motor to move to a desired angular position.

By controlling a motor in first and second operating modes, it is possible to achieve improved printer performance by ensuring that a control mode is appropriate for the particular situation. For example, by operating the first motor in a torque controlled mode, it is possible accurately control the pressure exerted by the printhead on the printing surface. On the other hand, by controlling the first motor in a position-controlled mode, it is possible to quickly and efficiently position the printhead relative to the printing surface.

In the second operating mode the printhead may be spaced apart from the printing surface.

Operating the first motor in a position controlled mode when the printhead is spaced apart from the printing surface allows the printer to be operated quickly and efficiently, and allows the printhead to be withdrawn from the printing surface by a predetermined amount between the printing of consecutive images. Whereas, if torque-only control is used, where there is no mechanical resistance to rotation of the output shaft of the first motor (e.g. when the printhead is spaced apart from the printing surface) the printhead may not be able to be maintained stably in an arbitrary positon (i.e. a free space position).

Controlling the magnitude of current supplied to the windings of the first motor may comprise controlling the magnitude of the current so as to not exceed a predetermined maximum value.

The predetermined maximum value may correspond to a predetermined maximum torque value. The predetermined maximum torque value may correspond to the predetermined pressure to be exerted by the printhead on the printing surface.

The controller may be arranged to control the first motor based upon a sensor signal indicating angular displacement of an output shaft of the first motor.

The printer may comprise a sensor arranged to generate said sensor signal indicating angular displacement of an output shaft of the first motor. The sensor may be an encoder, for example, a rotary encoder.

In the second operating mode, the first motor may be controlled based upon a sensor signal indicating angular displacement of the output shaft of the first motor. Alternatively, or additionally, in the second operating mode, the first motor may be controlled in an open loop manner, based upon a desired angular position of the output shaft of the first motor.

In the first operating mode, the first motor may be controlled based upon the sensor signal indicating angular displacement of the output shaft of the first motor.

Such control allows positional information to be provided to the controller, so as to effect closed-loop control of the first motor. In this way, appropriate control signals can be provided to the first motor so as to cause a desired torque to be generated by the first motor. For example, where the first motor is a stepper motor, a field angle (that is, the angular offset between the stator field position and the rotor position), can be determined and the field generated by the motor windings (i.e. the stator field) can be caused to have a particular orientation. Such control can be used to maximise the torque generated for a particular magnitude of current supplied to the motor windings.

The first motor may be a position controlled motor. The first motor may be a stepper motor.

By using a sensor signal indicating angular displacement of an output shaft of the first motor as a control input, it is possible to achieve many of the benefits conventionally associated with stepper motors (e.g. high torque output, low-cost, and high-speed operation) while also providing advantageous characteristics usually associated with DC motors (e.g. a well-known relationship between the current supplied to the motor and the torque output by the motor).

In the first operating mode, the controller may be arranged to control current supplied to the windings of the first motor so as to control an orientation of a stator field of said first motor based upon a sensor signal indicating angular displacement of the output shaft of the first motor.

In this way, the torque generated by the first motor can be controlled and optimised. For example, by controlling the field angle (that is, the angular offset between the stator field position and the rotor position) the torque can be maximised for a particular magnitude of current supplied to the motor windings. In particular, it is known that a stepper motor produces maximum torque when a field angle of 90 (electrical) degrees is used. Thus, the control of the orientation of a stator field allows a field angle to be controlled, which in turn allows the stepper motor to generate a maximum torque for a given winding current. Moreover, by providing accurate positional information, and controlling the stator field based upon this information, there is no risk that a stepper motor will stall if the load is greater than the maximum torque capacity.

The controller may be further arranged to control the angular position of the first motor.

Said controller may be configured to control the first motor so as to cause the output shaft of the first motor to attempt to rotate by a predetermined angular displacement.

Where the printhead is spaced apart from the printing surface, attempts by the first motor to rotate the output shaft of said first motor by a predetermined angular displacement will generally cause a corresponding rotation of the predetermined angular displacement to occur. Therefore, unless the movement of the printhead is impeded (for example by contact with the printing surface) positional control of the first motor can allow accurate positional control of the printhead.

In the second operating mode, the first motor may be configured to control the first motor so as to cause the output shaft of the first motor to attempt to rotate by a predetermined angular displacement controlled based upon a sensor signal indicating angular displacement of the first motor. Alternatively, or additionally, in the second operating mode, the first motor may be controlled in an open loop manner, based upon a desired angular position or a desired angular displacement, so as to rotate to a predetermined angular position.

Said control of angular position may be based upon a sensor signal indicating angular displacement of the first motor.

The sensor signal indicating angular displacement of the first motor may be generated by a sensor. The sensor may take any suitable form and may be, for example, a magnetic or optical encoder.

Said controller may be configured to control the first motor based upon a received target position and a received current position.

In the second operating mode, the first motor may be configured to control the first motor so as to cause the output shaft of the first motor based upon a received target position and a received current position.

Said controller may be arranged to control the angular position of the output shaft of the first motor based upon at least one of a motor speed signal and a motor current signal.

Control of the first motor so as to attempt to rotate by a predetermined angular displacement allows the first motor to be controlled in a position-controlled manner so as to move towards and press against a printing surface. By limiting the current supplied to the first motor during such position-controlled movement, it is possible to realise benefits of both positional control (e.g. a predetermined rate of movement, and ability to stop in any arbitrary position) with those of torque control (e.g. generation of a predetermined output torque which corresponds to a predetermined pressure which is to be exerted by the printhead on the printing surface during printing operations). That is, by torque-limited position-controlling the first motor, accurate control of both the printing pressure and printhead position before, during and after printing can be realised.

The predetermined angular displacement may correspond to a movement of the printhead relative to the printing surface beyond a point at which the printhead makes contact with the printing surface, such that, in use, the printing surface obstructs the output shaft of the first motor from rotating through the predetermined angular displacement.

That is, the predetermined angular displacement may be such that the mechanical arrangement of printer components makes the predetermined angular displacement impossible to achieve in use because, for example, the printhead will contact the printing surface before the predetermined angular displacement has been achieved.

The controller may be arranged to control the first motor so as to command the output shaft of the first motor to rotate until a signal indicative of actual movement of the output shaft of the first motor indicates that the predetermined angular displacement has been completed.

Said controller may be configured to control the first motor in the second operating mode to cause the printhead to maintain a position in which it is spaced apart from the printing surface by a predetermined separation.

The printhead may be caused to be maintained in a ready-to-print position in which the printhead is spaced apart from the printing surface by a small distance (e.g. 2 mm) in a position controlled mode. In this way, the printhead can be kept close enough to the printhead that it can respond quickly when printing is required, but also sufficiently spaced apart from the printing surface that the printhead will not interfere with the substrate.

Said controller may be configured to control the first motor in the first operating mode to cause the printhead to move from a position in which it is spaced apart from the printing surface towards the printing surface.

The printhead may be caused to move from a ready-to-print position in which the printhead is spaced apart from the printing surface by a small distance (e.g. 2 mm) towards the printing surface in a torque controlled mode. In this way, once a command to print is received, the controller can switch from controlling the first motor in a position controlled way, to controlling the first motor in a torque controlled way, in order to move the printhead towards the printing surface, and then cause a controlled printing force to be developed between the printing and the printing surface.

Said controller may be configured to control the first motor so as to cause the printhead to move from a position in which it is pressed against the printing surface to a position spaced apart from the printing surface in the second operating mode.

The position in which the printhead is spaced apart from the printing surface may be the ready-to-print position. Alternatively, the position in which the printhead is spaced apart from the printing surface may be a retracted position.

Controlling the magnitude of current supplied to windings of the first motor may comprise providing a pulse width modulated signal to said windings. Controlling the magnitude of current may comprise controlling a duty cycle of the pulse width modulated signal provided to said windings. Controlling the magnitude of current supplied to windings of the first motor may comprise controlling an average current supplied to said windings.

By controlling current supplied to windings of the first motor with pulse width modulation (PWM), it is possible to control the average current flowing in said windings. That is, during PWM operation the instantaneous current flowing in the motor windings will vary, but the average value can be controlled to have a desired value. Further, commutation of the windings of the first motor (such as, for example, in a brushless-DC motor) will result in the current flowing in different ones of the windings to vary in accordance with the rotational position of the output shaft of the first motor with respect to the positions of the windings, and the internal structure of the first motor. However, an average value of current flowing within all of the windings of the first motor will be indicative the overall torque generated by the first motor.

The printhead may be rotatable about a pivot and the first motor may be arranged to cause rotation of the printhead about the pivot to vary the position of the printhead relative to the printing surface.

The thermal transfer printer may further comprise a printhead assembly, the printhead assembly comprising a first arm and a second arm, the first arm being coupled to the first motor, and the printhead being disposed on the second arm. The first motor may be arranged to cause movement of the first arm, thereby causing rotation of the second arm about the pivot, and causing the position of the printhead relative to the printing surface to vary.

The first motor may be coupled to the first arm via a flexible linkage.

The term flexible linkage is not intended to imply that the coupling behaves elastically. That is, the flexible linkage may be relatively inelastic resulting in any movement of the first motor being transmitted to, and causing a corresponding movement of, the first arm, and hence the second arm and the printhead, rather than causing elastic deformation (i.e. stretching) of the flexible linkage.

The linkage may be a printhead rotation belt.

The printhead rotation belt may pass around a roller driven by the first motor such that rotation of the first motor causes movement of the printhead rotation belt, movement of the printhead rotation belt causing the rotation of the printhead about the pivot. The roller may be driven by the output shaft of the first motor, such that rotation of the output shaft of the first motor causes movement of the printhead rotation belt.

The printer may further comprise a printhead drive mechanism for transporting the printhead along a track extending generally parallel to the printing surface.

The track may extend in a direction parallel to a direction of substrate and/or ribbon transport past the printhead.

The controller may be configured to control the first motor in the second operating mode to cause the printhead to maintain a position in which it is spaced apart from the printing surface by a predetermined separation during transport of the printhead along the track extending generally parallel to the printing surface.

After the completion of the printing of an image, the printhead may be retracted to the ready to print position and moved along the track in a direction substantially parallel to the printing surface, so as to be ready to begin printing a new image.

The controller may be configured to control the first motor in the first operating mode to cause said predetermined pressure to be exerted by the printhead on the printing surface during transport of the printhead along the track extending generally parallel to the printing surface.

During the printing of an image, the printhead may be pressed against the printing surface and moved along the track in a direction substantially parallel to the printing surface, so as to print a plurality of lines of the image.

The predetermined angular displacement may be determined based upon the position of the printhead along the track extending generally parallel to the printing surface.

The printhead drive mechanism may comprise a printhead drive belt operably connected to the printhead and a second motor for controlling movement of the printhead drive belt; wherein movement of the printhead drive belt causes the printhead to be transported along the track extending generally parallel to the printing surface.

The printhead drive belt may pass around a roller driven by the second motor such that rotation of an output shaft of the second motor causes movement of the printhead drive belt, movement of the printhead drive belt causing the printhead to be transported along the track extending generally parallel to the printing surface.

The printhead drive belt may extend generally parallel to the printhead rotation belt. That is, the printhead drive belt (which is arranged to cause the printhead to be transported along the track extending generally parallel to the printing surface) may extend generally parallel to the printhead rotation belt which causes the rotation of the printhead about the pivot.

The printing surface may extend generally parallel to a direction of substrate movement and/or ribbon movement.

The second motor may be a position controlled motor. The second motor may be a stepper motor. The second motor may referred to as a printhead drive motor.

The first motor may be a DC motor. The first motor may be a brushless DC motor, such as, for example a three-phase brushless DC motor.

The printer may be a thermal printer wherein the printhead is configured to be selectively energised so as to generate heat which causes the mark to be created on the substrate.

The printer may be a thermal transfer printer wherein the printhead is configured to be selectively energised so as cause ink to be transferred from an ink carrying ribbon to the substrate so as to cause the mark to be created on the substrate.

The printer may be a thermal transfer printer further comprising: first and second spool supports each being configured to support a spool of ribbon; and a ribbon drive configured to cause movement of ribbon from the first spool support to the second spool support.

The printhead may be configured to be selectively energised so as to generate heat which causes the mark to be created on a thermally sensitive substrate.

According to a second aspect of the invention there is provided a method of controlling a printer, the printer comprising: a printhead configured to selectively cause a mark to be created on a substrate; a first motor coupled to the printhead and arranged to vary the position of the printhead relative to a printing surface against which printing is carried out to thereby control the pressure exerted by the printhead on the printing surface; and a controller arranged to control the first motor. The method comprises controlling the magnitude of current supplied to windings of the first motor so as to cause a predetermined pressure to be exerted by the printhead on the printing surface.

The controller may be arranged to control the first motor in first and second operating modes. The method may comprise, in the first operating mode, controlling the magnitude of current supplied to windings of the first motor so as to cause a predetermined pressure to be exerted by the printhead on the printing surface. The method may comprise, in the second operating mode, controlling the angular position of an output position of the first motor so as to control the position of the printhead relative to the printing surface.

The method may comprise controlling the first motor in the second operating mode to cause the printhead to maintain a position in which it is spaced apart from the printing surface by a predetermined separation.

The method may comprise controlling the first motor in the first operating mode to cause the printhead to move from a position in which it is spaced apart from the printing surface towards the printing surface.

The method may comprise, controlling the first motor so as to cause the printhead to move from a position in which it is pressed against the printing surface to a position spaced apart from the printing surface in the second operating mode.

The method may comprise controlling the first motor in the second operating mode to cause the printhead to maintain a position in which it is spaced apart from the printing surface by a predetermined separation during transport of the printhead along a track extending generally parallel to the printing surface.

The method may comprise controlling the first motor in the first operating mode to cause said predetermined pressure to be exerted by the printhead on the printing surface during transport of the printhead along the track extending generally parallel to the printing surface.

The method may comprise determining a position of the printhead in a direction parallel to the printing surface, and controlling the first motor based upon the position of the printhead in the direction parallel to the printing surface.

Controlling the magnitude of current supplied to the windings of the first motor may comprise controlling the magnitude of the current so as to not exceed a predetermined maximum value.

Controlling the magnitude of current supplied to the windings of the first motor may comprise: determining a target position of the printhead relative to the printing surface; controlling the magnitude of current supplied to the windings of the first motor to cause the printhead to move towards the target position; and, if the current required to cause the printhead to move towards the target position exceeds the predetermined maximum value, controlling the magnitude of the current so as to not exceed the predetermined maximum value.

Controlling the magnitude of current supplied to the windings of the first motor may further comprise: determining a rotational position of an output shaft of the first motor which corresponds to the target position of the printhead; and controlling the magnitude of current supplied to the windings of the first motor to cause the output shaft of the first motor to move towards the determined rotational position.

Controlling the magnitude of current supplied to the windings of the first motor may further comprise: determining an actual position of the printhead in a direction parallel to the printing surface; wherein determining the rotational position of the output shaft of the first motor which corresponds to the target position of the printhead is based upon the actual position of the printhead in a direction parallel to the printing surface.

According to a third aspect of the invention there is provided a printer comprising a printhead configured to selectively cause a mark to be created on a substrate. The printer comprises a stepper motor having an output shaft coupled to the printhead, the stepper motor being arranged to vary the position of the printhead relative to a printing surface against which printing is carried out, and to control the pressure exerted by the printhead on the printing surface. The printer further comprises a sensor configured to generate a signal indicative of an angular position of the output shaft of the stepper motor. The printer further comprises a controller arranged to generate control signals for the stepper motor so as to cause a predetermined torque to be generated by the stepper motor; said control signals being at least partially based upon an output of said sensor.

In contrast to conventional DC-servo motor control techniques, in which a torque generated by a motor is controlled by monitoring current flowing in windings of the motor and controlling the current in order to achieve a desired level (which corresponds to a desired torque output), the control of a stepper motor to generate a predetermined torque uses positional feedback, thereby allowing the commutation of currents supplied to the motor to be controlled so as to cause the magnetic field generated by the energised windings of the motor to have an orientation which causes a predetermined torque to be generated. Current feedback may also be used so as to allow the controller to cause that a desired current to flow in the motor windings. Thus, there are two parameters which can be controlled (field orientation and current magnitude) in order to achieve a directed motor output characteristic (e.g. generated torque).

Said control signals for the stepper motor may be arranged to cause a magnetic field to be generated by windings of the stepper motor, a field angle being defined between an angular position of the output shaft of the stepper motor, and an orientation of the generated magnetic field. Said generation of control signals may be controlled so as to cause said field angle to have a predetermined value.

By use of an encoder associated with the output shaft of the stepper motor, it is possible to provide accurate positional information regarding the actual rotor position, thereby allowing the field angle to be accurately controlled. Control of the field angle in this way allows a maximum output torque to be generated by the motor for a given current level, while also reducing the risk that a stepper motor will stall. In this way, it is possible to provide a smaller stepper motor (i.e. one having a smaller maximum torque capacity), and a correspondingly smaller power supply for a given torque requirement. That is, rather than having to provide an excess torque capacity, so as to prevent against stall conditions (and the associated loss of motor control), the motor can be controlled in a closed-loop field controlled manner to generate a maximum torque at all times, without any risk that the motor will stall. The signal indicative of the angular position of the motor output shaft can thus be used to update the control signals supplied to the motor, so as to cause the magnetic field to rotate, thereby maintaining the predetermined (and optimal) field angle.

The control signals for the stepper motor may comprise control signals supplied to windings of the stepper motor.

The predetermined value of the field angle may be based upon a motor output characteristic. The motor output characteristic may comprise a desired motor output characteristic.

The motor output characteristic may comprise a maximum torque output. For example, a stepper motor may generate a maximum torque for a given magnitude of winding current when the field angle has a predetermined value (e.g. 90 electrical degrees).

The generated magnetic field may have a predetermined angular orientation with respect to a housing of said stepper motor.

The predetermined angular orientation with respect to the housing of said stepper motor may be varied in order to maintain the value of the field angle at said predetermined value. That is, the motor housing may be physically stationary (with respect to the body of the printer), with the generated magnetic field at any point in time having a predetermined angular orientation with respect to the housing. However, the predetermined angular orientation may be controlled as required (for example based upon rotation of the rotor) so as to maintain the value of the field angle at said predetermined value.

The control signals may be generated based upon the signal indicative of an angular position of the output shaft of the stepper motor so as to cause the field angle to have said predetermined value.

The control signals may be generated so as to cause said magnetic field to have a predetermined magnitude.

In this way, both the field angle and the field magnitude can be controlled independently. For example, in one control mode, the field angle may be set to 90 electrical degrees, so as to provide a maximum torque.

The controller may be arranged to control the stepper motor so as to cause a predetermined pressure to be exerted by the printhead on the printing surface. The predetermined pressure may correspond to said predetermined torque.

The controller may be arranged to control the stepper motor in first and second operating modes. In the first operating mode, the controller may be arranged to control the stepper motor so as to cause a predetermined pressure to be exerted by the printhead on the printing surface. In the second operating mode, the controller may be arranged to control the angular position of an output shaft of the stepper motor so as to control the position of the printhead relative to the printing surface.

In the second operating mode the printhead may be spaced apart from the printing surface.

In the first operating mode, the stepper motor may be controlled based upon said output of said sensor.

In the first operating mode, the controller may be arranged to generate control signals for the stepper motor so as to cause said predetermined torque to be generated by the stepper motor; said control signals being at least partially based upon said output of said sensor.

Said controller may be configured to control the stepper motor in the second operating mode to cause the printhead to maintain a position in which it is spaced apart from the printing surface by a predetermined separation.

Said controller may be configured to control the stepper motor in the first operating mode to cause the printhead to move from a position in which it is spaced apart from the printing surface towards the printing surface.

Said controller may be configured to control the stepper motor so as to cause the printhead to move from a position in which it is pressed against the printing surface to a position spaced apart from the printing surface in the second operating mode.

Generating control signals for the stepper motor so as to cause a predetermined torque to be generated by the stepper motor may comprise generating control signals for the stepper motor so as to cause a predetermined magnitude of current to flow in windings of the stepper motor.

Causing said predetermined magnitude of current to flow in windings of the stepper motor may comprise providing a pulse width modulated signal to said windings. Causing said predetermined magnitude of current may comprise controlling a duty cycle of the pulse width modulated signal provided to said windings. Causing said predetermined magnitude of current may comprise controlling an average current flowing in said windings.

The printhead may be rotatable about a pivot and wherein the stepper motor is arranged to cause rotation of the printhead about the pivot to vary the position of the printhead relative to the printing surface.

The printer may further comprise a printhead assembly, the printhead assembly may comprise a first arm and a second arm. The first arm may be coupled to the stepper motor, and the printhead may be disposed on the second arm. The stepper motor may be arranged to cause movement of the first arm, thereby causing rotation of the second arm about the pivot, and causing the position of the printhead relative to the printing surface to vary.

The stepper motor may be coupled to the first arm via a flexible linkage. The linkage may be a printhead rotation belt.

The printhead rotation belt may pass around a roller driven by the output shaft of the stepper motor such that rotation of the output shaft of the stepper motor causes movement of the printhead rotation belt, movement of the printhead rotation belt causing the rotation of the printhead about the pivot.

The printer may further comprise a printhead drive mechanism for transporting the printhead along a track extending generally parallel to the printing surface.

The controller may be configured to control the stepper motor in the second operating mode to cause the printhead to maintain a position in which it is spaced apart from the printing surface by a predetermined separation during transport of the printhead along the track extending generally parallel to the printing surface.

The controller may be configured to control the first motor in the first operating mode to cause said predetermined pressure to be exerted by the printhead on the printing surface during transport of the printhead along the track extending generally parallel to the printing surface.

The printhead drive mechanism may comprise a printhead drive belt operably connected to the printhead and a second motor for controlling movement of the printhead drive belt; wherein movement of the printhead drive belt causes the printhead to be transported along the track extending generally parallel to the printing surface.

The printhead drive belt may pass around a roller driven by the second motor such that rotation of an output shaft of the second motor causes movement of the printhead drive belt, movement of the printhead drive belt causing the printhead to be transported along the track extending generally parallel to the printing surface.

The second motor may be a position controlled motor. The second motor may be a stepper motor. The second motor may be controlled in a speed controlled manner.

According to a fourth aspect of the invention there is provided a printer comprising a printhead configured to selectively cause a mark to be created on a substrate. The printer further comprises a first motor coupled to the printhead and arranged to vary the position of the printhead relative to a printing surface against which printing is carried out, and to control the pressure exerted by the printhead on the printing surface. The printer further comprises a printhead drive mechanism for transporting the printhead along a track extending generally parallel to the printing surface, the printhead drive mechanism comprising a printhead drive belt operably connected to the printhead, and a second motor for controlling movement of the printhead drive belt; wherein movement of the printhead drive belt causes the printhead to be transported along the track extending generally parallel to the printing surface. The printer further comprises a controller arranged to control the first motor. The controller is arranged to generate control signals for the first motor so as to cause a predetermined pressure to be exerted by the printhead on the printing surface. Said control signals are generated at least partially based upon a torque generated by said second motor.

Due to the mechanical coupling between second motor and the printhead (via the printhead drive belt) torque generated by the second motor influences the pressure exerted by the printhead on the printing surface. Thus, the control signals for the first motor may be generated taking into account the torque generated by said second motor so as to ensure that the predetermined pressure is exerted by the printhead on the printing surface during printing operations.

The first motor may be referred to as a printhead motor. The second motor may be referred to as a printhead carriage motor. The printhead may be mounted to a printhead carriage, the printhead carriage being configured to be the transported along the track extending generally parallel to the printing surface.

The second motor may be controlled in a position controlled manner to control the movement of the printhead in a direction generally parallel to the printing surface. The second motor may be controlled in a speed controlled manner to control the movement of the printhead in a direction generally parallel to the printing surface.

The first motor may be controlled in a torque controlled manner so as to cause a predetermined pressure to be exerted by the printhead on the printing surface. The controller may be arranged to generate control signals for the first motor so as to cause a predetermined torque to be generated by the first motor, and to thereby cause said predetermined pressure to be exerted by the printhead on the printing surface.

The control signals for the first motor may be generated at least partially based upon a signal indicative of torque generated by said second motor.

The control signals for the first motor may be generated at least partially based upon a control signal for the second motor.

The control signals for the first motor may be generated at least partially based upon a signal indicative of a rotational velocity and/or a change in rotational velocity of the second motor.

It may be known that during a phase of acceleration, or deceleration, or constant speed movement of the second motor (and therefore the printhead, in the direction generally parallel to the printing surface), a particular, or predetermined, level of torque is required to be applied to the first motor in order to cause a predetermined pressure to be exerted by the printhead on the printing surface.

The control signals for the first motor may be generated at least partially based upon a signal indicative of an angular position the output shaft of the second motor.

The angular position the output shaft of the second motor may correspond to a linear position of the printhead in a direction generally parallel to the printing surface, and thus a particular torque requirement. For example, a known relationship may exist between the linear position of the printhead in a direction generally parallel to the printing surface and the torque applied by the second motor. That is, for a print feed having a known length, and for which the speed and acceleration profile is known, the linear position of the printhead may be indicative of the acceleration or speed of (and thus torque applied by) the second motor. Therefore, knowledge of the linear position of the printhead in a direction generally parallel to the printing surface, allows a torque requirement of the first motor to be derived.

The printhead may be rotatable about a pivot. The first motor may be arranged to cause rotation of the printhead about the pivot to vary the position of the printhead relative to the printing surface.

The printer may further comprise a printhead assembly, the printhead assembly comprising a first arm and a second arm, the first arm being coupled to the first motor, and the printhead being disposed on the second arm, wherein the first motor is arranged to cause movement of the first arm, thereby causing rotation of the second arm about the pivot, and causing the position of the printhead relative to the printing surface to vary.

The first motor may be coupled to the first arm via a flexible linkage. The linkage may be a printhead rotation belt.

The printhead rotation belt may pass around a roller driven by the output shaft of the first motor such that rotation of the output shaft of the first motor causes movement of the printhead rotation belt, movement of the printhead rotation belt causing the rotation of the printhead about the pivot.

The printhead drive belt may pass around a roller driven by the second motor such that rotation of an output shaft of the second motor causes movement of the printhead drive belt, movement of the printhead drive belt causing the printhead to be transported along the track extending generally parallel to the printing surface.

According to a fifth aspect of the invention there is provided a printer comprising a printhead configured to selectively cause a mark to be created on a substrate. The printer further comprises a first motor coupled to the printhead and arranged to vary the position of the printhead relative to a printing surface against which printing is carried out, and to control the pressure exerted by the printhead on the printing surface. The printer further comprises a printhead assembly, the printhead assembly comprising a first arm and a second arm, the printhead being disposed on the second arm, wherein the first motor is coupled to the first arm via a printhead rotation belt, the printhead rotation belt passing around a roller driven by the output shaft of the first motor such that rotation of the output shaft of the first motor causes movement of the printhead rotation belt, movement of the printhead rotation belt causing movement of the first arm, thereby causing rotation of the second arm about a pivot, thereby causing the position of the printhead relative to the printing surface to vary. The printer further comprises a printhead drive mechanism for transporting the printhead along a track extending generally parallel to the printing surface, the printhead drive mechanism comprising a printhead drive belt operably connected to the printhead and a second motor for controlling movement of the printhead drive belt; wherein movement of the printhead drive belt causes the printhead to be transported along the track extending generally parallel to the printing surface. The printer further comprises a controller arranged to control the first motor, wherein the controller is arranged to generate control signals for the first motor so as to cause a predetermined torque to be generated by the first motor, and to thereby cause a predetermined pressure to be exerted by the printhead on the printing surface, and the predetermined torque is at least partially based upon a signal indicative of a rotational speed of the output shaft of the first motor, and a signal indicative of a rotational speed of an output shaft of the second motor.

Where the printhead position is controlled by two drive belts, one responsible for movement in a direction perpendicular to the printing surface (which is driven by the first motor), and one responsible for movement in a direction parallel to the printing surface (which is driven by the second motor), it will be understood that to maintain a position of the printhead in a direction perpendicular to the printing surface, and therefore to maintain a predetermined printing force, each of the first and second motors should rotate according to a predetermined relationship (and where a similar geometry is used for each belt, and associated drive components, the motors should rotate in a synchronised manner). Thus, an error signal which is generated based upon the rotational speed of each of the motors will be related to a printing force error. Such an error signal can be used to control the first motor, so as to identify any deviation in the speed of the first motor from that expected based upon the speed of the second motor, and therefore to allow for correction for any errors in the printhead pressure. That is, in contrast to a conventional closed-loop position controlled technique in which a positional error may be used to adjust a target position, the torque applied to the first motor (which is operated in a torque controlled manner) may be varied based upon the speed (or velocity) error signal, in order to reduce oscillations in printhead pressure.

The control signals for the first motor may thus be generated based upon said error signal. The control signals for the first motor may be generated so as to cause a predetermined torque to be generated by the first motor, said predetermined torque being based upon said predetermined pressure and said error signal.

In this way, signals indicative of a speed error can be used to vary the torque generated by the first motor, thereby correcting for any errors in printhead pressure which may, for example, be caused by oscillations of the printhead (e.g. due to resilience in printhead drive components, or the printing surface). The modification of motor drive signals in this way may be considered to be a form of damping, and in particular, active damping.

The signal indicative of a rotational speed of the output shaft of the first motor may comprise a signal indicative of a rotational velocity of the output shaft of the first motor.

The signal indicative of a rotational speed of the output shaft of the second motor may comprise a signal indicative of a rotational velocity of the output shaft of the second motor. It will be understood that where a signal indicative of a rotational speed is present, a signal indicative of a direction of rotation may also be provided, allowing a rotational velocity to be determined.

Said control signals for the first motor may be generated based upon a comparison between said signal indicative of a rotational speed of the output shaft of the first motor, and said signal indicative of a rotational speed of an output shaft of the second motor.

The predetermined torque may be at least partially based upon said predetermined pressure.

The predetermined torque may comprise a first component which is based upon said predetermined pressure, and a second component which is based upon said signal indicative of said rotational speed of the output shaft of the first motor and said signal indicative of said rotational speed of the output shaft of the second motor.

The first component may be considered to be a fixed component. The second component may be considered to be a variable component.

Said signal indicative of said rotational speed of the output shaft of the first motor may be based upon a signal indicative of a rotational position of the output shaft of the first motor. A rotational position of the output shaft of the first motor may correspond to a position of the printhead in a direction generally perpendicular to the printing surface.

The first motor may be controlled in a torque controlled manner, so as to cause the predetermined pressure to be exerted by the printhead on the printing surface.

Said signal indicative of said rotational speed of the output shaft of the second motor may be based upon a signal indicative of a rotational position of the output shaft of the second motor.

The rotational position of the output shaft of the second motor may correspond to a linear position of the printhead in a direction generally parallel to the printing surface.

Said signal indicative of said rotational speed of an output shaft of the second motor may be based upon a control signal for the second motor.

The second motor may be controlled in a position controlled manner to control the movement of the printhead in a direction generally parallel to the printing surface. The second motor may be controlled in a speed controlled manner to control the movement of the printhead in a direction generally parallel to the printing surface.

The printhead drive belt may pass around a roller driven by the second motor such that rotation of an output shaft of the second motor causes movement of the printhead drive belt, movement of the printhead drive belt causing the printhead to be transported along the track extending generally parallel to the printing surface.

The controller may be arranged to control the first motor in first and second operating modes. In the first operating mode, the controller may be arranged to control the first motor so as to cause a predetermined pressure to be exerted by the printhead on the printing surface. In the second operating mode, the controller may be arranged to control the angular position of an output shaft of the first motor so as to control the position of the printhead relative to the printing surface. The first operating mode may be referred to as a torque controlled mode. The second operating mode may be referred to as a position controlled mode.

The controller may be arranged to control the first motor in a third operating mode. In the third operating mode, the controller may be arranged to control the first motor so as to cause an output shaft of the first motor to rotate at a predetermined speed. The third operating mode may be referred to as a speed controlled mode.

In the third operating mode, the controller may be arranged to control the angular position of an output shaft of the first motor so as cause the output shaft of the first motor to rotate at the predetermined speed. The third operating mode may therefore be considered to be an embodiment of the second operating mode.

In the second operating mode the printhead may be spaced apart from the printing surface.

The controller may be arranged to control the first motor based upon a signal indicative of a rotational position of the output shaft of the first motor. In the first operating mode, the first motor may be controlled based upon a signal indicative of a rotational position of the output shaft of the first motor.

The first motor may be a stepper motor.

The printer may further comprise a sensor configured to generate a signal indicative of an angular position of the output shaft of the first motor. In the first operating mode, the controller may be arranged to generate control signals for the stepper motor so as to cause a predetermined torque to be generated by the stepper motor; said control signals being at least partially based upon an output of said sensor.

In the third operating mode, the controller may be arranged to generate control signals for the stepper motor so as to cause the output shaft of the first motor to rotate at a predetermined speed; said control signals being at least partially based upon an output of said sensor. The third operating mode may be referred to as a closed-loop speed controlled mode.

In the third operating mode, the controller may be arranged to generate control signals for the stepper motor so as to cause a predetermined torque to be generated by the stepper motor; said predetermined torque being at least partially based upon an output of said sensor and said predetermined speed. That is, sufficient torque may be generated by the motor to cause the output shaft to move at the predetermined speed.

Said control signals for the first motor may be arranged to cause a magnetic field to be generated by windings of the first motor, a field angle being defined between an angular position of the output shaft of the first motor, and an orientation of the generated magnetic field. Said generation of control signals may be controlled so as to cause said field angle to have a predetermined value.

Further features described above in combination with the third aspect of the invention may be combined with either of the fourth or fifth aspects of the invention. Conversely, features described in combination with the fourth or fifth aspects of invention may be combined with each other, or with the third aspect of the invention.

Said controller may be configured to control the first motor in the second operating mode to cause the printhead to maintain a position in which it is spaced apart from the printing surface by a predetermined separation.

Said controller may be configured to control the first motor in the third operating mode to cause the printhead to move from a position in which it is spaced apart from the printing surface towards the printing surface. The first motor may be controlled to cause the printhead to move from a position in which it is spaced apart from the printing surface towards the printing surface according to a predetermined motion profile. The predetermined motion profile may comprise data indicative of a target speed for the first motor during said movement of the printhead towards the printing surface. The predetermined motion profile may be generated based upon data indicative of the location of the printing surface. Said data indicative of the location of the printing surface may be based upon a signal indicative of an angular position of the output shaft of the first motor.

Said controller may be configured to control the first motor in the first operating mode to cause the printhead to move from a position in which it is spaced apart from the printing surface towards the printing surface.

Said controller may be configured to control the first motor so as to cause the printhead to move from a position in which it is pressed against the printing surface to a position spaced apart from the printing surface in the second operating mode.

Generating control signals for the first motor so as to cause a predetermined torque to be generated by the first motor may comprise generating control signals for the first motor so as to cause a predetermined magnitude of current to flow in windings of the first motor.

Causing said predetermined magnitude of current to flow in windings of the first motor may comprise providing a pulse width modulated signal to said windings. Causing said predetermined magnitude of current may comprise controlling a duty cycle of the pulse width modulated signal provided to said windings. Causing said predetermined magnitude of current may comprise controlling an average current flowing in said windings.

The controller may be configured to control the first motor in the second operating mode to cause the printhead to maintain a position in which it is spaced apart from the printing surface by a predetermined separation during transport of the printhead along the track extending generally parallel to the printing surface.

The controller may be configured to control the first motor in the first operating mode to cause said predetermined pressure to be exerted by the printhead on the printing surface during transport of the printhead along the track extending generally parallel to the printing surface.

The second motor may be a position controlled motor. The second motor may be a stepper motor. The second motor may be controlled in a speed controlled manner.

A printer according to any of the first, third, fourth and fifth aspects of the invention may be a thermal printer. The printhead may be configured to be selectively energised so as to generate heat which causes the mark to be created on the substrate.

The printer may be a thermal transfer printer. The printhead may be configured to be selectively energised so as cause ink to be transferred from an ink carrying ribbon to the substrate so as to cause the mark to be created on the substrate.

The thermal transfer printer may further comprise first and second spool supports each being configured to support a spool of ribbon, and a ribbon drive configured to cause movement of ribbon from the first spool support to the second spool support.

The printhead may be configured to be selectively energised so as to generate heat which causes the mark to be created on a thermally sensitive substrate.

According to a sixth aspect of the invention there is provided a thermal transfer printer comprising first and second spool supports each being configured to support a spool of ink carrying ribbon, a ribbon drive configured to cause movement of ribbon from the first spool support to the second spool support, and a printhead configured to be selectively energised so as cause ink to be transferred the ribbon to the substrate so as to cause a mark to be created on the substrate. The ribbon drive comprises a stepper motor having an output shaft operably associated with one of said spool supports, the stepper motor being arranged to cause said one of the spool supports to rotate to cause said movement of ribbon from the first spool support to the second spool support. The ribbon drive further comprises a sensor configured to generate a signal indicative of an angular position of the output shaft of the stepper motor, and a controller arranged to generate control signals for the stepper motor so as to cause a predetermined torque to be generated by the stepper motor; said control signals being at least partially based upon an output of said sensor.

The control of the stepper motor to generate a predetermined torque uses positional feedback, thereby allowing the commutation of currents supplied to the motor to be controlled so as to cause the magnetic field generated by the energised windings of the motor to have an orientation which causes a predetermined torque to be generated. Current feedback may also be used so as to allow the controller to cause that a desired current to flow in the motor windings. Thus, there are two parameters which can be controlled (field orientation and current magnitude) in order to achieve a directed motor output characteristic (e.g. generated torque).

Said control signals for the stepper motor may be arranged to cause a magnetic field to be generated by windings of the stepper motor, a field angle being defined between an angular position of the output shaft of the stepper motor, and an orientation of the generated magnetic field. Said generation of control signals may be controlled so as to cause said field angle to have a predetermined value.

By use of an encoder associated with the output shaft of the stepper motor, it is possible to provide accurate positional information regarding the actual rotor position, thereby allowing the field angle to be accurately controlled. Control of the field angle in this way allows a maximum output torque to be generated by the motor for a given current level, while also reducing the risk that a stepper motor will stall. In this way, it is possible to provide a smaller stepper motor (i.e. one having a smaller maximum torque capacity), and a correspondingly smaller power supply for a given torque requirement. That is, rather than having to provide an excess torque capacity, so as to prevent against stall conditions (and the associated loss of motor control), the motor can be controlled in a closed-loop field controlled manner to generate a maximum torque at all times, without any risk that the motor will stall. The signal indicative of the angular position of the motor output shaft can thus be used to update the control signals supplied to the motor, so as to cause the magnetic field to rotate, thereby maintaining the predetermined (and optimal) field angle.

The controller may be arranged to control the stepper motor so as to cause a predetermined tension to be established in the ribbon being transported between the first and second spools. The predetermined torque may be based upon a predetermined tension.

The first spool support may be a supply spool support. The second spool support may be a takeup spool support.

The output shaft of the stepper motor may be operably associated with said takeup spool support. The controller may be arranged to control the stepper motor so as to cause said predetermined torque to be exerted by the takeup spool support on a takeup spool mounted thereon.

By controlling the takeup spool in a torque controlled manner, the tension in the ribbon extending between the takeup spool to the printhead can be accurately controlled. In this way, the angle of ribbon passing the printhead (which may be referred to as a peel angle) can be maintained, so as to ensure the ink is peeled from the ribbon in a controlled and optimal way.

The stepper motor may be a first stepper motor. The ribbon drive may further comprise a second stepper motor. An output shaft of the second stepper motor may be operably associated with said supply spool support.

The ribbon drive may further comprise a second sensor configured to generate a signal indicative of an angular position of the output shaft of the second stepper motor, the controller being arranged to generate control signals for the second stepper motor so as to cause a predetermined torque to be generated by the second stepper motor; said control signals being at least partially based upon an output of said second sensor.

The controller may be configured to control the first stepper motor in a first operating mode and control the second stepper motor in a second operating mode different from the first operating mode.

In the first operating mode, the controller may be arranged to control the first stepper motor so as to cause said predetermined torque to be exerted by the takeup spool support on a spool mounted thereon. The first operating mode may be referred to as a torque controlled mode.

In the second operating mode, the controller may be arranged to control the angular position of an output shaft of the second stepper motor so as to control the angular position of the supply spool support. The second operating mode may be referred to as a position controlled mode. In the second operating mode, the controller may be arranged to control the angular position of an output shaft of the second stepper motor so as to control the angular speed of the supply spool support. The second operating mode may alternatively be referred to as a speed controlled mode.

The controller may be arranged to control the first stepper motor in the first operating mode when the printhead is caused to exert a predetermined pressure on the printing surface during printing operations. The controller may be arranged to control the second stepper motor in the second operating mode when the printhead is caused to exert a predetermined pressure on the printing surface during printing operations.

That is, during printing operations, when the tension in the printing ribbon is an important characteristic, the first motor may be controlled in a torque controlled mode so as to maintain the ribbon tension at a predetermined level, while the second motor is controlled in a position (or speed) controlled manner to advance the ribbon between the spools in a position (or speed) controlled way.

The controller may be arranged to control the first stepper motor in the second operating mode when the printhead is spaced apart from the printing surface between printing operations. Between printing operations, both motors may be controlled in a position (or speed) controlled manner, so as to accelerate or decelerate the ribbon in a controlled manner, or to rewind ribbon from the takeup spool to the supply spool. During such operations, maintaining a predetermined the tension in the ribbon may be less important than during printing operations.

According to a seventh aspect of the invention there is provided a method of operating a printer according to any of the third to sixth aspects of the invention.

Any feature described in the context of one aspect of the invention can be applied to other aspects of the invention. For example, features described in the context of the first aspect of the invention can be applied to the second aspect of the invention. Similarly, features described in the context of the first aspect of the invention may be applied to the third to seventh aspects of the invention. Further, features described in the context of any of the third to sixth aspects of the invention may be combined with other ones of the third to sixth aspects of the invention or the seventh aspect of the invention.

Embodiments of the invention will now be described, by way of example, with reference to the accompanying drawings, in which.

Figure 1:
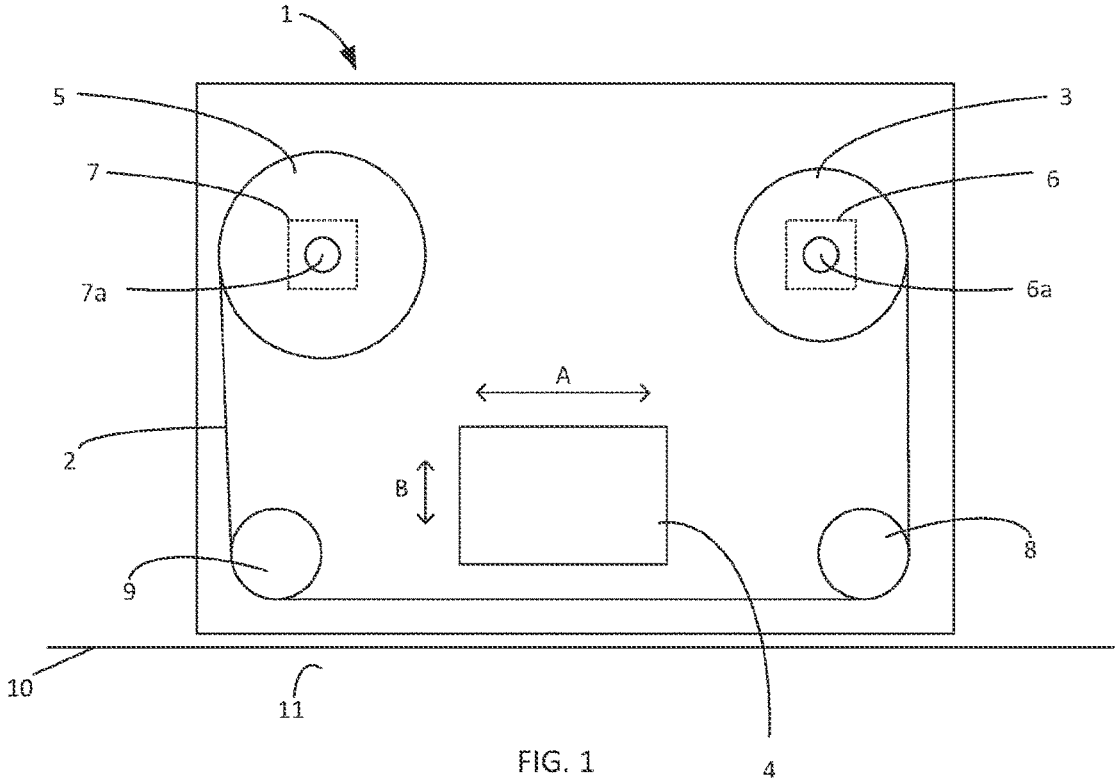
FIG. 1 is a schematic illustration of a printer in accordance with the present invention.

Referring to FIG. 1, there is illustrated a thermal transfer printer 1 in which ink carrying ribbon 2 is provided on a ribbon supply spool 3, passes a printhead assembly 4 and is taken up by a ribbon take-up spool 5. The ribbon supply spool 3 is driven by a stepper motor 6 while the ribbon take-up spool is driven by a stepper motor 7. In the illustrated embodiment the ribbon supply spool 3 is mounted on an output shaft 6*a* of its stepper motor 6 while the ribbon take-up spool 5 is mounted on an output shaft 7*a* of its stepper motor 7. The stepper motors 6, 7 may be arranged so as to operate in push-pull mode whereby the stepper motor 6 rotates the ribbon supply spool 3 to pay out ribbon while the stepper motor 7 rotates the ribbon take-up spool 5 so as to take up ribbon. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

In other embodiments the ribbon may be transported from the ribbon supply spool 3 to the ribbon take up spool 5 past the printhead assembly 4 in other ways. For example only the ribbon take up spool 5 may be driven by a motor while the ribbon supply spool 3 is arranged so as to provide resistance to ribbon motion, thereby causing tension in the ribbon. That is, the motor 6 driving the ribbon supply spool 5 may not be required in some embodiments. Resistance to ribbon movement may be provided by a slipping clutch arrangement on the supply spool. In some embodiments the motors driving the ribbon supply spool 5 and the ribbon take up spool 7 may be motors other than stepper motors. For example the motors driving the ribbon supply spool 5 and the ribbon take up spool 7 may be direct current (DC) motors. In general the motors driving the ribbon supply spool 5 and/or the ribbon take up spool 7 may be motors which are commonly referred to as torque controlled torque controlled motors (e.g. DC motors) or motors which are commonly referred to as position controlled motors (e.g. stepper motors, or DC servo motors).

Ribbon paid out by the ribbon supply spool 3 passes a guide roller 8 before passing the printhead assembly 4, and a further guide roller 9 and subsequently being taken up by the ribbon take up spool 5.

The printhead assembly 4 comprises a printhead (not shown) which presses the ribbon 2, and a substrate 10 against a printing surface 11 to effect printing. The printhead is a thermal transfer printhead comprising a plurality of printing elements, each arranged to remove a pixel of ink from the ribbon 2 and to deposit the removed pixel of ink on the substrate 10.

The printhead assembly 4 is moveable in a direction generally parallel to the direction of travel of the ribbon 2 and the substrate 10 past the printhead assembly 4, as shown by an arrow A. Further, at least a portion of the printhead assembly 4 is moveable towards and away from the substrate 10, so as to cause the ribbon 2 (when passing the printhead) to move into and out of contact with the substrate 10, as shown by arrow B.

Figure 2:
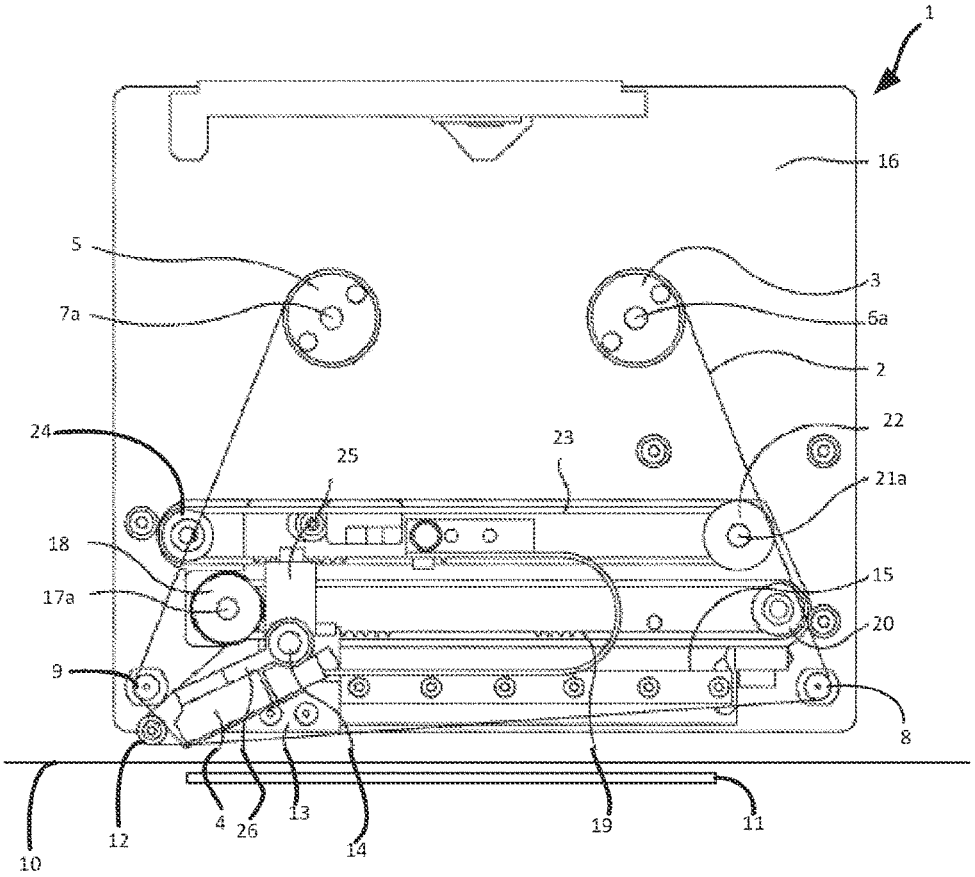
FIG. 2 is an illustration showing the printer of FIG. 1 in further detail.
Figure 3:
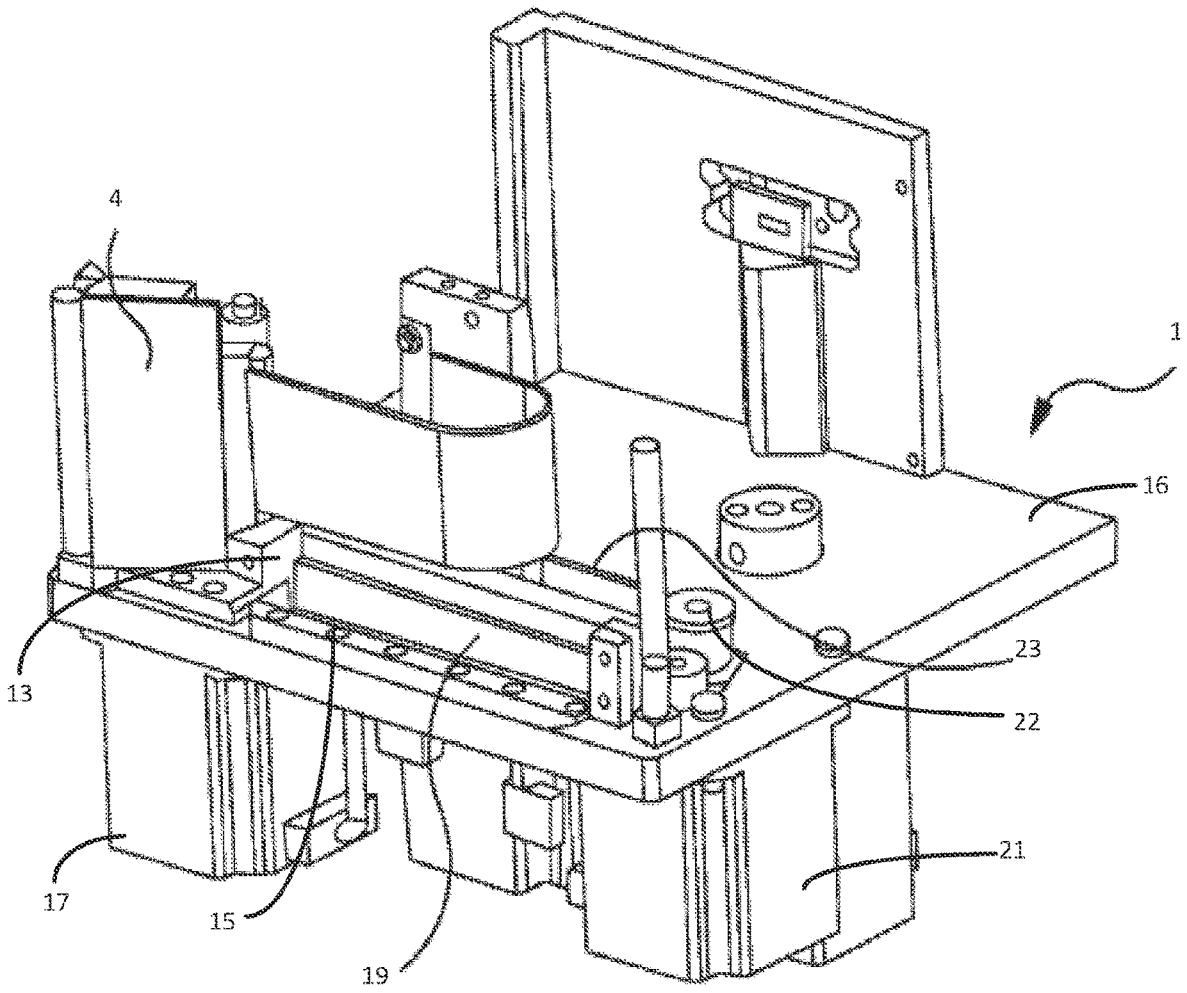
FIG. 3 is a perspective illustration showing the printer of FIG. 1 in further detail.

Referring now to FIGS. 2 and 3, the printer 1 is described in more detail. The printhead assembly 4 further comprises a guide roller 12, around which the ribbon 2 passes between the roller 9, and the printhead. The printhead assembly 4 is pivotally mounted to a printhead carriage 13 for rotation about a pivot 14 thereby allowing the printhead to be moved towards or away from the printing surface 11. The printhead carriage 13 is displaceable along a linear track 15, which is fixed in position relative to a base plate 16 of the printer 1.

The position of the printhead carriage 13 in the direction of ribbon movement (and hence position of the printhead assembly 4) is controlled by a carriage motor 17 (see FIG. 3). The carriage motor 17 is located behind the base plate 16 and drives a pulley wheel 18 that is mounted on an output shaft 17*a* of the carriage motor 17. The pulley wheel 18 in turn drives a printhead drive belt 19 extending around a further pulley wheel 20. The printhead carriage 13 is secured to the printhead drive belt 19. Thus rotation of the pulley wheel 18 in the clockwise direction drives printhead carriage 13 and hence the printhead assembly 4 to the left in FIG. 2 whereas rotation of the pulley wheel 18 in the counter-clockwise direction in FIG. 2 drives the printhead assembly 4 to the right in FIG. 2.

The movement of the printhead towards and away from the printing surface 11 (and hence the pressure of the printhead against the ribbon 2, the substrate 10, and the printing surface 11) is controlled by a motor 21. The motor 21 is also located behind the base plate 16 (see FIG. 3) and drives a pulley wheel 22 that is mounted on an output shaft of the motor 21. The pulley wheel 22 in turn drives a printhead rotation belt 23 extending around a further pulley wheel 24. The printhead assembly 4 comprises a first arm 25, and a second arm 26, which are arranged to pivot about the pivot 14. The first arm 25 is connected to the printhead rotation belt 23, such that when the printhead rotation belt 23 moves the first arm 25 is also caused to move. The printhead is attached to the second arm 26. Assuming that the pivot 14 remains stationary (i.e. that the printhead carriage 13 does not move), it will be appreciated that movement of the printhead rotation belt 23, causes movement of the first arm 25, and a corresponding movement of the second arm 26 about the pivot 14, and hence the printhead. Thus rotation of the pulley wheel 22 in the clockwise direction drives the first arm 25 in to the left in FIG. 2, causing the second arm 26 to move in a generally downward direction, and the printhead assembly 4 to move towards the printing surface 11. On the other hand, rotation of the pulley wheel 22 in the counter-clockwise direction in FIG. 2 causes the printhead assembly 4 to move away from the printing surface 11.

The belts 19, 23 may be considered to be a form of flexible linkage. However, the term flexible linkage is not intended to imply that the belts behave elastically. That is, the belts 19, 23 are relatively inelastic in a direction generally parallel to the direction of travel of the ribbon 2 and the substrate 10 past the printhead assembly 4 (i.e. the direction which extends between the pulley wheel 22 and the further pulley wheel 24). It will be appreciated, of course, that the belts 19, 23 will flex in a direction perpendicular to the direction of travel of the ribbon 2 and the substrate 10 past the printhead assembly 4, so as to allow the belts 19, 23 to move around the pulleys 18, 20, 22, 24. Further, the printhead rotation belt 23 will flex in a direction perpendicular to the direction of travel of the ribbon 2 and the substrate 10 past the printhead assembly 4, so as to allow for the arc of movement of the first 25 arm about the pivot 14. However, in general, it will be understood that the relative inelasticity ensures that any rotation of the pulley wheel 22 caused by the motor 21 is substantially transmitted to, and causes movement of, the first arm 25, and hence the printhead. The belts 19, 23 may, for example, be polyurethane timing belts with steel reinforcement. For example, the belts 19, 23 may be AT3 GEN III Synchroflex Timing Belts manufactured by BRECOflex CO., L.L.C., New Jersey, United States.

The arc of movement of the printhead with respect to the pivot 14 is determined by the location of the printhead relative to the pivot 14. The extent of movement of the printhead is determined by the relative lengths of the first and second arms 25, 26, and the distance moved by the printhead rotation belt 23. Thus, by controlling the motor 21 to cause the motor shaft (and hence pulley wheel 22) to move through a predetermined angular distance, the printhead can be moved by a corresponding predetermined distance towards or away from the printing surface 11.

It will further be appreciated that a force applied to the first arm 25 by the printhead rotation belt 23 will be transmitted to the second arm 26 and the printhead. Thus, if movement of the printhead is opposed by it coming into contact with a surface (such as, for example, the printing surface 11), then the force exerted by the printhead on the printing surface 11 will be determined by the force exerted on the first arm 25 by the printhead rotation belt 23—albeit with necessary adjustment for the geometry of the first and second arms 25, 26. Further, the force exerted on the first arm 25 by the printhead rotation belt 23 is in turn determined by the torque applied to the printhead rotation belt 23 by the motor 21 (via pulley wheel 22).

Thus, by controlling the motor 21 to output a predetermined torque, a corresponding predetermined force (and corresponding pressure) can be established between the printhead and the printing surface 11. That is, the motor 21 can be controlled to move the printhead towards and away from the printing surface 11, and thus to determine the pressure which the printhead applies to the printing surface 11. The control of the applied pressure is important as it is a factor which affects the quality of printing.

The description above assumes that the pivot 14 is stationary as the printhead is moved towards and away from the printing surface 11. Such an arrangement may, for example, be used to effect continuous printing. However, in some printing modes, such as, for example, intermittent printing, it is required for the printhead to move in the direction of substrate movement during a printing operation. Such movement is effected by moving the carriage 13 along the linear track 15 under the control of the carriage motor 17, as described above.

However, it will be appreciated that any movement of the printhead carriage 13, without a corresponding movement of the printhead rotation belt 23 will cause the first and second arms 25, 26 of the printhead assembly 4 to rotate about the pivot 14, moving the printhead towards or away from the printing surface 11. Thus, to ensure a stable printhead pressure and position during printhead movement, it is necessary to control the motors 17, 21 so as to drive the printhead drive and printhead rotation belts 19, 23 in a coordinated manner.

The movement of the printhead towards and away from the printing surface when the position of the pivot 14 is also moving is carried out in a similar manner to the situation described above where the position of the pivot 14 is fixed. However, control of motor 21, and thus control of the movement of the printhead rotation belt 23, is carried out relative to the position of the printhead drive belt 19, rather than to any fixed datum on the base plate 16.

For example, in order to maintain a predetermined separation between the printhead and the printing surface 11 during movement of the printhead carriage 13 along the linear track 15, the printhead rotation belt 23 should be controlled to move the same amount as the printhead drive belt 19. On the other hand, to maintain a predetermined pressure between the printhead and the printing surface 11 during movement of the printhead carriage 13 along the linear track 15, care should be taken to ensure that the printhead rotation belt 23 is controlled to move as the printhead drive belt 19 moves, while still providing a force to the first arm 25 which is sufficient to generate the predetermined printhead pressure.

Such control can be achieved, regardless of the position of the printhead rotation belt 23 with respect to the printhead drive belt 19, if the motor 21 is controlled to output a predetermined torque. This results in a predetermined pressure (which corresponds to the predetermined torque) being established between the printhead and the printing surface 11. That is, if the motor 21 is operated as a torque-controlled motor, the output shaft of the motor 21 (and hence the pulley 22 and printhead rotation belt 23) will be rotated so as to maintain the motor output torque at the predetermined level, regardless of the position of the printhead carriage 13 on the linear track 15, or even during movement of the printhead carriage 13. In this way, printhead pressure can be controlled with reference to a single control parameter of the motor 21, regardless of the printhead carriage position or movement state.

In some embodiments the motor 21 is a DC motor, such as, for example, a brushless DC motor (BLDC). For example, the DC motor may be a BLDC motor having a rated voltage of around 36 volts and a no-load speed of around 3500 revolutions per minute. Further, the DC motor may, for example, be capable of generating a rated-torque of around 500 milli-Newton-metres while drawing around 5 amperes current, and a starting torque of around 800 milli-Newton-metres while drawing around 8 amperes of current. The DC motor may, for example, comprise internal drive electronics arranged to control commutation of the windings of the motor. Of course, motors having specifications other than this may also be selected as appropriate for each particular application. Moreover, motor operating characteristics can be altered or optimised by use of a gearbox coupled to the motor.

DC motors of this type generally exhibit a well-known relationship between the current supplied to the motor and the torque output by the motor. Therefore, by providing a predetermined current to the motor 21, a corresponding predetermined torque can be generated at the output shaft of the motor, resulting in a predetermined pressure being established between the printhead and the printing surface 11.

That is, by appropriate control of the current supplied to the motor 21, the torque generated by the motor 21, and hence the printhead pressure can be controlled to a predetermined value.

Control of the printhead pressure by torque control of the motor 21 allows the printhead to be controllable to be either 'in', or 'out'. That is, the motor 21 is driven in a torque-control mode in either a clockwise, or an anti-clockwise direction, with no control as to the position. When driven 'in' the printhead moves until it reaches a physical stop, after which the motor 21 will continue to generate a predetermined retract torque, but will not move any further due to the presence of the physical stop (described in more detail below). On the other hand, when the printhead is driven 'out' the printhead moves outwards until it reaches the printing surface 11, after which the motor 21 will continue to generate a predetermined printing torque, but will not move any further due to the presence of the printing surface 11 (also described in more detail below).

The operation of the printer 1 as briefly described above is now described with reference to FIG. 4. The processing described is carried out by a controller (not shown) associated with the printer 1. Processing begins at step S1, where initialisation actions may be carried out. Once complete, processing passes to step S2 where the printer 1 is in a standby, or ready-to-print condition. In such a state, the printhead is withdrawn from the printing surface, and the controller is waiting for a 'print' command to be received. While no 'print' command is received, processing loops around step S2.

When a 'print' command is received by the controller processing passes to step S3, and the motor 21 is energised to move in a clockwise direction and to deliver a predetermined torque (i.e. with a predetermined current flowing through the motor windings), so as to cause the printhead assembly 4 to move towards the printing surface 11. Once contact is made between the printhead and the printing surface 11, the printhead exerts a pressure on the printing surface which corresponds to the predetermined torque set for the motor 21. Once the contact pressure has stabilised, processing passes to step S4. At step S4, where intermittent printing is to be carried out, the carriage motor 17 is energised so as to cause the printhead drive belt 19 to move, moving the printhead carriage 13 along the linear track 15, causing the printhead to move parallel to the printing surface 11. Once the required movement speed of the printhead carriage has been established, processing passes to step S5, where printing is carried out. The printhead is energised as it passes along the printing surface 11, transferring ink to the substrate 10 as required.

Where continuous printing is required to be carried out (as opposed to intermittent printing), step S4 can be omitted, and processing can pass directly from step S3 to step S5.

Once printing is complete, processing passes step S6, where the motor 21 is controlled so as to be energised in the reverse direction (i.e. anti-clockwise) with a predetermined retract torque, causing the printhead assembly 4 to be moved away from the printing surface 11. A physical stop (not shown) is provided to prevent the printhead assembly 4 moving more than a predetermined distance from the printing surface 11. That is, when the motor 21 is controlled in a torque-controlled mode, it can operate only to drive the printhead carriage 4 in a particular direction (i.e. towards or away from the printing surface 11). Thus, the stop is provided to prevent the printhead assembly 4 (and thus the printhead) from moving too far from the printing surface 11. The physical stop is arranged to stop the printhead carriage 4 at a distance from the printing surface 11, in a retracted position. The retracted position allows for safe movement of the substrate 10, and for system maintenance to be carried out without risk of damage to the printhead, ribbon 2 or substrate 10. For example, the retracted position allows for the ribbon 2 to be threaded through the printer 1 without any interference from the printhead. Further, it will be appreciated that some substrates may not be flat, and may comprise raised portions, which could cause damage to the printhead if they were to come into contact. As such, the retracted position is selected so as to be far enough from the printing surface 11 (and also substrate 10) so as to avoid any such contact.

Once the printhead assembly 4 abuts the stop, the motor 21 will continue to generate the retract torque, however movement will cease. Therefore, by appropriate choice of a retract torque value, the printhead assembly 4 can be made to press against the stop with a predetermined retract force, maintaining the printhead assembly 4 in the retracted position until it is required to print once again. It will be appreciated that the retract force may be selected so as to be less than the printing force. That is, maintaining the printhead assembly 4 in the retracted position may require a smaller force (and a correspondingly smaller torque) than is required to achieve high quality printing.

Once the printhead assembly is retracted, processing passes to step S7, where the printhead carriage 13 is moved, by appropriate control of the carriage motor 17 to be ready for a subsequent printing operation. For example, the printhead carriage 13 may be moved along the linear track 15 in the opposite direction to the direction of movement during a printing operation. Of course, where continuous printing is carried out, step S7 may be omitted (as with step S4). Processing then passes to step S8, where it is determined whether more printing is required. If yes, processing returns to step S2, where a next 'print' command is awaited. On the other hand, if no more printing is required, processing terminates at step S9.

While the control of the printhead pressure by torque control of the motor 21 described with reference to FIG. 4 may provide a degree of control, it does not allow for the printhead to be maintained in an arbitrary position which is close to the printing surface 11 (other than when pressed against the stop). Thus, the provision of a 'ready to print' location for the printhead, which is close to, but separated from, the printing surface is not possible when the motor 21 is controlled by torque control alone. That is, while the retracted position described above allows any unwanted contact with the substrate to be avoided, this position necessarily results in there being significant separation between the printhead and the substrate 10. Thus, when a 'print' command is received, this distance must be closed by movement of the printhead assembly 4 towards the substrate 10 (and printing surface 11). However, such movement, if performed sufficiently quickly so as to allow high speed printing, may result in the printhead bouncing upon making contact with the printing surface 11, requiring further time to be waited until a stable printing pressure is established.

However, in an alternative control mode the DC motor 21 is controlled by a closed loop position controller, which is also provided with a torque limit, allowing a ready to print position to be provided.

Figure 5:
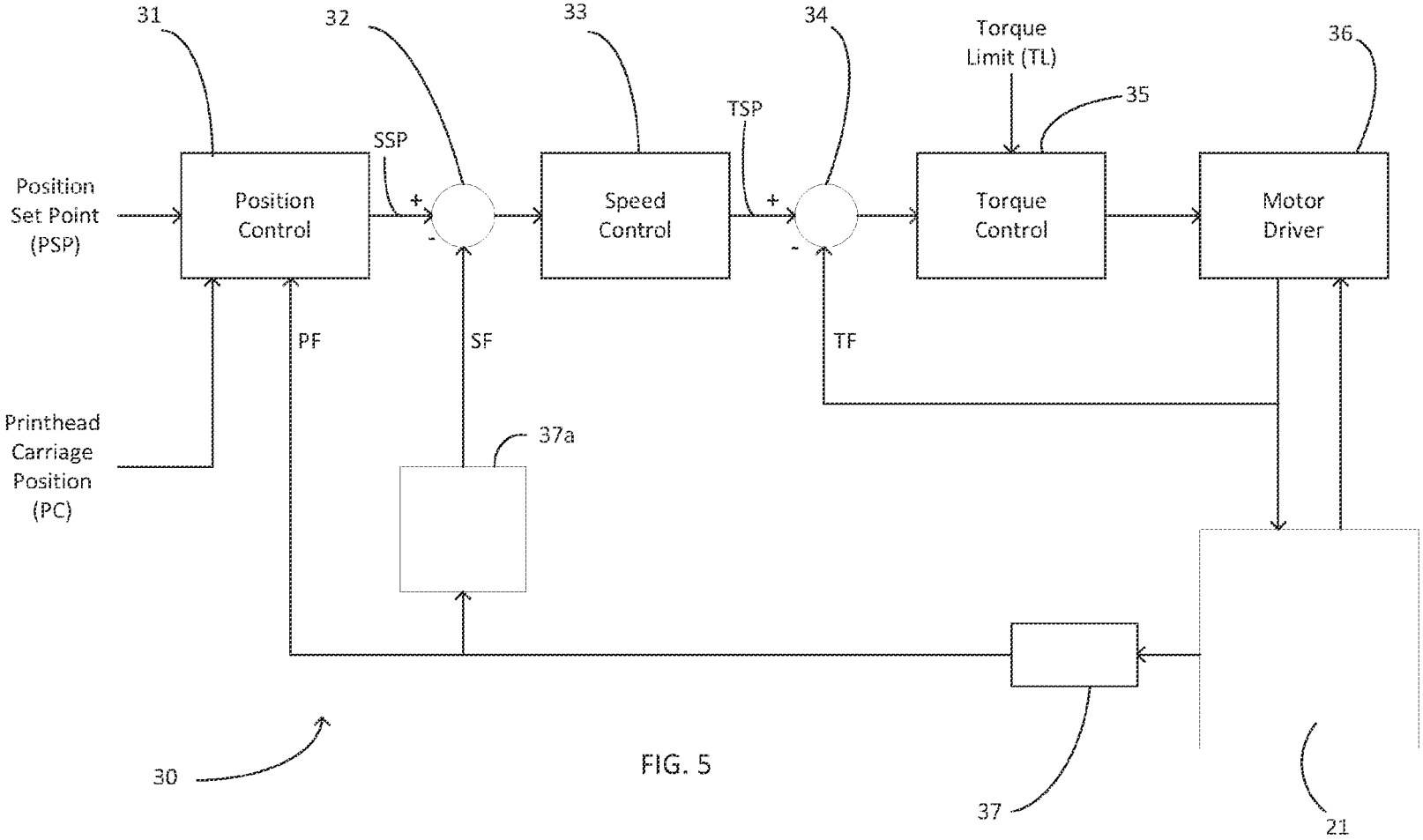
FIG. 5 is a schematic illustration of a controller arranged to control components of the printer of FIG. 1.

FIG. 5 illustrates a controller 30 which is arranged to provide combined torque and positional control of the motor 21. The controller 30 comprises a position controller 31, a speed set point adder 32, a speed controller 33, a current set point adder 34, a torque controller 35 and a motor driver 36. The controller 30, and more particularly the position controller 31 receives, as an input, a position set point signal PSP. For example, the position set point signal may take the form of a signal indicating that the printhead should be moved to one of the ready-to-print position, the printing position or the home (retracted) position. The position controller 31 also receives as a second input a position feedback signal PF which is indicative of the rotary position of the motor 21.

The position feedback signal PF is generated by an encoder 37 which is attached to the motor 21 and which generates an output which accurately represents the position of the motor 21. The encoder 37 may for example be a magnetic encoder comprising a magnet which is mounted so as to rotate with the output shaft of the motor 21, and whose field is sensed by a Hall-effect sensor encoder chip. The Hall-effect sensor encoder chip may, for example, generate around 1000 pulses per revolution. The encoder may suitably provide an output which is either an absolute encoder position output via a serial interface, or a pseudo-quadrature encoder output. A suitable Hall-effect sensor may, for example, be provided by a component having part number AS5040 manufactured by Austria Microsystems.

Alternatively, the position feedback signal PF may be generated by internal components of the motor 21, or by any components which generate an output which accurately represents the angular position of the motor 21. Hall-effect sensors which are routinely incorporated into BLDC motors for commutation purposes may not provide sufficient resolution at low speeds to accurately control the position of the motor 21. As such, an additional encoder (such as that described above) may be preferred.

It will further be appreciated that the position feedback signal PF may be generated by any components which generate an output which accurately represents the position of the printhead assembly 4.

The position controller 31 also receives as a third input a printhead carriage position signal PC which is indicative of the position of the printhead carriage 13. The printhead carriage position signal PC may be generated based upon the number of steps through which the carriage motor 17 has moved. For example, the printhead carriage position signal PC may be based upon a control signal supplied to the carriage motor 17. In combination the printhead carriage position signal PC and the position feedback signal PF allow the actual position of the printhead relative to the printing surface 11 to be calculated.

The position controller 31 generates as an output a motor speed set point signal SSP which is based upon the position set point signal PSP, the printhead carriage position signal PC and the position feedback signal PF (which signals, taken together, are indicative of the actual position of the printhead carriage 13, and the actual position of the printhead assembly). The speed set point signal SSP is adjusted during the subsequent movement of the printhead assembly 13 so as to ensure that the movement is controlled in an appropriate manner. For example, when an instruction is received to cause the printhead to be moved into contact with the printing surface 11 from the ready to print position, the position controller 31 initially generates a series of speed set point signals SSPs which take the form of a increasing ramp, having a rate of increase (i.e. acceleration) which is known to be within the capabilities of the motor 21 and motor driver 36 in combination with the load (i.e. the printhead assembly 4). Once the generated speed set point SSP characteristic reaches a predetermined maximum speed, the speed set point characteristic becomes flat—maintaining the predetermined maximum speed. Further, once the actual position of the printhead assembly 4 approaches the printing surface 11, a deceleration ramp may be generated, causing the motor 21 to be decelerated before contact is made, reducing the likelihood of printhead bounce. Such control of the printhead position may be performed in combination with embodiments in which the motor 21 is a DC motor or a stepper motor.

Thus, the position feedback signal PF is used by the position controller 31 as an index to a set of predetermined movement profile functions. Each movement profile function may, for example, comprise an acceleration ramp, a maximum speed, and a deceleration ramp. It will be appreciated that the characteristics of the various movement profiles are dependent upon the purpose of that profile (e.g. move in to ready-to-print, move in to printing position, move out to ready-to-print position, etc.), and also dependent upon various characteristics of the printer 1. For example, different movement profiles may be required for use with different printhead widths.

In some embodiments, the position controller 31 may comprise a simple closed loop position controller having a set point adder which subtracts an actual position signal (as indicated by the position feedback signal PF) from a position set point generating a position error signal, which is provided to a proportional-integral controller (which may itself limit maximum acceleration/speed etc.).

The output of the position controller 31 (i.e. the speed set point signal SSP) is provided to the speed set point adder 32, which also receives a speed feedback signal SF. The speed feedback signal SF is generated, based upon the output of the encoder 37, by a speed convertor 37*a*. The speed convertor 37*a* converts pulses generated by the encoder 37 into a signal indicative of the rotational speed of the motor 21.

The speed set point adder 32 subtracts the speed feedback signal SF from the speed set point signal SP generating a speed error signal, which is provided to the speed controller 33. The speed controller 33 may, for example, take the form of a proportional-integral (PI) controller, and is arranged to generate, as an output a torque set point signal TSP which causes the motor 21 to be operated so as to minimise the difference between the speed set point SSP, and the speed feedback signal SF (i.e. to minimise the speed error signal).

The output of the speed controller 33 (i.e. the torque set point signal TSP) is in turn provided to the torque set point adder 34, which also receives a torque feedback signal TF which is indicative of the torque being generated by the motor 21. It is well known that the torque produced by a DC motor is proportional to the current flowing in the windings. The torque feedback signal may thus be generated by monitoring the current flowing in the windings of the motor 21.

The torque set point adder 34 subtracts the torque feedback TF signal from the torque set point signal TSP generating a torque error signal, which is provided to the torque controller 35. The torque controller 35 is arranged to generate, as an output a motor control signal which is provided to the motor driver 36. The torque controller 35 may, for example, take the form of a proportional-integral (PI) controller and is operated so as to minimise the difference between the torque set point signal TSP, and the torque feedback signal TF (i.e. to minimise the torque error signal). Thus, if the generated torque is smaller than the torque set point, the motor 21 is caused to generate more torque, and vice versa.

The torque controller 35 also receives, as an input, a torque limit signal TL, which corresponds to the maximum torque to be generated by the motor 21. This torque limit signal TL is determined to correspond to a predetermined printhead contact force. The torque limit signal TL is used to prevent the printhead contact force from exceeding the predetermined printhead contact force. That is, even if the torque required to correct a speed error signal is greater than the torque limit TL, the torque controller 35 is prevented from generating a signal which would cause the motor to generate that level of torque. For example, when the torque error signal is sufficiently large to cause the output of the torque controller 35 to exceed the torque limit TL the output may be simply limited to a maximum value which corresponds to the torque limit TL.

It will be appreciated that if the motor 21 is position-controlled so as to attempt to drive the printhead to a target position which is beyond the printing surface 11 (which target cannot be achieved due to the presence of the printing surface 11) the motor 21 will drive the printhead as far as possible until it meets the printing surface 11, at which point the torque generated by the motor 21 will rise to the maximum torque that can be output by the motor 21. Such operation could result in large printhead force being generated between the printhead and the printing surface. However, the arrangement described above allows the maximum torque generated by the motor 21 (i.e. the torque limit TL) to correspond to a predetermined printhead force being generated between the printhead and the printing surface 11. Therefore, if a target position is set which is beyond the printing surface 11, the printhead force can be controlled by appropriate choice of a torque limit TL. That is, in a torque-limited position-controlled mode the motor 21 can be used to position-control the printhead, while also delivering a predetermined torque, which corresponds to the predetermined printing pressure.

It will be appreciated that the torque limit TL may be varied in dependence upon characteristics of the printhead assembly 4, or the printhead (e.g. printhead width). Further, the torque limit TL may be varied during movement of the printhead so as to accommodate different torque requirements during acceleration, deceleration and stationary operation. For example a larger torque limit TL may be required during acceleration from a stationary position than is required to maintain a predetermined printhead force. As such, the torque controller 35 may generate a dynamic torque limit, which takes the form of a torque limit profile. The torque controller 35 may vary such a torque limit (e.g. by indexing the profile) based upon the actual position of the printhead, or the actual speed of the printhead (as indicated by the position feedback signal PF and speed feedback signal SF respectively).

The motor driver 36 converts the motor control signal generated by the torque controller 35 into pulse width modulated (PWM) signals which are supplied to the motor windings. The duty cycle of the PWM signals is controlled so as to generate more or less torque, as required by the torque controller 35.

As described above the torque feedback signal may be generated based upon the current flowing within the windings of the motor 21. The current may, for example, be monitored by way of a low-value shunt resistor which is arranged in series with the common ground connection for the power stage of the motor driver 36.

Figure 6:
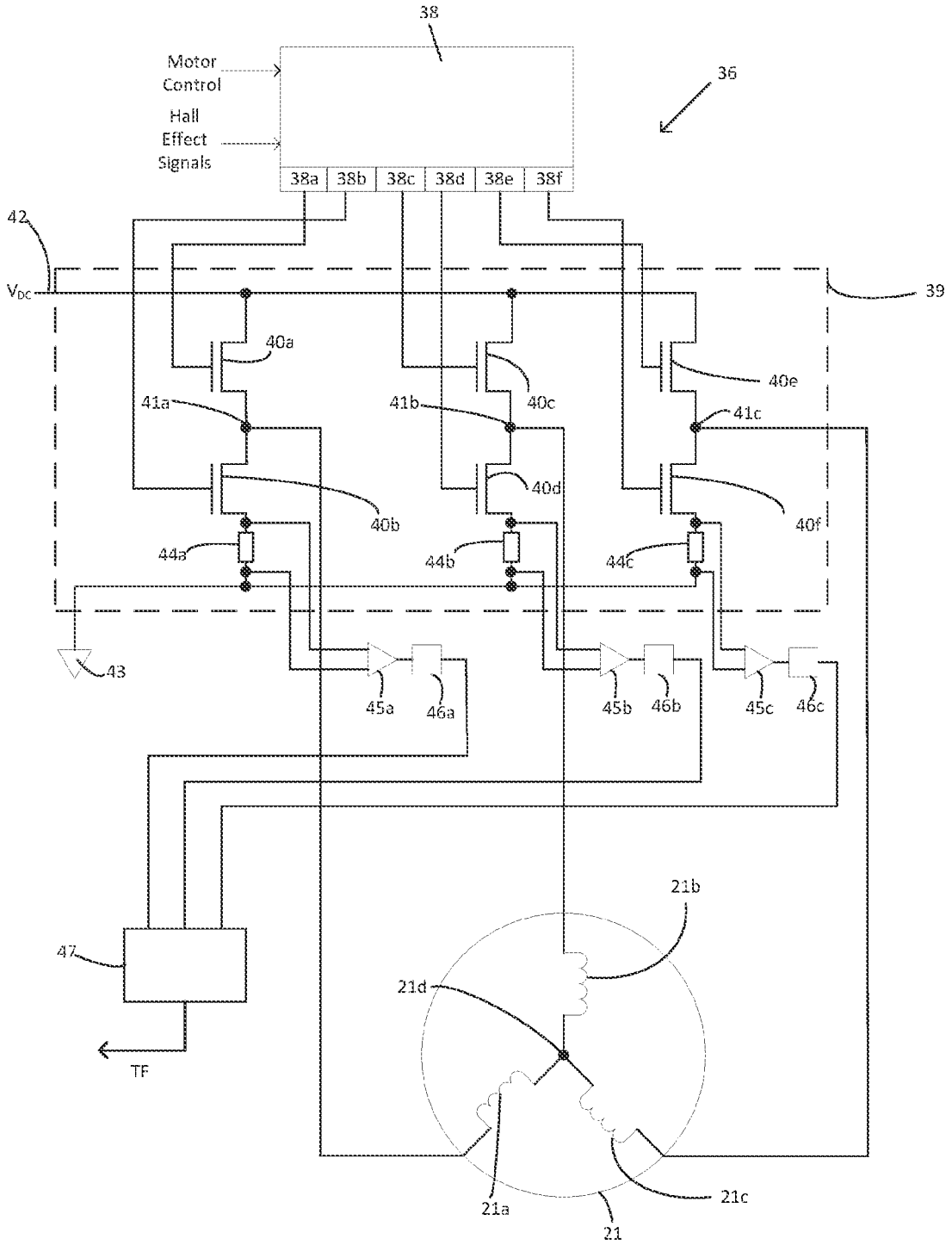
FIG. 6 is a schematic illustration of a part of the controller of FIG. 5.

FIG. 6 shows the components of the motor driver 36 in more detail. In particular, the motor driver 36 comprises a PWM block 38 which receives as inputs the motor control signal generated by the torque controller 35 and the output of Hall-effect sensors embedded in the motor 21 which are configured to generate an output indicative of the current rotational position of the rotor of the motor 21. The PWM block uses these signals to generate PWM output signals Q1 to Q6. The duty cycle of the PWM signals is controlled based upon the motor control signal, while the commutation of the output signals Q1 to Q6 is controlled based upon the output of the Hall-effect sensors.

Motor driver 36 further comprises a power stage 39 which comprises six power transistors 40*a* to 40*f* arranged in series pairs (40*a* and 40*b*, 40*c* and 40*d*, and 40*e* and 40*f*), each pair having an intermediate node 41*a*, 41*b*, 41*c* between the two transistors of that pair. The three pairs of transistors are arranged in parallel between a DC power supply 42 and a ground connection 43. Each pair of transistors comprises an upper transistor 40*a*, 40*c*, 40*d* and a lower transistor 40*b*, 40*d*, 40*f* which are arranged to provide three parallel connections between the DC power supply 42 and the ground connection 43. As is common-place in PWM motor drives, free-wheel diodes may be associated with each of the transistors 40*a*-40*f*, allowing current to continue flowing in the windings when the transistors 40*a*-40*f* are switched off.

The intermediate nodes 41*a*, 41*b*, 41*c* are each connected to a first end of a respective one of three windings 21*a*, 21*b*, 21*c* of the motor 21. A second end of each of the three windings 21*a*, 21*b*, 21*c* of the motor 21 is connected together at a node 21*d*.

In operation each of the transistors 40*a* to 40*f* is controlled by a respective one of the output signals 38*a* to 38*f* so as to cause the motor windings 21*a* to 21*c* to be sequentially energised in accordance with the desired torque, and present rotational position according to well-known commutation and PWM techniques. The motor windings 21*a* to 21*c* may, for example, be energised according to trapezoid or sinusoidal waveforms.

The current flowing through the windings 21*a* to 21*c* returns through one of the lower transistors 40*b*, 40*d*, 40*f*, via a respective low value shunt resistor 44*a*, 44*b*, 44*c* to a ground connection 43. Each of the low value shunt resistors 44*a*, 44*b*, 44*c* may, for example be, a resistor having a resistance of around 0.3 ohm. Voltages developed across the each of resistors 44*a*, 44*b*, 44*c* are monitored via amplifiers 45*a*, 45*b*, 45*c*. Each of the amplifiers 45*a*, 45*b*, 45*c* generates an output which is indicative of the voltage developed across a respective one of the resistors 44*a*, 44*b*, 44*c*. The voltages developed across the resistors 43*a*, 43*b*, 43*c* are proportional to the current flowing through a respective one of the windings 21*a*, 21*b*, 21*c* according to Ohm's law.

The amplifiers 45*a*, 45*b*, 45*c* may, for example, be high-speed rail-to-rail operational amplifiers, which are configured with an offset such that the output is biased to be approximately half-way between the ground level and the voltage supply level. That is, the output of the amplifiers 45*a*, 45*b*, 45*c* can swing in both positive and negative directions from the bias position, allowing both positive and negative voltages developed across the resistors 44*a*, 44*b*, 44*c* to be detected.

As described above, during operation the motor windings 21*a* to 21*c* are energised according to well-known commutation and PWM techniques. As such, during PWM "on" periods, a current will flow from the power supply 42, through a respective one of the upper transistors 40*a*, 40*c*, 40*e*, through the windings 21*a*, 21*b*, 21*c*, through a respective one of the lower transistors 40*b*, 40*d*, 40*f*, before flowing through respective one of the resistors 44*a*, 44*b*, 44*c*, thereby generating a positive voltage across a said one of the resistors 44*a*, 44*b*, 44*c*. On the other hand, during the PWM "off" periods, the motor windings 21*a*, 21*b*, 21*c* will act as generators, and current will be conducted through the free-wheel diodes which are associated with each of the transistors 40*a*-40*f*. This free-wheel current will result in a negative voltage being developed across the resistors 44*a*, 44*b*, 44*c* during the PWM "off" periods. The above-described amplifier configuration allows such negative voltages to be measured during the PWM "off" periods, as well as the positive voltages during PWM "on" periods.

Outputs of the amplifiers 45*a*, 45*b*, 45*c* are provided to analog-to-digital convertors (ADCS) 46*a*, 46*b*, 46*c*. Each of the analog-to-digital convertors (ADCS) 46*a*, 46*b*, 46*c* converts a voltage signal output by a respective one of the amplifiers 45*a*, 45*b*, 45*c* to a digital signal which is indicative of the voltage developed across a respective one of the resistors 43*a*, 43*b*, 43*c*.

The ADC outputs are provided to inputs of a controller 47, which may, for example, take the form of a digital-signal-processor (DSP) or a microcontroller having fast signal processing capabilities. The controller 47 digitally processes the ADC output signals to generate a measure of the average current flowing in the windings 21*a*, 21*b*, 21*c*. That is, the effect of any offset voltage introduced by the amplifiers 45*a*, 45*b*, 45*c* (so as to allow for detection of positive and negative voltages) is removed. Thus, the controller 47 performs processing to generate digital signals which are indicative of the absolute negative and positive voltages which are generated as a result of the PWM control of the windings 21*a*, 21*b*, 21*c*. These digital signals are further processed by the controller 47 so as to calculate an effective average current flowing through each of the windings 21*a*, 21*b*, 21*c* at any point in time. Such processing may involve rectifying the positive and negative voltages measured across the resistors, so as to reflect the magnitude of current flow within the windings 21*a*, 21*b*, 21*c* (which does not change direction between PWM pulses, unlike the resistor current). Such processing may further involve performing filtering or averaging, for example, so as to remove unwanted measurement artefacts. The processed current values may be combined (e.g. by averaging) so as to form a single current value which is indicative of the current flowing within the windings 21*a*, 21*b*, 21*c*. The processed current values are then provided to the torque adder 34 as the torque feedback signal.

It will be appreciated that additional components may be providing to perform signal conditioning between the resistors 44*a*, 44*b*, 44*c* and the torque adder 34. For example, any of the processing described above as being performed in the digital domain may instead be performed in the analog domain. For example, the voltage signal may be rectified at the output of the amplifiers 45*a*, 45*b*, 45*c*. Alternatively, or in addition, level translators may be used so as to generate an appropriate signal offset. Similarly low pass filters may be used so as to remove unwanted high frequency components from the signal waveform. Further, the ADCS 46*a*, 46*b*, 46*c* may be provided as discrete components, or as part of an input stage of the controller 47. Moreover, the controller 47 may itself be part of the controller 30.

The controller 30 can thus be operated, as described above, to cause the motor 21 to operate in a torque-limited position control mode. As such, the motor 21 can be operated to hold the printhead in any arbitrary position (with a limited torque), or move between positions. Such positions may include the ready-to-print position, the printing position and the home position.

Further, the motor can be used to position control the printhead during printing, while also delivering a predetermined torque, which corresponds to the predetermined printing pressure.

Once printing is complete, the printhead can be withdrawn, under positional control, to a ready to print position. Alternatively when printing is complete, the printhead can be withdrawn to the home position (which may or may not be provided with a physical stop).

Processing carried out to control the printhead position and pressure in this way by control of the motors 17 and 21 is carried out as described with reference to FIG. 7. Processing begins at step S10 where an initialisation process is carried out. The initialisation process includes identifying the current position of the printhead assembly by use of a known datum position and the encoder. During this initialisation process the motor 21, may, for example, be controlled so as to move the printhead assembly 4 about the pivot 14 until the printhead assembly 4 is in a position where it abuts a physical stop (such as the physical stop described above with reference to torque controlled operation), and/or where it is in contact with the printing surface 11. Such end positions may be detected by monitoring the current supplied to the motor 21 during movement (for example using the resistor 45). The current will rise as soon as the movement of the printhead assembly 4 is obstructed by contact with a physical barrier (such as to the stop, or the printing surface 11), as the torque output of the motor increases. In this way, the controller determines a current position of the printhead assembly 4, and can monitor subsequent movements relative to that position with reference to the output of the encoder 37.

Once initialisation is complete, processing passes to step S11 where the printer 1 is placed in a standby, or ready-to-print condition. The printhead moved to the ready-to-print position, so as to be ready to print immediately when a print command is received. The ready-to-print position corresponds to a position which is a known number of encoder pulses away from the printing position. As such, once initialisation has been completed at step S10, the printhead can be moved to, and maintained in, the ready to print position under positional control.

Processing then passes to step S12, where the printer waits for a print command to be received. While no 'print' command is received, processing loops around step S12. When a 'print' command is received by the controller processing passes to step S13, and the motor 21 is energised to move to a target position which is beyond the contact point between the printing surface 11 and the printhead. The use of such a target position causes the motor to rotate such that the printhead assembly 4 is moved towards the printing surface 11. Once contact is made between the printhead and the printing surface 11, the printhead exerts a pressure on the printing surface which corresponds to the maximum torque set for the motor 21 (i.e. the torque limit). That is, although the actual position has not reached the target position, the torque limit provided by the torque controller 35 prevents the motor 21 from generating any more torque than the predetermined torque limit.

Once the contact pressure has stabilised (for example after a predetermined stabilisation period determined by experimentation) processing passes to step S14. At step S14, where intermittent printing is to be carried out, the carriage motor 17 is energised so as to cause the printhead drive belt 19 to move, moving the printhead carriage 13 along the linear track 15, causing the printhead to move parallel to the printing surface 11. It will also be appreciated that such movement of the printhead carriage 13 will also cause the printhead assembly 4 to be moved. However, the controller 30, and more particularly the position controller 31 is arranged to control the printhead movement (by generation of an appropriate speed set point signal) such that movement of the printhead corresponds to the movement of the printhead carriage 13. That is, at any point during the movement of the printhead carriage 13, the printhead target position will correspond to a target position which is beyond the contact point between the printing surface 11 and the printhead, and the contact pressure will be maintained at a value which corresponds to the maximum torque set for the motor 21

Figure 8:
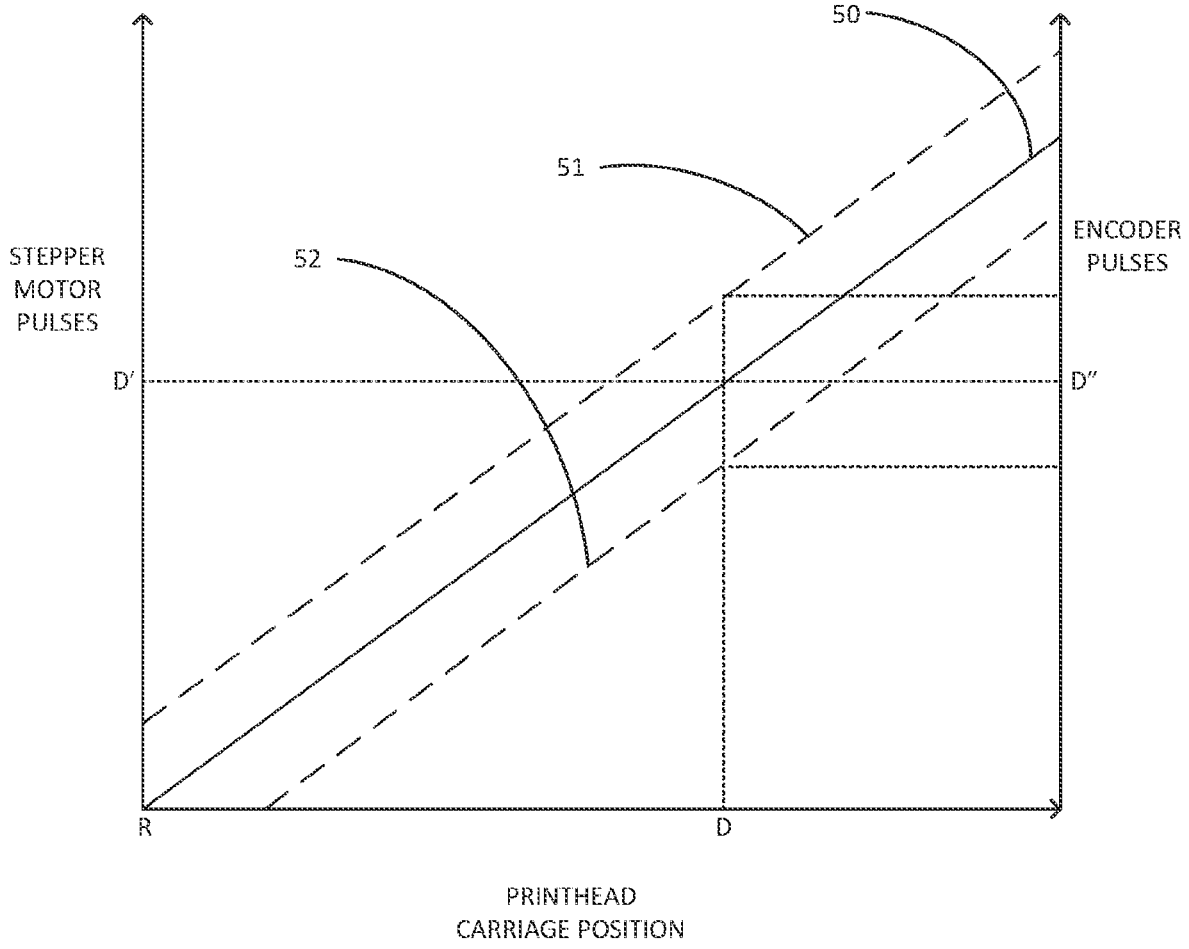
FIG. 8 is a graph showing the relationship between the actual position of the printhead and the target position of the printhead during printing operations.

FIG. 8 shows a relationship between the movement of the carriage motor 17 (which controls the movement of the printhead carriage 13) and the target position of the printhead assembly 4. The x-axis represents the position of the printhead carriage 13, and hence the lateral position of the printhead in the direction of substrate movement (i.e. in the direction indicated by arrow A in FIG. 1). A left-hand vertical axis represents the number of stepper motor pulses supplied to the carriage motor 17. A right-hand vertical axis represents a number of encoder pulses which correspond to movement of the motor 21.

A line 50 represents the relationship between the movement printhead carriage 13 and number of stepper motor pulses supplied to the carriage motor 17. It can be seen that the line 50 is a straight line. As such, each step moved by the stepper motor 17 causes a corresponding movement of the printhead carriage 13. A reference position R represents the printhead carriage 13 being at one end of the linear track 15, with the printhead in contact with the printing surface 11.

Given the coupling between the printhead carriage 13 and the printhead assembly 4, via the pivot 14 (which is described in detail above), it will be understood that any lateral movement of the printhead carriage 13 in the direction A (FIG. 1) will also cause a corresponding movement of the printhead assembly 4 in the direction B (FIG. 1)—that is unless the printhead rotation belt 23 is also caused to move. As such, to maintain the position of the printhead assembly in the direction B, any movement of the carriage motor 17 (and thus movement of the printhead drive belt 19), should be matched by an equivalent movement of the motor 21 (and thus movement of the printhead rotation belt 23). The line 50 thus also represents the number of pulses from encoder 37 which must be moved by the motor 21 so as to maintain the relative position of the printhead assembly 4 in the direction B as the printhead carriage 13 is moved in the direction A. For any printhead carriage position relative to the reference position R, there is a number of steps which will have been moved by the carriage motor 17, and a corresponding number of encoder pulse which will have been moved by the motor 21. Thus, for an arbitrary printhead carriage position D relative to the reference position R, the carriage motor 17 will have moved a number of steps D', and the motor 21 will have moved an amount which has caused a number of encoder pulses D" to be generated.

Similarly, any movement of the printhead drive belt 19 with respect to the printhead rotation belt 23 will result in a change in the position of the printhead assembly in the direction B. A second line 51 is offset from and parallel to the first line 50. The offset between the line 51 and the line 50 represents an offset between the amount of movement of the printhead drive belt 19 and the printhead rotation belt 23, and thus a displacement of the printhead assembly 4 in the direction B. The line 51 thus represents the number of encoder pulses required to be moved by the motor 21 to cause the printhead assembly 4 to be maintained in the ready to print position (which is slightly offset from the contact position) as the printhead carriage 13 is moved in the direction A.

A third line 52 is offset from and parallel to the first line 50 in the opposite direction from the line 51. The offset between the line 52 and the line 50 represents an offset between the amount of movement of the printhead drive belt 19 and the printhead rotation belt 23, and thus a displacement of the printhead assembly 4 in the direction B. The line 52 represents the number of encoder pulses which could be required to be moved by the motor 21 to cause the printhead assembly 4 to be maintained in a position which is beyond the contact position with the printing surface 11. However, it will be appreciated that this position cannot be achieved, due to the printing surface 11 obstructing the movement of the printhead assembly 4. The line 52 therefore can be understood to represent a target position which, when supplied to the position controller 31 will cause the printhead to be pressed against the printing surface 11. The torque limit TL described above will result in the printhead being pressed against the printing surface 11 with the predetermined force.

The relationships described above with reference to FIG. 8 may take the form of a lookup table which is accessible by the controller 31 and which allows positional control of the motor 21 based upon both the position of the printhead carriage 13 in direction A, and a target position of the printhead assembly 4 in the direction B. That is, for each position of the printhead carriage 13 (i.e. for each position on the x-axis of FIG. 8), a target position for the motor 21 in terms of a number of encoder pulses can be derived from FIG. 8 for three different target positions of the printhead with respect to the printing surface 11. A first target position corresponds to the ready-to-print position and is represented by the line 51. A second target position corresponds to the point at which contact is made between the printhead and the printing surface 11, and is represented by the line 50. A third target position corresponds to a point beyond the contact position with the printing surface 11, and is represented by the line 52. The third target position allows the printhead to be pressed against the printing surface 11 with the predetermined force printing as described above.

Further target positions may be provided as necessary. For example, an additional line which corresponds to the home (retracted) position may be provided.

Once the required movement speed of the printhead carriage 13 has been established, (including a corresponding movement of the printhead rotation belt 23 and motor 21), processing passes to step S15, where printing is carried out. The printhead is energised as it passes along the printing surface 11, transferring ink to the substrate 10 as required.

As described above with reference to FIG. 4, where continuous printing is required to be carried out (as opposed to intermittent printing), step S14 can be omitted, and processing can pass directly from step S13 to step S15.

Once printing is complete, processing passes step S16, where the target position specified to the position controller 31 is commanded to move to the ready-to-print position (i.e. line 51). This causes the motor 21 to be energised in the reverse direction (i.e. anti-clockwise), causing the printhead assembly 4 to be moved away from the printing surface 11.

Once the printhead assembly is retracted to the ready-to-print position, processing passes to step S17, where the printhead carriage 13 is moved, by appropriate control of the carriage motor 17 to be ready for a subsequent printing operation. The printhead carriage 13 may be moved along the linear track 15 in the opposite direction to the direction of movement during a printing operation. A corresponding adjustment to the target position specified to the position controller 31 is also made, according to the lines 50 and 51. As such, as the printhead carriage 13 moves along the linear track 15, the printhead remains in the ready to print position.

Of course, where continuous printing is carried out, step S17 may be omitted (as with step S14). Processing then passes to step S18, where it is determined whether more printing is required. If yes, processing returns to step S12, where a next 'print' command is awaited. On the other hand, if no more printing is required, processing terminates at step S19.

It will be appreciated that while it is described above the motor 21 is controlled in a combined torque and position controlled mode, other control techniques are possible. That is, the motor 21 can be controlled in different operating modes, such as, for example, a first operating mode which may be referred to as a torque-controlled mode. In the first operating mode, torque may be the dominant control parameter. The second operating mode may be referred to as a position-controlled mode. In the second operating mode, position may be the dominant control parameter.

In more detail, the motor 21 can be controlled in a position controlled manner (for example, using positional feedback provided by the encoder 37, or an open loop positional control mode) when not in contact with the printing surface, and when held in the ready-to-print position. However, when printing is required, the torque output of the motor 21 can be controlled in a torque controlled manner. That is, when the printhead is in the ready-to-print position, under positional control, and a print signal is received the motor 21 can be controlled to cause the printhead to move towards the printing surface, as described above with reference to step S13. However, prior to, or at the point of, contact between the printhead and the printing surface 11, the motor 21 can be switched to a torque control mode. Such a transition may be carried out immediately upon receipt of the print command. This would result in the printhead being driven towards and making contact with the printing surface 11 whilst the motor 21 was in a torque controlled mode.

Alternatively the transition between position and torque control may be based upon reaching a known position. For example, the transition may be carried out based upon a known number of encoder pulses which correspond to the contact position (as determined during initialisation), or an increased motor torque (as detected by resistors 44*a*, 44*b*, 44*c*-FIG. 6).

A target torque is set to generate a predetermined printing force. This results in the printhead being driven towards the printing surface 11 and the predetermined printing force being developed.

Printing then occurs, as described above, with the printhead carriage 13 moving as required to move the printhead along the printing surface 11 in intermittent mode printing. During this movement, the motor 21 remains under torque control and will move as required to maintain the predetermined torque level (and thus contact force)

Once printing is complete, the motor 21 is again controlled in a position controlled manner to withdraw to the ready-to-print position (or to a fully retracted position) as required. For example, such movement can be carried out by moving the motor 21 through a number of encoder pulses which correspond to the required amount of movement.

Similarly, the motor 21 can be controlled in a position controlled manner to maintain the printhead in the ready to print positon as the printhead carriage 13 is moved after the end of printing operations. In particular, the printhead carriage 13 may be moved along the linear track 15 in the opposite direction to the direction of movement during a printing operation by operation of the motor 17. During this movement, the motor 21 may be controlled in an open loop manner, with an excitation field applied to the windings of the motor 21 being rotated by an amount which corresponds to the movement of the printhead carriage motor 17 required to move the printhead carriage 13 along the track 15 (such a relationship being illustrated by line 51 in FIG. 8).

Such a control arrangement provides the benefit of torque control during printing while also providing the benefit of positional control between printing cycles. It will be appreciated that such techniques can be applied using any form of motor which can be operated in either a torque controlled, or a position controlled mode.

The pressure to be applied by the printhead may, for example, be 15.7 N (1.6 kgf) for a 53 mm printhead width. Such a pressure can be converted to a torque to be output by the motor 21. Such a conversion will depend upon the mechanical coupling (including the relative lengths of arms 25, 26 and the diameter of the pulley 22), and any gearing effect of the said coupling. The required torque can then be converted to a current limit according to the torque constant of the motor 21, that is, the Newton-metres (Nm) of torque generated per unit Ampere (A) of current (Nm/A).

Further, the pressure to be applied by the printhead may be varied in dependence upon the substrate speed. The pressure to be applied by the printhead may also be specified by a user as a percentage of a pressure to be applied given a particular substrate speed. A pressure of 50% may be considered to be nominal.

The printer may store data indicating a minimum pressure (associated with user input of 0%) and a maximum pressure (associated with user input of 100%) when particular user input is received the pressure to be applied may be determined by linear interpolation from the stored minimum pressure and stored maximum pressure.

In above described embodiments the motor 21 is a DC motor. However, in alternative embodiments different motors may be used to drive the printhead rotation belt 23 and, therefore, to control the printhead pressure. For example, in an embodiment the motor is a stepper motor. The stepper motor may be associated with a rotary encoder which provides information relating to the rotary position of the motor shaft. Such information enables the windings of the stepper motor to be driven in a closed-loop manner.

Figure 9:
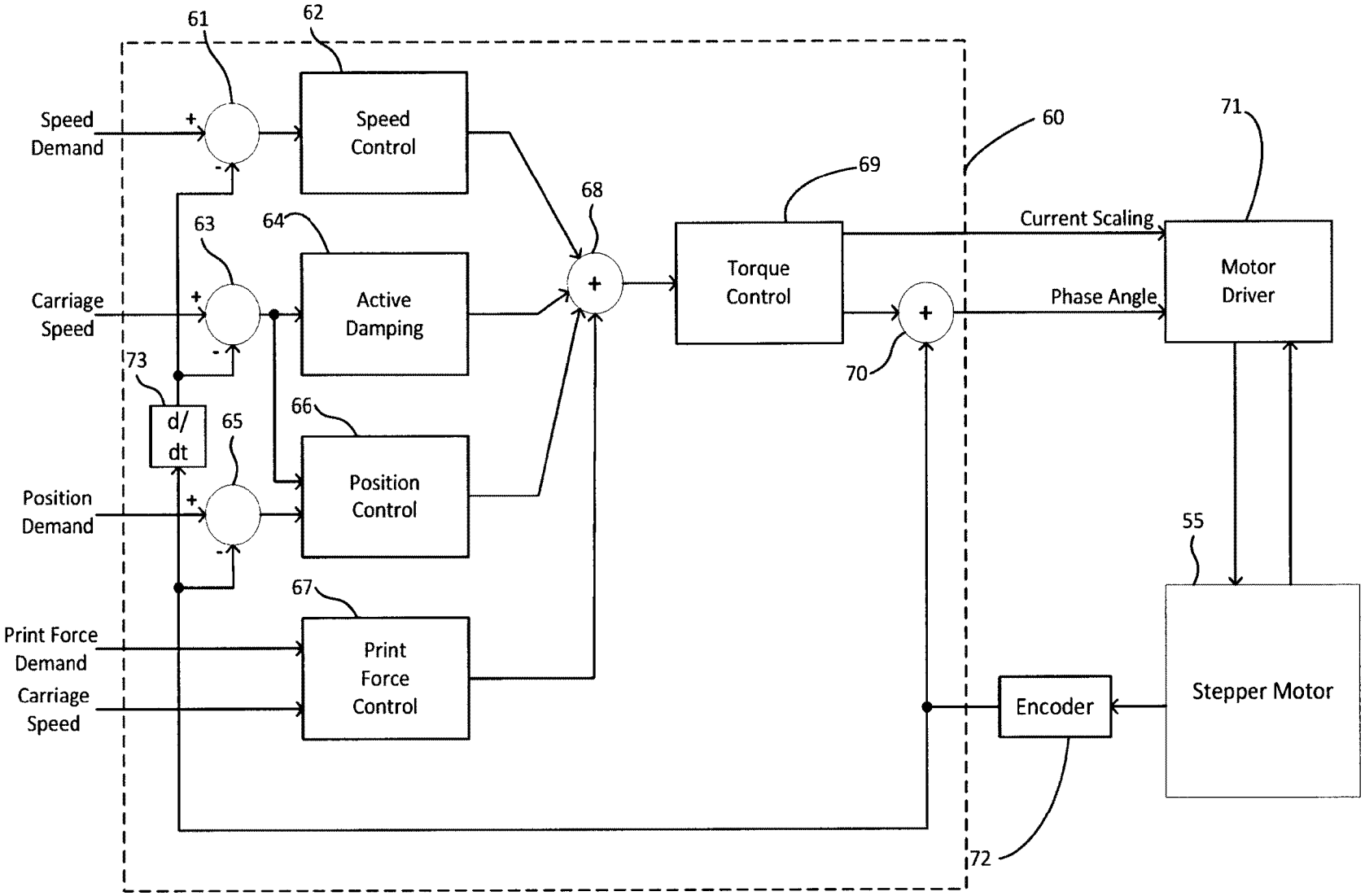
FIG. 9 is a schematic illustration of a controller arranged to control components of an alternative embodiment of the printer of FIG. 1.

FIG. 9 illustrates a motor controller 60 which is arranged to control the motor 21 when implemented as a stepper motor 55. The stepper motor controller 60 comprises a printhead speed demand adder 61, a printhead speed controller 62, a carriage speed adder 63, an active damping block 64, a printhead position adder 65, a printhead position controller 66, a print force controller 67, a torque demand adder 68, a torque controller 69, and a phase angle adder 70.

The motor controller 60 generates control signals which are provided to a stepper motor driver 71. The stepper motor driver 71 in turn generates control signals which are provided to transistors which control the current flowing in the windings of the motor 55 (as described in more detail below with reference to FIG. 10).

An encoder 72 generates a signal indicative of the angular position of the output shaft of the motor 55. The output of the encoder 72 is processed by a speed convertor 73, which converts a signal generated by the encoder 72 into a signal indicative of the rotational speed of the motor 55.

It will be appreciated that whereas a single output signal is shown in FIG. 9 as being generated by the encoder, the output may comprise a plurality of related signals. In particular, pulses generated by the encoder 72 may be processed to produce a signal indicative of angular position of the output shaft of the motor 55 (which can be used for field control). The signal indicative of angular position of the output shaft of the motor 55 may be referred to as an absolute position signal. A further signal may be generated based upon the pulses generated by the encoder 72 which indicates an angular position of the output shaft of the motor 55 adjusted for changes caused by the carriage 13 (which may be used in a printhead position control mode). Such a signal may be referred to as a relative position signal. The relative position signal may have the property that, for a given printhead position (i.e. a given separation between the printhead and the printing surface), the output stays constant as the carriage 13 moves, even though the motor output shaft is rotating. A position error signal generated by the printhead position adder 65, which is provided to the printhead position controller 66, may be generated based upon this relative position signal, rather than the absolute position signal.

The motor controller 60 may be implemented in any convenient way. For example, the various blocks of the motor controller 60 may each be implemented as separate software sub-routines running on a general purpose processor, or as blocks implemented in an FPGA (or any combination thereof). It will be appreciated that following description describes the functional interaction of these blocks, rather than the physical implementation. Further, whereas various adders are described as adding or subtracting input signals to/from one another, it will be appreciated that the polarity of such operations may vary between different implementations (e.g. based upon the direction in which motor phases or encoders are connected).

The motor controller 60 receives a number of inputs indicative of various characteristics of and control parameters for the printer 1. More particularly, the printhead speed demand adder 61 receives as an input a printhead speed demand signal. From this speed demand signal the printhead speed demand adder 61 subtracts a printhead motor speed signal received from the speed convertor 73. The output of the printhead speed demand adder 61 is passed to the printhead speed controller 62. The printhead speed controller 62 also receives as an input a speed control gain (not shown). The printhead speed controller 62 generates as an output a printhead motor speed control signal which is passed to the torque demand adder 68.

The carriage speed adder 63 receives as an input a printhead carriage speed signal. This signal may, for example, be generated based upon a control signal for the carriage motor 17 (which is controlled in a position or speed controlled manner). From this carriage speed signal the carriage speed adder 63 subtracts a printhead motor speed signal received from the speed convertor 73. The output of the carriage speed adder 63 is thus indicative of the difference in speed between the stepper motor 55 (i.e. the printhead motor 21) and the carriage motor 17. The output of the carriage speed adder 63 is passed to the active damping block 64. The active damping block 64 also receives as an input a damping control gain (not shown). The active damping block 64 generates as an output a printhead motor damping signal which is passed to the torque demand adder 68.

The printhead position adder 65 receives as an input a printhead position demand signal. From this position demand signal the printhead position adder 65 subtracts a printhead motor position signal received from the encoder 72. The output of the printhead position adder 65 is thus indicative of the difference between the demanded and actual position of the printhead motor 55. The output of the printhead position adder 65 is passed to the printhead position controller 66. The printhead position controller 66 also receives as inputs a position control gain (not shown), and the output of the carriage speed adder 63. The printhead position controller 66 generates as an output a printhead motor position signal which is passed to the torque demand adder 68.

The print force controller 67 receives as an input a print force demand signal. The print force controller 67 also receives as an input a printhead carriage speed signal. In some embodiments, the print force controller 67 may receive as an input a printhead carriage position signal instead of or in addition to the printhead carriage speed signal. The print force controller 67 generates as an output a print force signal which is passed to the torque demand adder 68.

The torque demand adder 68 receives inputs from each of the printhead speed controller 62, the active damping block 64, the printhead position controller 66 and the print force controller 67. The torque demand adder 68 sums the received inputs to generate a torque demand signal output, which is passed to the torque controller 69. In use, depending upon the motor control mode selected, one or more of the inputs to the torque demand added 68 may be zero, such that one or more of the control blocks 62, 64, 66 and 67 does not influence the control of the motor 21.

It will, of course, be appreciated that control architecture shown in FIG. 9 is an abstract illustration of how the various control blocks functionally interact. As such, it will be understood that the torque controller 69, in combination with the torque demand adder 68, may receive, process, and/or ignore, various inputs from the one or more other control blocks (e.g. control blocks 62, 64, 66 and 67) as required so as to control the motor 55 according to a selected mode of operation.

The torque controller 69 generates a current scaling signal, which is passed to the stepper motor driver 71, and a phase lead signal. The phase lead signal is passed to the phase angle adder 70, where it is summed with a printhead motor position signal received from the encoder 72. An output of the phase angle adder 70 is passed to the stepper motor driver 71.

In use, the various control blocks within the motor controller 60 may be operated in combination, or in isolation, in order to control the stepper motor 55 in one of a number of different control modes (which control modes are described in more detail below). That is, at any point in time, one or more of the above described control blocks may not contribute to the control of the motor.

Figure 10:
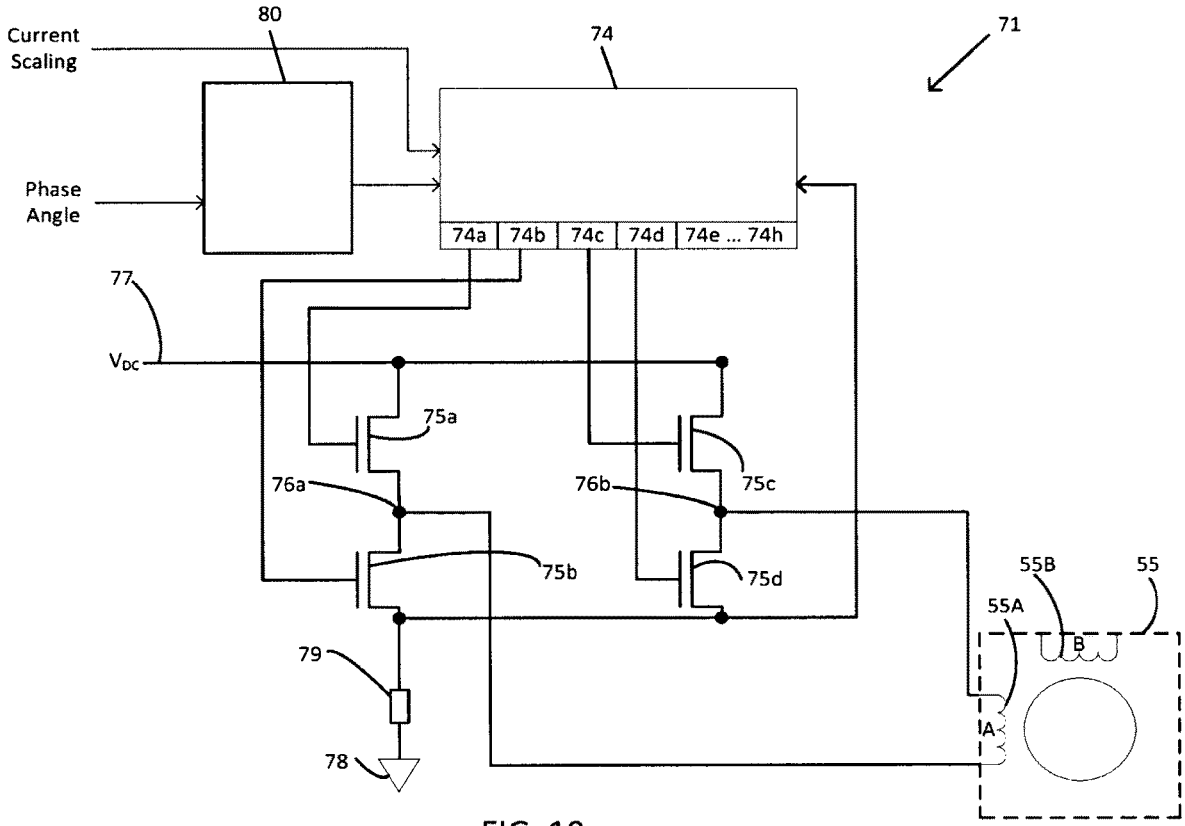
FIG. 10 is a schematic illustration of a part of the controller of FIG. 9.

FIG. 10 illustrates the stepper motor driver 71 which is arranged to drive the stepper motor 55. The stepper motor 55 is (in this embodiment) a two-phase bipolar stepper motor having two phases 55A, 55B, shown schematically at 90 degrees to one another. Each of the phases 55A, 55B may comprise multiple windings. The stepper motor driver 71 comprises a stepper motor controller 74, which receives as inputs motor phase current signals generated by a field vector generation block 80 and the current scaling signal generated by the torque controller 69. The field vector generation block 80 receives as an input the output of the phase angle adder 70 (as described above with reference to FIG. 9). The motor stepper driver 71 further comprises four power transistors 75*a* to 75*d* arranged in series pairs (75*a* and 75*b*, 75*c* and 75*d*), each pair having an intermediate node 76*a*, 76*b* between the two transistors of that pair. The two pairs of transistors are arranged in parallel between a DC power supply 77 and a ground connection 78. Each pair of transistors comprises an upper transistor 75*a*, 75*c* and a lower transistor 75*b*, 75*d* which are arranged to provide two parallel connections between the DC power supply 77 and the ground connection 78. As is common-place in PWM motor drives, free-wheel diodes may be associated with each of the transistors 75*a*-75*d*, allowing current to continue flowing in the windings when the transistors 75*a*-75*d* are switched off. It will be appreciated that there are many modes of operation of a full bridge current controller (e.g. 'fast', 'slow', and 'mixed' current decay modes) known in the art in which the transistors are switched in various sequences to achieve a desired motor current response under the control of a controller.

The intermediate nodes 76*a*, 76*b* are each connected to a respective end of the windings of the first phase 55A of the motor 55.

In operation each of the transistors 75*a* to 75*d* is controlled by a respective one of the output signals 74*a* to 74*d* so as to cause the first phase 55A to be energised in accordance with the desired winding current level. It will be appreciated that the first phase 55A can be energised in two directions. Further, as described in more detail below with reference to FIG. 12, the first phase 55A may comprise several windings, some of which may be arranged in opposing directions.

The current flowing through the windings of the first phase 55A returns through one of the lower transistors 75*b*, 75*d*, via a low value shunt resistor 79 to the ground connection 78. The use of a low value shunt resistor allows several amps of motor winding current to flow without causing significant losses in the resistor. The value of the shunt resistor determines the level of current which will be caused to flow in the motor windings for each value of the current scaling signal specified to the stepper motor controller 74 by the torque controller 69. The low value shunt resistor 79 may, for example be, a resistor having a resistance of around 0.04 ohm. The voltage developed across the resistor 79 is proportional to the current flowing through the windings of the first phase 55A, according to Ohm's law. The voltages developed across the resistor 79 is monitored by the stepper motor controller 74, for example by being provided to an comparator with the controller 74 where it is compared with a desired current level. The stepper motor controller 74 may be configured to compare a voltage developed across the resistor 79 with different reference voltages based upon a sensitivity setting. Thus, for a given sensitivity setting, the choice of resistor 79 will determine the maximum current level ($I_{pk}$), and thus level of current which will be caused to flow in the motor windings for each value of the current scaling signal specified to the stepper motor controller 74.

The second phase 55B is driven by a similar arrangement of transistors (not shown) to that described as driving the first phase 55A, controlled by output signals 74*e* to 74*h*.

As described above with reference to FIG. 9, the controller 60 is configured to control the stepper motor 55 based upon a signal which is indicative of the rotary position of the output shaft of the motor 55. The signal is generated by the encoder 72 which is associated with the motor 55 and which generates an output which accurately represents the angular position of the output shaft of motor 55. The angular position of the output shaft of motor 55 may be measured relative to the stator windings of the motor, or some other fixed position of a housing of the stepper motor. The encoder 72 may be arranged to generate 2048 output events (8192 quadrature events) during a full revolution of the output shaft of the motor 55. The encoder 72 may suitably be an AMT10 capacitive encoder manufactured by CUI Inc., Oregon, United States.

The stepper motor 55 may suitably be a bipolar two-phase stepper motor such as the 103H7822-1710 motor manufactured by Sanyo-Denki CO., LTD., Japan. This stepper motor has 200 full steps per revolution, each full step corresponding to an angular movement of the output shaft of the motor of 1.8 degrees.

The stepper motor controller 74 may be a controller such as a TMC262 manufactured by Trinamic Motion Control GmbH and Co. KG, Germany. It will be appreciated that in some embodiments the stepper motor controller 74 may be provided with step and direction control signals, and be arranged to internally determine the current magnitude and field angle values required to effect stepper motor movements as required. However, in some embodiments (as described in more detail below) the stepper motor controller 74 may be arranged to control the commutation and switching of transistors which are connected to the motor windings, so as to effect current magnitude and field angle values specified by the torque controller 69 and the field vector generation block 80. The field vector generation block 80 may, for example, be provided as a software routine running within a general purpose controller, or within FPGA logic (e.g. controller 60) and may thus be a separate controller to the stepper motor controller 74.

In such an arrangement the controller 60 is arranged to receive, as an input, an actual angular position of the stepper motor output shaft from the encoder 72. The field vector generation block 80 then generates electrical signals which are provided to the stepper motor controller 74 which in turn causes the windings of the stepper motor to be energised so as to cause the stator field to rotate to a position which will cause the rotor to move in the desired way.

In this way, the torque generated by the stepper motor 55 can be controlled and optimised. For example, by controlling the torque (or field) angle (that is, the angular offset between the stator field position and the rotor position) the torque can be maximised for a particular magnitude of current supplied to the motor windings. In particular, it is known that a stepper motor produces maximum torque when a field angle of 90 (electrical) degrees is used. Thus, the use of such a field angle allows the stepper motor to generate a maximum torque for a given winding current.

Moreover, the use of positional feedback based upon the output of the encoder 72 allows the motor winding currents to be modulated so as to produce a desired torque level. That is, rather than controlling the stepper motor 55 to operate in an open-loop position controlled mode, the stepper motor 55 can be operated in a closed-loop manner, using positional feedback. With such a control arrangement, and by appropriate control of the current supplied to the windings of the stepper motor 55, the torque generated by the stepper motor, and hence the printhead pressure can be controlled to a predetermined value.

Of course, it will be appreciated that the use of a stepper motor also allows the use of conventional open-loop stepper motor control (which may be referred to as stepping mode) when beneficial. For example, such open-loop control may be used to move the printhead in free-space, or to maintain a predetermined free-space position of the printhead (e.g. when the printhead is maintained in the ready to print position prior to commencing a printing operation, or during printhead carriage movement between printing cycles).

Further, in some embodiments a stepper motor may be operated in a closed loop positon controlled manner (as opposed to a closed-loop torque controlled manner, or an open-loop position controlled manner). Such control may be effected by use of the position controller 66.

However, by providing accurate information relating to the angular position of the output shaft (and thus the rotor) of the stepper motor 55, it is possible to achieve many of the benefits conventionally associated with stepper motors (e.g. high torque output, low-cost, and high-speed operation) while also providing advantageous characteristics usually associated with DC motors (e.g. a well-known relationship between the current supplied to the motor and the torque output by the motor). Moreover, by providing accurate positional information, and controlling the stator field based upon this information, there is no risk that a stepper motor will stall if the load is greater than the maximum torque capacity. Rather than the motor stalling, the stator field will simply be controlled so as to rotate to an angle which allows the required torque to be provided.

In an embodiment the stepper motor 55 may be operated in each of the modes described above during a single printing cycle. For example, during printing operations, when the printhead 4 is in contact with the printing surface 11, the printhead motor 55 may be operated in a closed-loop torque controlled manner, with the print force being primarily controlled by the print force controller 67.

Then, during movement of the printhead 4 away from the printing surface 11 to the ready-to-print position, the printhead motor 55 may be operated in a closed-loop position controlled manner (under the control of the position controller 66), so as to ensure that accurate positional control is maintained. This type of control allows the motor 55 to be operated in an efficient manner, with the fastest possible operation being achieved for a given current level, with minimal torque ripple, and with a reduced risk of stalling.

Then, during movement of the printhead 4 in a direction parallel to the printing surface 11 (but spaced apart from the printing surface) during carriage return, the printhead motor 21 may be operated in an open-loop position controlled manner (i.e. stepping mode) with the target position being set based upon the position of the carriage 13, or the rotational position of the output shaft of the carriage motor 17. Such open-loop control allows movement of the two motors 17, 21 to be closely synchronised, even during rapid movements, so that the printhead position relative to the printing surface 11 is maintained during carriage return.

Such open loop control may, for example, be performed under the control of the torque controller 69, with the demanded motor field orientation being updated based upon changes in the carriage motor position (for example, by updating the demanded stator field position by one quarter step each time a quarter step is moved by the carriage motor). In such an arrangement, the torque controller 69 may generate a phase angle signal which is passed directly to the motor driver 71 without requiring any additional signal to be provided from the encoder 72.

Additionally, in some embodiments, during movement of the printhead 4 from the ready-to-print position towards and into contact with the printing surface 11, the printhead drive motor 55 may be controlled in a closed-loop speed controlled manner, so as to move a predetermined speed or according to a predetermined motion profile. Such control may be carried out by the speed controller 62, as described in more detail below.

Of course, it will be appreciated that in some embodiments alternative control schemes may be used. Moreover, the various control techniques described above may be combined as appropriate for each particular application. For example, during movement of the printhead 4 in a direction parallel to the printing surface 11 the motor 55 may be operated in a closed-loop position controlled manner, with the target position controlled based upon the carriage motor position. During such operations, it will be appreciated that it is desirable to maintain a positional relationship between the printhead 4 and the printing surface 11, such that the vertical position of the printhead (in the orientation shown in FIG. 2) does not vary, ensuring that the printhead is in a known position, and can quickly move towards the printing surface once more to carry out a new printing operation when required.

Figure 4:
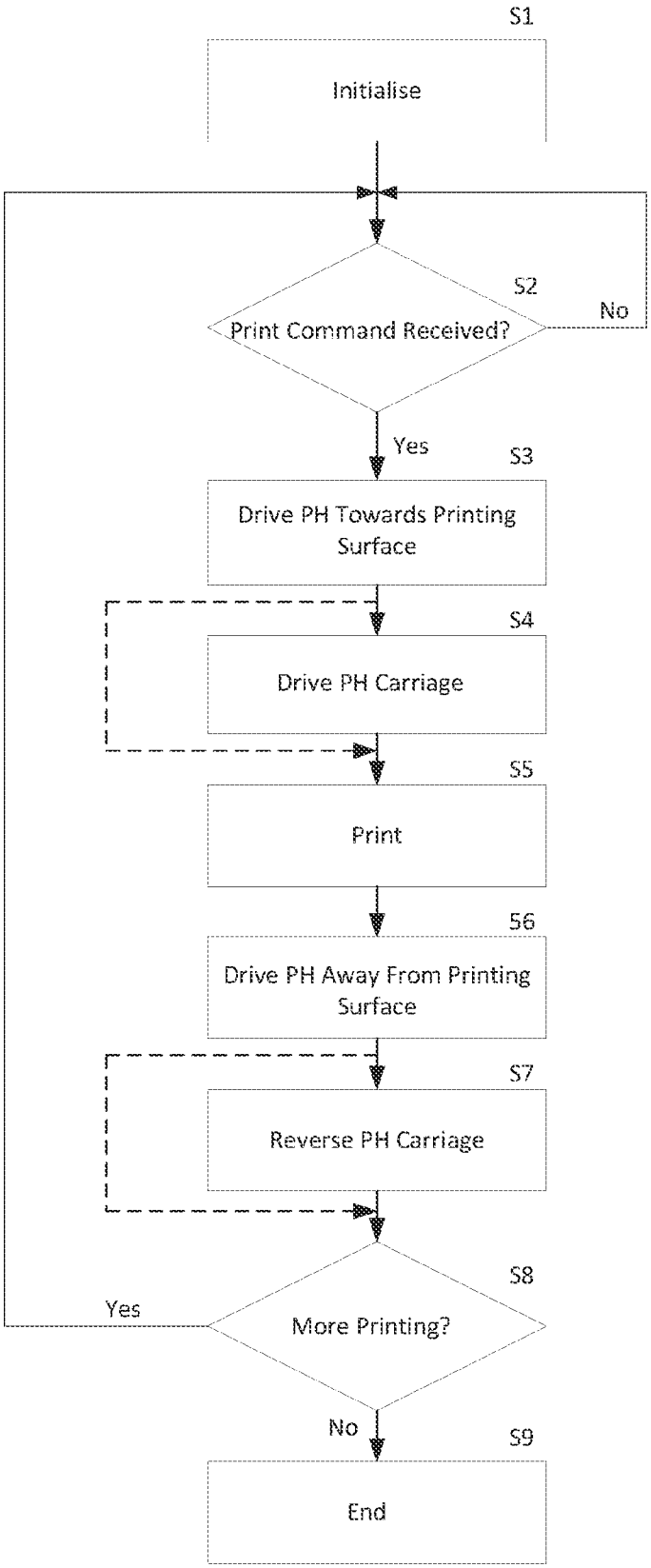
FIG. 4 is a flowchart showing control of the position of the printhead relative to a printing surface during printing operations.
Figure 7:
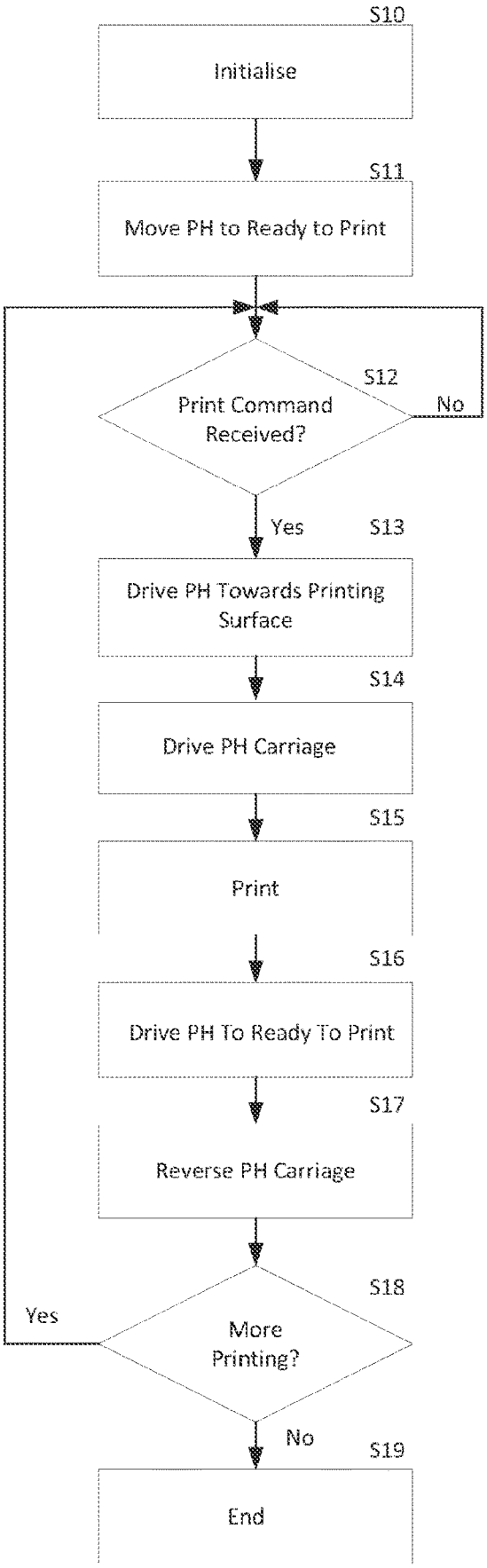
FIG. 7 is a flowchart showing control of the position of the printhead relative to a printing surface during printing operations.

Thus, a stepper motor may be used in place of a DC motor with the sequence of control operations being carried out generally as described further above, for example, with reference to FIGS. 4 and 7.

By controlling the current supplied to windings of the stepper motor based upon information relating to the angular position of the rotor, the orientation of the field generated by the motor is controlled. This type of control allows the stepper motor to be operated in a torque-controlled manner, so as to generate a predetermined output torque. Such a generated torque can be converted (via a suitable mechanical coupling) to a predetermined force (corresponding for a particular area to a predetermined pressure) which is to be exerted by the printhead on the printing surface during printing operations.

Figure 11:
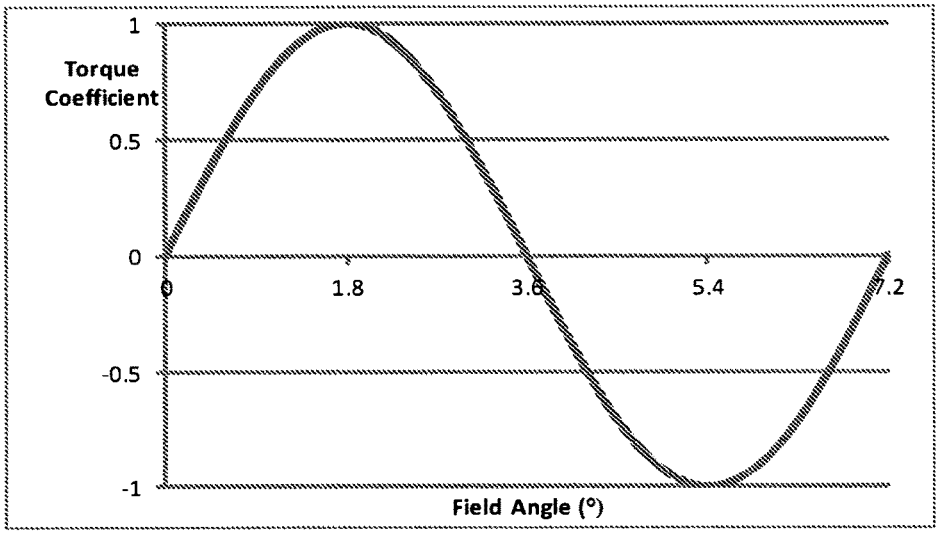
FIG. 11 is a graph showing the relationship between the field angle of control signals applied to a stepper motor and a coefficient of generated torque.

In more detail, as illustrated in FIG. 11, the torque generated by a stepper motor depends upon an angle formed between the magnetic field of the rotor and the magnetic field generated by the energised motor windings. In FIG. 11, the x-axis shows field angle, and the y-axis shows torque coefficient. The torque coefficient illustrated at each point indicates the torque that is generated as a proportion of the maximum available torque (for a given winding current) at a particular field angle. Where a stepper motor having a full step angle of 1.8 degrees is used (i.e. having 200 full steps per revolution), as in this example, an electrical angle of 90 degrees corresponds to a physical angle of 1.8 degrees. The generated torque is, therefore, at a maximum when an angle of 1.8 degrees is formed between the magnetic field vector and the rotor field position.

It is noted that where the angular position of the rotor field, and the direction of the stator field are discussed, what is meant is that there is a nominal position of the rotor and a nominal position of the stator field, and that the relative position between these two positions varies according to some relationship. The angular offset between the nominal position of the rotor and the nominal position of the stator field may be referred to as the field angle (or torque angle).

It will further be appreciated that in a stepper motor the rotor is generally configured such that there are many effectively identical angular positions in terms of magnetic and electrical performance, which may correspond to a plurality of different actual angular positions of the rotor shaft with respect to the stator (and therefore with respect to the motor housing). As such, depending on the initial position of a rotor, when a stepper motor is energised, the rotor may move to one of several (e.g. 50) distinct angular positions.

Similarly, the stator windings of the motor are typically arranged so as to have a number of windings which have different fixed angular positions. The magnetic field generated at any point in time can be represented by a vector which is based upon the relative field strengths generated by a number of windings (e.g. by each of two adjacent windings). For example, if two adjacent windings are energized to the same level, the field vector will be midway between the two windings. However, if one winding is fully energized and the adjacent winding is not energized, the field vector will be aligned with the energized winding. Again, it will be appreciated that there may be repeated windings within a motor and as such, when referring to a field vector position, it is meant to refer to the position of that field vector with reference to each set of windings.

Figure 12:
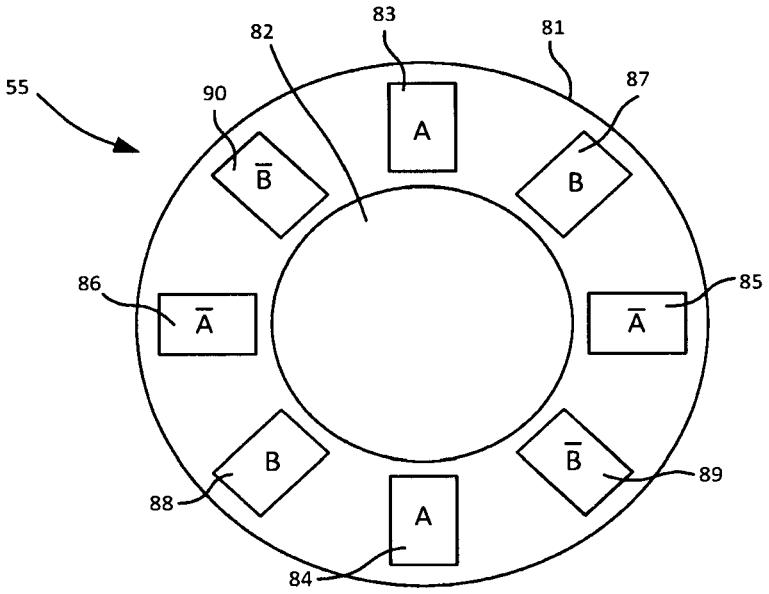
FIG. 12 is a schematic illustration of a part of a stepper motor which may be used in an embodiment of the printer of FIG. 1.

FIG. 12 shows schematically an example of the winding structure of a bipolar hybrid stepper motor 55, such as may be used to implement the motor 21. The motor 55 comprises a housing 81, and a rotor 82. The rotor 82 comprises a permanent magnet (not shown) and a plurality (e.g. 50) of equally spaced teeth distributed around its circumference (also not shown). In the illustrated example there are eight windings, with two 'A' windings 83, 84, two '$\overline{A}$' windings 85, 86, two 'B' windings 87, 88, and two '$\overline{B}$' windings 89, 90. The two 'A' windings 83, 84 are arranged at opposite sides of the stator housing 81 from one another (i.e. spaced apart by 180 degrees), with the two '$\overline{A}$' windings 85, 86 also being arranged at opposite sides of the stator housing 81 from one another, each being offset by 90 degrees from a respective one of the 'A' windings 83, 84. The 'B' and '$\overline{B}$' windings 87, 88, 89, 90 are provided in a similar arrangement, each winding being offset by 45 degrees from a respective one of the 'A' or '$\overline{A}$' windings 83, 84, 85,86. The windings 83 to 90 each form a magnetic pole the polarity of which is determined by the direction of current flowing within the windings. The surface of the poles which faces the rotor 82 is provided with teeth (not shown) which can be aligned with the teeth of the rotor 82. The 'A' windings 83, 84 and the two '$\overline{A}$' windings may together be referred to as the first phase 55A of the motor 55. Similarly, the 'B' and 'B' windings 87, 88, 89, 90 may together be referred to as the second phase 55B.

It will thus be appreciated that during a full electrical switching cycle (i.e. cycling each winding through a full 360 sine or cosine wave) the stator field will in fact rotate by 180 degrees. Further, during the same full electrical switching cycle, the rotor (if unimpeded) will rotate by 7.2 degrees. Thus it will be understood that the term 'field angle', when used to refer to an angular offset between the stator field vector and rotor position, may not strictly refer to any physically observable angle, but rather an offset in the relative phase of the switching waveform. Further, it will be appreciated that the various physical angles corresponding to a particular field angle may vary based upon motor construction.

In other words, the field angle is based upon relative angular position within the frame of reference of a single electrical switching cycle, as dictated by the repeating magnetic and electrical arrangement of the motor, and a particular field angle may correspond to a plurality of different actual rotor positions.

It will be understood that field angle can vary between 0 and ±180 electrical degrees (or, equivalently, 0 and +360 degrees, as shown in FIG. 11) which, in a stepper motor having a native resolution of 1.8 degrees per step, corresponds to an actual rotor positon of ±3.6 degrees. That is, two full-steps forwards, or two full-steps backwards. It will also be appreciated that the same energization condition applied to a stepper motor may have the effect of causing the rotor of the motor to adopt one of a number of different angular configurations (assuming that the motor is not restricted in any way), depending upon the initial starting position of the rotor.

As shown in FIG. 11, the maximum torque available from a stepper motor (for a given winding current) of the type described above varies substantially sinusoidally with respect to the field angle, with a period of four full steps. That is, for a stepper motor having a native step size of 1.8 degrees of the type described above, the generated torque is zero at an angle of zero degrees, rising to a maximum at an angle of 1.8 degrees (90 electrical degrees), before falling back to zero at 3.6 degrees (180 electrical degrees). Further, due to the nature of the motor construction, for a given stator field vector position, once the rotor has moved further than two-full steps (3.6 degrees of rotor movement, 180 degrees in the electrical switching cycle), the torque produced becomes negative, and in fact urges to the rotor to move further from the 'zero' degree position. Thus, as described briefly above, a maximum torque output can be achieved by controlling the stator field vector to maintain an angular position which is offset with respect to the actual rotor position by 1.8 degrees (i.e. 90 electrical degrees).

In a basic form of operation known as full-step operation, a stepper motor may be operated by advancing the signals applied to the windings such that the motor field is indexed by an angle corresponding to a full step in the native resolution of the motor (e.g. 1.8 degrees) for each step required to be advanced by the motor shaft. In this way, the electrical signals causing the field vector to be generated may be advanced in increments of 90 electrical degrees. During such operation, and when there is no restriction to movement of the rotor, once each field vector position is established, the rotor will quickly adopt a position which is fully aligned with a native step positon and, once the rotor has moved to that position, no further torque will be applied (i.e. the field angle will be zero).

However, where forces act to oppose the rotation of the rotor, the rotor may be caused to adopt a position which is not fully aligned with a native step positon. That is, if a step of 1.8 degrees is requested, the rotor may only rotate by an amount which is less than that requested, before being restricted by a resisting force applied to the shaft of the motor, and some residual torque may be applied to the motor when movement has stopped. The magnitude of any residual torque will depend upon the nature of the obstruction to rotation (e.g. resilience of a printing surface), with an equilibrium being found between the torque applied by the motor, and the reaction force experienced by the rotor.

Further, where a motor is operated so as to rapidly execute a plurality of steps (or sub-steps), the rotor may never fully execute a first step before a second step is requested. Thus, a constantly changing torque is experienced by the rotor, increasing as each step is requested, and reducing as the rotor begins to execute each step (assuming that, at all times, the field angle is maintained within an acceptable range, and stalling does not occur).

The full-step operation of a stepper motor described immediately above may be used in an open-loop controlled system. That is, there is no information regarding the actual position of the rotor of the motor, and it is necessary to control the currents applied to the windings of the motor such that the stator field vector rotates to a desired position, with the rotor being assumed to follow the field vector so as to minimize the angle between the rotor position and the field vector position at all times.

However, given knowledge of the actual angular position of the rotor of the motor 55 (e.g. based upon the output of the rotary encoder 72), the currents caused to flow in the windings of the motor 55 can be controlled so as to achieve any desired stator field vector direction, and therefore cause any desired torque to be applied to the rotor. Moreover, as described above, the maximum torque generated by the motor (for a given winding current) can be achieved when there is a field angle of 90 electrical degrees. Therefore, to control the motor 55 so as to generate a maximum torque, it will be understood that maintaining a field angle of 90 electrical degrees is desirable.

In this way, by using actual information regarding the angular position of the rotor, it is possible to continually update the current supplied to the windings of the motor 55 so as to achieve energization of the motor 55 which ensures that the electric magnetic field constantly leads the rotor position by the maximum field angle 90 electrical degrees, thereby ensuring that a constant (and maximum) torque (for a given current value) is applied to the shaft of the motor 55. Such control is performed by the torque controller 69, which generates the current scaling signal, and the phase lead signal (e.g. 90 degrees), with the phase lead signal being added to the actual rotor position by the phase angle adder 70.

In use, the magnitude and polarity of currents supplied to the motor windings may be updated so as to maintain the field angle at the predetermined value each time a signal indicating movement of the encoder 72 is received by the controller 60. Based upon typical geometry and operating conditions, the controller may receive over 75,000 encoder updates per second. For example, where an encoder generates 8192 quadrature events per revolution, and the pulley 22 has an outer diameter of 17.19 mm, an encoder event is generated for each 6.59 micrometre of linear movement at the circumference of the pulley 22. Where the pulley 22 is rotating so as to result in a linear speed of 500 mm/s (again, at the circumference of the pulley 22), 75846 quadrature events are generated each second. In some embodiments, the belt 19 may be driven by the pulley 22 at a linear speed of up to 800 mm/s. In further embodiments, the belt 23 may be driven by the pulley 22 at a linear speed of up to around 1000 mm/s, resulting in over 150,000 encoder updates being generated per second. Further, a current scaling factor (i.e. a value of the current scaling signal), which allows the magnitude of the field vector to be adjusted, may also be updated at frequent intervals, such as, for example, each millisecond.

Thus, the rotor is not caused to jump between native step positions. Rather, the rotor experiences a continually rotating magnetic field which causes the rotor to rotate in a smooth manner. Furthermore, the torque applied to the rotor does not experience the same level of torque ripple which is experienced during open loop step operation of a stepper motor. In particular, because of the continually updated energization field, the motor experiences a smooth torque, which is relatively insensitive of the exact alignment between the various physical features of the rotor and stator.

In use, the current supplied to the windings of the motor can be determined by the field vector generation block 80 by indexing into a pair of look up tables which represent the relative magnitude of the current supplied to each of the windings to generate a particular magnetic field vector. That is, for each magnetic field vector position there is a particular ratio of currents to be applied to the windings of the motor. Furthermore the magnitude of the current supplied to the windings of the motor can be modified (by adjustment of the current scaling signal provided to the stepper motor controller 74) so as to generate a different torque level.

It will be understood that the current levels will correspond to a particular torque level which corresponds to a particular print force level, and that a lookup table may provide a set of current levels required to achieve a particular torque level (as described in more detail below). The required torque may be configurable (e.g. to implement different print force settings) and as such a plurality of lookup tables may be provided (e.g. one for each of a plurality of different print force settings). Alternatively, lookup tables may be stored for maximum and minimum print force settings, with interpolation used to generate current levels required for intermediate print force settings based upon the stored maximum and minimum values. Lookup table data may be generated empirically based upon experiments performed on a particular printer configuration.

An example of the way in which the current levels flowing within each of two phases within a two-phase bipolar hybrid stepper motor may be determined using well-known sinusoidal commutation techniques is now described in more detail. It will be understood that the electrical switching sequence for each of the phases A and B is sinusoidal, but with a 90° phase shift between them. The current value caused to flow in phase A is equal to:

$$I_A = I_{pk} C_S \sin\theta$$

where:

$I_A$ is the current to be supplied to phase A;

$I_{pk}$ is the peak current;

$C_S$ is the current scaling factor (discussed in more detail below); and $\theta$ is the desired field vector angle.

Similarly, the current value caused to flow in coil B is equal to:

$$I_B = I_{pk} C_S \cos\theta$$

where:

$I_B$ is the current to be supplied to phase B.

Of course, it will be understood that rather than being calculated in real-time, these current values may be generated based upon data stored in lookup tables.

Moreover, rather than being calculated by a single processing block using the equations described above, appropriate motor winding current levels may be determined by the motor driver 71 based upon signal received from the torque controller 69. In more detail, the field vector generation block 80 may generate normalised current values to be applied to each of the motor phases 55A, 55B based upon the desired field vector angle. The normalised current values are subsequently combined, by the stepper motor controller 74, with the value of the current scaling signal specified by the torque controller 69. The peak current value $I_{pk}$ may be determined by the configuration of power supply and/or the stepper motor controller 74, and may be selected to provide a desired maximum torque value.

As the desired field vector angle $\theta$ is advanced from 0° to 360°, the rotor (if unimpeded, and assuming that the angular change is sufficiently slow for the rotor to keep up) will be caused to move through a physical angle 7.2°, which corresponds to four full-step positions for a motor having a step size of 1.8°.

This switching cycle repeats for every 7.2° physically rotated by the motor shaft, or for every four full-steps of rotation.

It will be appreciated that control of the current supplied to the windings of the motor in this way may require a stepper motor controller which allows direct configuration of the current supplied to the windings, rather than simple step and/or direction controls. One such suitable controller may be a TMC262 controller referred to above. Similarly, accurate positional information may be provided by an encoder having a resolution of, for example, 8192 quadrature events per revolution, also as described in more detail above.

In use, an initialization routine may be performed during which currents are applied to the windings of the motor 55, and the rotor is allowed to align to the position of the magnetic field. Such an initialization should be carried out with no opposition provided to the movement of the rotor. This allows the rotor to be aligned with the native resolution of the motor (e.g. to align with a full-step position) and for the actual position of the rotor to be measured by the encoder 72, and the measured actual position compared with a known driven stator field orientation.

For example, during the initialisation routine, the winding currents may be set to a value based upon a predetermined field angle (e.g. $\theta$=0°) and a predetermined peak current value and maximum current scaling factor (e.g. a maximum possible level—so as to minimise any final position error). Then, once a settling time has elapsed the encoder position is set to a datum value (e.g. 0). Thus, it can be known that the encoder datum value (e.g. 0) corresponds to the predetermined field angle (e.g. $\theta$=0°) in subsequent switching operations.

Thereafter, relative movement of the rotor from the datum position can be monitored by the encoder 72, while the position of the magnetic field vector generated by the stator can be controlled by the field vector generation block 80. Therefore, at all times, the angle between the angular position of the rotor and the magnetic field vector (i.e. the field angle) can be monitored and controlled.

That is, each time the encoder position changes after initialisation, the absolute rotor position (which has a range of zero to 360 physical degrees) is mapped to a position within the repeating range of 0° to 7.2°. For example, an absolute angle of 9.0° with respect to the zero position is treated as 1.8°, and so on. Each physical rotor position is then mapped to an angle within the electrical switching range of 0° to 360° using well known trigonometric relationships. For example, the electrical angle may be calculated as follows:

$$\theta_{EL} = \sin^{-1}\left(\sin\left(360\left(\frac{\theta_R}{7.2}\right)\right)\right)$$

where:

$\theta_{EL}$ is the electrical angle; and $\theta_R$ is the physical rotor angle.

In this way, a physical angle can be converted to an appropriate angle within the in the electrical switching range of 0° to 360°. It will be appreciated that any convenient technique may be used to convert the encoder position into an appropriate electrical angle. Alternatively, an encoder output may be converted to an appropriate index into a lookup table without being converted into a physical angle.

A desired field lead angle (e.g. 90°) is then added by phase angle adder 70 to generate a desired angle for a field vector which is to be applied in order to maintain optimum torque.

Thus, coil currents for each coil are generated by the stepper motor controller 74, as described above, based upon a desired torque and a desired field angle, which are specified by the torque controller 69.

In practice, rather than providing for continually variable current scaling (i.e. the value $C_S$), a stepper motor controller may provide for a predetermined number of equally spaced levels for the value of $C_S$. For example, the TMC262 device may be arranged to provide 32 levels of current scaling, with the actual magnitude of current supplied to the motor windings being set by the electrical configuration of the device based upon the selected level. Thus, a maximum current capability may first be determined ($I_{pk}$), and then a scaling value between 1 and 32 selected, for example by the torque controller 69. The maximum current capability may be determined by characteristics of the power supply provided to the motor 55, and by configuration of the stepper motor controller 74. The current scaling value may be provided to the stepper motor controller 74 via a serial control interface, and used by the stepper motor controller 74, in combination with phase magnitude signals provided to the stepper motor controller 74 by the field vector generation block 80, to determine the level of current supplied to the motor windings.

Further, whereas the encoder position may be known to $1/8192$ of a full revolution, the stepper motor controller may provide for position control based upon micro-step positons. For example, each full step (i.e. 1.8 degrees) may be divided into a plurality (e.g. 256) of equally spaced micro-steps.

Therefore, each switching sequence of 360 electrical degrees (which corresponds to 4 full-steps, or 7.2 physical degrees) may be sub-divided into 1024 micro-steps. A lookup table may be provided which includes current levels to be provided to the motor windings to achieve each of these 1024 micro-step levels. The lookup table may be provided within, or associated with, the stepper motor controller 74.

When operated in open-loop stepping (or micro-stepping) mode, the stepper motor controller 74 will advance an internal index into the lookup table so as to generate appropriate winding current levels based upon each step signal provided to the controller. However, when operating in a field-controlled manner, the physical rotor position can be resolved to an equivalent micro-step positon (e.g. in the range 0 to 1023) so as to determine an appropriate ratio of winding current levels for each winding. Where the magnitude of winding currents is controlled by the field vector generation block 80 in this way, the lookup table may be stored in a memory location accessible by the field vector generation block 80.

An index into the lookup table may be required to be modified in a number of ways to ensure that an appropriate magnitude value is obtained. For example, it may be necessary to add or subtract a predetermined offset (e.g. 256), so as to achieve a required field angle (e.g. 90 electrical degrees) in order to generate a particular torque in a particular direction. Further, if such an adjustment results in the index being outside the range 0 to 1023, any over- or underflow can be dealt with by adding or subtracting 1024 as appropriate. Finally, the resulting index may be further manipulated so as to be mapped on to a value within a single quadrant (i.e. a value in the range 0 to 255). That is, a lookup table may be populated with current magnitude values in a single quadrant only (i.e. values 0 to 255, corresponding to 0 to 90 electrical degrees, or 0 to 1.8 physical degrees), and magnitude values for the remaining quadrants can be obtained by appropriate modification.

It will be appreciated that where the magnitude values follow a sinusoidal pattern, the magnitude values for the remaining quadrants (i.e. 90-180, 180-270, 270-360 degrees) can be readily calculated from the data provided for a single quadrant. Similarly, magnitude values following a cosine pattern (e.g. which may be required for a second electrical winding), may be readily calculated from the data provided for a sinusoidal pattern (or quadrant thereof) by appropriate manipulation.

Of course, alternative techniques may be used for generating an appropriate current level for each of the motor windings (e.g. by calculation). In some embodiments additional adjustments may be made to the appropriate current level for each of the motor windings. For example, a sine wave commutation pattern may be modified to compensate for non-linearities in motor performance.

In general, if a controlled torque is required to be generated by the motor, this can be achieved by setting the magnetic field angle to lead the rotor position by an angle which corresponds to the maximum torque for a given winding current in a particular motor arrangement (e.g. 1.8 degrees). This will result in the maximum torque being generated by the motor for a given winding current. Then, as the rotor rotates in response to the application of the field, the applied field can be immediately updated using a feedback loop so as to ensure that the field is continually applied at an angle which leads the actual rotor position by the predetermined amount. This form of closed-loop control may be referred to a closed-loop field control, or field-oriented control. More generally, a desired motor output characteristic can be achieved by controlling the magnetic field to have a predetermined relationship with the rotor position.

Such closed-loop field control of a stepper motor effectively prevents any risk that the motor can stall. It will be appreciated that stalling of a conventionally controlled stepper motor (i.e. one which is controlled in an open loop position controlled manner) occurs when a resisting force to a desired movement of the rotor is greater than the maximum torque which can be applied by the motor for a given winding current, resulting in the field angle increasing past the maximum of 1.8 degrees, and slipping occurring between the actual rotor position and the desired position (which corresponds to the rotor position where the field angle is zero). Thereafter, it will be impossible to know the actual angular position of the motor and positional control may be lost. In particular, once a rotor has slipped from one pole alignment, it cannot be known if it has slipped through a single repeat of the magnetic repeat interval (e.g. 7.2 degrees, where each single step is 1.8 degrees), or a multiple thereof.

However, the use of the positional encoder 72 ensures that at all times the actual angular position of the rotor is known, and the field position vector can be controlled so as to have a predetermined angular relationship with the actual angular position of the rotor.

The use of a closed-loop field controlled rotor in this way ensures that the maximum torque output can be generated for a given motor for a given winding current. Moreover, it will also be appreciated that the avoidance of any risk of stall conditions allows a smaller motor to be used for a particular application than would otherwise be necessary. That is, whereas it is customary to oversize a motor (i.e. by providing a motor which is capable of supplying a torque greater than that required) such that stall conditions are not likely to occur given the severe negative consequences associated with stalling a position controlled motor, the provision of positional feedback allows a motor having a maximum torque capacity which is no more than is required by a particular situation to be used. Furthermore, the use of a smaller motor also allows a power supply to be provided which is appropriate to the desired torque level, rather than one which has additional capacity. In use, rather than supplying additional current to the windings of the motor so as to prevent any the loss of synchronisation (i.e. stalling), this is unnecessary where the actual rotor position is provided as an input to the controller.

In contrast to conventional DC-servo motor control techniques, in which a torque generated by a motor is controlled by monitoring current flowing in windings of the motor and controlling the current in order to achieve a desired level (which corresponds to a desired torque output), the control of a stepper motor to generate a predetermined torque uses positional feedback, thereby allowing the commutation of currents supplied to the motor to be controlled so as to cause the magnetic field generated by the energised windings of the motor to have an orientation which causes a predetermined torque to be generated. Current feedback may also be used so as to allow the controller to cause a desired current to flow in the motor windings. Thus, there are two parameters which can be controlled (field orientation and current magnitude) in order to achieve a directed motor output characteristic (e.g. generated torque).

It will be understood that a stepper motor controller (e.g. the TMC262 device) may provide internal current feedback (for example, by monitoring the voltage developed across the resistor 79). That is, the stepper motor controller 74 may be requested to cause a predetermined current flow in the windings by the field vector generation block 80 and the torque controller 69, and may use current feedback in a control process to modulate the control signals (e.g. PWM control signals) so as to ensure that the predetermined current level is achieved.

It will, of course, be appreciated that motors having different constructions will require different control schemes. For example, where a stepper motor having a different native resolution (i.e. degrees per step), a different field angle may be required to generate a maximum torque. Further, in some embodiments a motor may be operated with a predetermined field angle which does not correspond to a maximum torque output. That is, the field angle is not necessarily set to 90 electrical degrees. Moreover, where the motor is to be controlled in a position controlled mode, the desired field lead angle may be set to zero degrees.

The use of a printhead motor 21 operated in a torque controlled manner as described above will now be discussed in more detail as discussed in more detail in the context of the printer 1 described further above. In particular, the operation of the motor will be discussed in the context of a printer having a carriage motor 17 which is arranged to drive the printer carriage 13 and a print head motor 21 which is arranged to drive the print head 4 (as described above with reference to FIGS. 1 to 3). However, while each of the motors 17, 21 may primarily control one of the print head carriage 13 and the print head 4 respectively, it will of course be appreciated that the print head carriage 13 and the print head 4 itself are both influenced by control of each of the print head carriage motor 17 and the print head motor 21. Moreover, it will be appreciated that, in some embodiments, the motor 21 may be a stepper motor, or a DC motor. Printer operations will now be described in the context of a printer in which the motor 21 is the stepper motor 55, with the controller 60 being as described above with reference to FIG. 9.

As described above with reference to FIG. 7, at step S13, when a 'print' command has been received by the controller the printhead drive motor 21 may be energised to cause the printhead 4 to move towards and into contact with the printing surface 11, and to press against the printing surface 11 with a predetermined pressure.

During such movement of the printhead 4 from the ready-to-print position towards and into contact with the printing surface 11, the printhead drive motor 21 may be controlled in a torque controlled manner. For example, control signals may be generated by the torque controller 69 in order to cause the motor 21 to generate a predetermined torque, causing the printhead 4 to move into contact with the printing surface 11 and to exert a predetermined force upon the printing surface 11.

Alternatively, in some embodiments, during movement of the printhead 4 from the ready-to-print position towards and into contact with the printing surface 11, the printhead drive motor 21 may be controlled in a speed (or position) controlled manner, so as to move a predetermined speed or according to a predetermined motion profile. For example, a motion profile (comprising, for example, target speed data, and acceleration and deceleration phases) may be generated which is intended to cause the printhead 4 to move into contact with the printing surface 11 as quickly as possible without experiencing significant bouncing upon making contact with the printing surface 11.

For example, the printhead drive motor 21 may, for example, be controlled by a PID control loop implemented in the speed controller 62 which receives, as an input, a speed error signal generated by the speed demand adder 61, and which generates a control output which passes to the torque controller 69 and in turn controls the torque applied to the motor (by appropriate control of the stator field) in order to bring about the desired motion profile. The gain provided to the speed controller 62 may, for example, comprise just a proportional component, and thus the PID control loop may just use proportional control.

Alternatively, the printhead drive motor 21 may be controlled by a PID control loop implemented in the position controller 66 which receives, as an input, a position error signal generated by the printhead position adder 65, and which generates a control output which passes to the torque controller 69 and in turn controls the torque applied to the motor (by appropriate control of the stator field) in order to bring about the desired position change. The gain provided to the position controller 66 may, for example, comprise just a proportional component, and thus the PID control loop may just use proportional control.

The position controller 66 may also take into account the carriage position, so as to ensure that the motor 21 is also moved to take into account any movement of the motor 17. For example, as described above, a relative position signal may be generated based upon the relative position of the output shaft of the printhead motor 21 (as indicated by the encoder 72) and output shaft of the carriage motor 17 (e.g. based upon a control signal provided to the carriage motor 17). This relative position signal may be used as an input (not shown in FIG. 9) to the printhead position controller 66.

Alternatively (also as described above), the relative position signal may be provided to the printhead position adder 65 in place of the printhead motor position signal received from the encoder 72. In such an embodiment, the output of the printhead position adder 65 is indicative of the difference between the demanded and actual position of the printhead 4 with respect to the printing surface 11 (provided the position demand signal is suitably calibrated), rather than simply the position of the printhead motor 21 (which, depending upon the position of the carriage motor 17, could correspond to different printhead positions).

Additionally, the point at which the printhead 4 makes contact with the printing surface 11 may be detected (for example by monitoring the rotation of the printhead drive motor 21), and the detected contact position used to modify the control of the printhead drive motor 21 in subsequent movements. Such control may enable any oscillation in printing force after initial contact is made between the printhead 4 and the printing surface 11 to be reduced. For example, the distance expected to be moved by the printhead drive motor 21, and the motion profile generated to cause that movement, may be modified based upon the detected contact position. Such monitoring of the rotation of the printhead drive motor 21 and the detection of the contact position may, for example, be performed during regular printing operations. Alternatively, the monitoring may be performed during a separate initialisation routine.

The predetermined pressure with which the printhead 4 is caused to press against the printing surface 11 may correspond to an optimum printing pressure, and may be controlled by appropriate control of the current supplied to the windings of the printhead motor 21. In particular, the motor may be operated in a closed-loop field controlled manner in order to generate a predetermined torque.

While the printhead carriage 13 is stationary, a holding torque may be applied to the printhead carriage motor 17, the motor being operated in a position controlled mode. This holding torque may act to prevent rotation of the printhead carriage motor 17 in response to a reaction force acting on the printhead 4 from the printing surface 11 when the printhead 4 makes contact with the printing surface 11. It will be understood that a component of the reaction force acting on the printhead 4 will act, via the belt 19, to urge the printhead carriage motor 17 to rotate.

For example, the carriage 13 may be controlled in an open-loop stepped manner. Thus, to maintain a substantially stationary carriage position, a current will be provided to the windings of the printhead carriage motor 17. As the reaction force acting on the printhead 4 from the printing surface 11 increases, the carriage 13 may be caused to move slightly from the controlled position, such that a torque is generated by the carriage motor 17 (the torque varying based upon the angular offset between the desired positon and the actual position as shown for the motor 21 in FIG. 11). Thus, if the current provided to the windings of the printhead carriage motor 17 is too low, the motor may stall, and the carriage may move in an undesirable (and unpredictable) way, for example, by moving to one end of its travel.

Once the required printing pressure has been achieved, processing passes to step S14, where the printhead carriage 13 is caused to move by movement of the printhead carriage motor 17. In use, a predetermined settling time (e.g. 15 ms) after contact is made between the printhead 4 and the printing surface 11 may be allowed to elapse before processing passes to step S14. It will be appreciated that the described printing operation is carried out by a printer operating in an intermittent printing mode.

It will be appreciated that it is desirable to provide a stable printing force for as large a proportion of a printing cycle as possible, so as to maximise the time available for printing (for example, by minimising time required for printhead force stabilisation). Moreover, where possible, printing operations may be carried out during periods of constant speed motion of the printhead carriage 13, and also during acceleration and/or deceleration of the printhead carriage 13.

Figure 13:
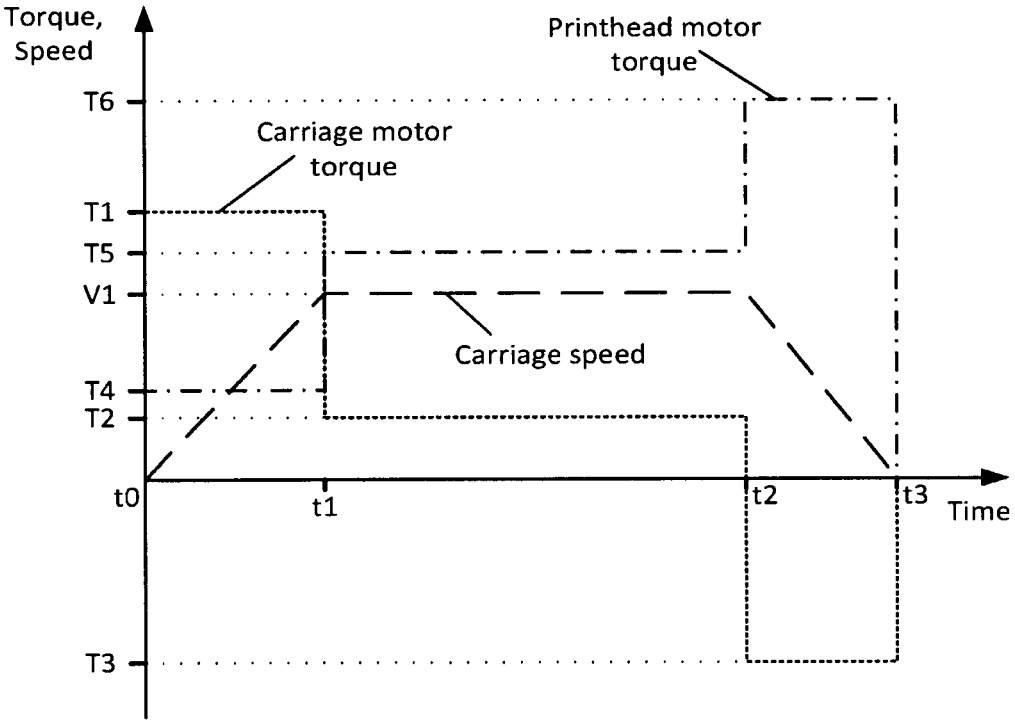
FIG. 13 is a graph showing torques generated by two motors of the printer of FIG. 1, and the speed of one of the motors, during various phases of a printing cycle.

FIG. 13 illustrates schematically the levels of torque applied to each of the carriage motor 17 and the print head drive motor 21 during the printing of an image, as well as the linear speed of the printhead carriage 13 during such printing operations.

As shown in FIG. 13, the printhead carriage speed is zero at time t0. The printhead carriage 13 then accelerates at a constant rate of acceleration to a speed V1 at time t1, before maintaining the constant speed V1 until time t2. At time t2 the printhead carriage 13 begins to decelerate at a constant rate of deceleration to a speed of zero at time t3.

Referring now to the torque generated by the printhead carriage motor 17, it will be understood that as the printhead carriage is accelerated from rest, a torque is applied. For example, during the acceleration phase between time t0 and t1, a substantially constant torque T1 is generated. Once the constant speed has been reached at time t1, the printhead carriage motor 17 generates a reduced level of constant torque T2 between times t1 and t2. The constant torque T2 may generally correspond to the torque required to overcome various friction and resistive forces in the printer. Then, during the deceleration phase between times t2 and t2, a negative torque T3 is generated. This negative torque T3 has a similar magnitude, but opposite direction, to the positive torque T1. It will also be appreciated that the torque generated by the printhead carriage motor 17 may not be a controlled variable. That is, the printhead carriage motor 17 may be controlled in a position and/or speed controlled manner, with sufficient torque being generated during each phase of motion to carry out the desired position and/or speed changes.

Referring now to the torque applied to the printhead motor 21 (which may be operated in a torque controlled manner), as the printhead carriage 13 is accelerated from rest between times t0 and t1 a torque T4 is applied which acts to maintain the printhead pressure established before the onset of printhead carriage movement. However, if no torque was generated by the printhead motor 21 during the above described movement of the printhead carriage 13, the printhead 4 may be caused to move in an unintended way, for example due to the interaction between forces applied to the printhead 4 by the movement of the printhead carriage 13 (under the influence of the carriage motor 17), and various other forces (e.g. reaction force from the printing surface 11, friction in the belt 23 and pulleys 22, 24, inherent resistance to movement by the motor 21 etc.). Further, it will be appreciated that if the printhead motor 21 was simply held stationary (i.e. prevented from rotating at all) during this acceleration phase, the printhead 4 would be forced into the printing surface 11, thereby increasing the printing force. Therefore, in order to maintain the printhead position in a direction generally perpendicular to the printing surface (as determined by the angular position of the second arm 26), and also the pressure applied by the printhead 4 to the printing surface 11, it is necessary for the printhead motor 21 to generate a reduced torque to resist movement.

Thus, during the acceleration phase between time t0 and t1, the torque T4 is generated by the printhead motor 21 so as to take into account the effects of the torque T1 generated by the carriage motor 17, and also to maintain the desired printhead pressure. That is, the carriage motor 17 acts to increase the printhead force. The printhead motor torque is therefore reduced, as compared to the static case (which occurs before the time t0 in FIG. 13), in order to compensate for the action of the carriage motor 17. Such control of printhead pressure may be performed by the print force controller 67, which provides appropriate control signals to the torque controller 69 based upon the print force demand signal.

In use, the print force controller 67 receives, as an input, data indicative of the current speed of rotation of the carriage motor 17 (which data may be based upon control signals provided to the carriage motor 17). The print force controller 67 receives regular speed updates relating to the speed of rotation of the carriage motor 17. Based upon this speed data, data indicative of the acceleration of the rotation of the carriage motor 17 is generated. This acceleration data is then used, in combination with the print force demand signal, to determine the appropriate torque to be applied by the printhead motor 21.

For example, in an embodiment the print force controller 67 may be provided with a maximum carriage motor acceleration value, and a minimum carriage motor acceleration value, which values may be stored in a memory associated with the controller. A predetermined torque value for the printhead motor may be associated with each of the minimum and maximum acceleration values. Then, when each acceleration value has been determined (e.g. based upon received speed data), an appropriate torque to be applied by the printhead motor 21 may be determined by linear interpolation between the predetermined torque values.

It will further be appreciated that the torque T4 may not be constant between times t0 and t1, and that the torque applied may be varied based upon the actual acceleration of the carriage motor 17 (which may vary from the constant acceleration profile described above and illustrated in FIG. 13).

Once the constant speed has been reached at time t1, and the printhead carriage motor 17 generates a reduced level of constant torque T2, the printhead motor 21 is controlled to generate an increased level of constant torque T5 between times t1 and t2. The increase in torque from torque T4 to T5 applied by the printhead motor 21 can be understood as being a result of the reduction in torque generated by the carriage motor 17 from T1 to T2.

In particular, the increased torque required during acceleration of the printhead carriage 13 causes the printhead to be pressed against the printing surface, thereby reducing the amount of torque required to be generated by the printhead motor 21 to provide a predetermined printing force. However, once the constant speed phase is reached (i.e. from time t1 to t2) the force exerted on the printing surface 11 by the printhead 4 would be reduced if not for the increase in torque generated by the printhead motor 21.

Then, during the deceleration phase between times t2 and t2, when a negative torque T3 is generated by the printhead carriage motor 17, a large positive torque T6 is required to be generated by the printhead motor 21. It will be appreciated that a negative torque generated by the carriage motor 17 will effectively act to reduce the printing force. Therefore, an increased torque is applied to the printhead motor 21 during the deceleration phase in order to maintain a constant printhead pressure during deceleration.

It will be appreciated that in order for printing operations to be carried out a predetermined pressure is required to be developed between the printhead 4 and the printing surface 11. Furthermore, if the printhead carriage 13 is required to move during this printing operation (e.g. during intermittent printing), further challenges are presented in controlling the motors 17, 21. In particular, in order to maintain a substantially constant printing pressure during printing operations, while the printhead carriage 13 is caused to accelerate, move, and decelerate, a varied torque should be generated by the printhead motor 21, for example as described above with reference to FIG. 13.

Of course, in some embodiments, different torque and/or velocity profiles may be used to those described above. For example, the acceleration by the printhead carriage motor 17 during the acceleration phase between time t0 and t1 may follow an s-curve. It will be appreciated that the torque actually generated by the printhead carriage motor 17 will vary as required to ensure the desired acceleration is achieved. Such an acceleration profile may provide for reduced oscillations (for example due to compliance in the in the belts 19, 23). The torque applied by the printhead motor 21 may be modified to take into account the different acceleration profile applied by the printhead carriage motor 17.

In an embodiment, the print force controller 67 may be provided an input signal indicative of the acceleration status (e.g. 'acceleration', 'steady speed', or 'deceleration') of the carriage motor 17. Different processing may be performed to determine the appropriate torque to be applied by the printhead motor 21 based upon the acceleration status. For example, during an acceleration phase, the processing described above may be performed. Then, during a steady speed phase, a constant torque value may be generated. Finally, during a deceleration phase a torque may be generated based upon a determined deceleration rate (e.g. based upon received speed data) and predetermined torque values which are associated with minimum and maximum deceleration values. Such predetermined torque values may be different than the predetermined torque values associated with the acceleration values described above.

In general terms, the printhead motor 21 may be controlled in a torque controlled manner so as to cause a predetermined pressure to be exerted by the printhead 4 on the printing surface 11, with the torque generated by the printhead motor 21 being varied based upon the torque generated by the carriage motor 17.

It will, of course, also be appreciated that the magnitude of forces and torques experienced and required to be generated at various times during printing operations will depend upon the precise geometry of each system, the requirements of the particular printing technology, and also the properties (e.g. friction, flexibility etc.) of various system components. However, in general terms, it will be understood that while the carriage motor 17 is controlled in a position or speed controlled manner to control the movement of the printhead carriage 13, the control signals applied to the printhead motor 21 during printing operations, may be varied based upon, and so as to compensate for, the torque generated by the carriage motor 17.

Further, it will be understood that the relative forces and torques described above with reference to FIG. 13 are based upon a printer having a twin-belt arrangement printing an image in an intermittent printing mode. However, where a different printing mode (e.g. continuous printing) is used, there will be no requirement for the printhead carriage 13 to move during printing operations, and therefore there will be no variable torque provided by the printhead carriage motor 17 to be overcome by the printhead motor 21. Moreover, where a printer is configured differently, different torques will be required to be generated as necessary. The torque required to be generated by the printhead motor 21 for a particular printer configuration or printing mode may be determined empirically.

Once the printing of an image has been completed, the printhead 4 can be moved out of contact with the printing surface, and the printhead carriage 13 moved so as to be ready to begin a new printing operation. Such operations may be carried out by operation of the printhead motor 21 operating in a position controlled mode, for example as described above with reference to steps S16 and S17. Such control may be performed by the position controller 66, with control being performed based upon a demanded position and an actual printhead motor position. It will further be appreciated that the carriage position will be taken into account so as to ensure correct printhead spacing from the printing surface.

Whereas the torque supplied to the printhead motor 21 may be controlled in response to torque applied to the printhead carriage motor 17 as described above, in some embodiments the torque may also (or alternatively) be controlled based upon other input factors, or with the aim of controlling the printhead pressure more accurately. For example, as the printhead moves towards and makes contact with the printing surface it will be appreciated that the printhead may rebound from the surface, before making contact once more, and eventually settling in contact. The force exerted on the printing surface 11 by the printhead 4 may therefore fluctuate or oscillate before settling at the predetermined printing force. It will be appreciated that it may be impossible, or at least difficult, to print reliably during such a period of printhead force instability.

Similarly, even where a printing force has been established and stabilised, it will be understood that when the printhead carriage 13 begins to move, this can lead to some fluctuation or oscillation in the printing force. This may be true even where the torque applied by the printhead motor 21 is modified based upon the expected torque applied by the carriage motor 17 (such as, for example, torque T4 as described above, which is modified to take into account the torque T1).

Such oscillations may be caused, at least in part, due to compliance in one or both of the belts 19, 23 (which may, for example, flex in a direction substantially perpendicular to the printing surface), and/or in the printing surface 11 (which may comprise a rubber portion).

As described briefly above, bouncing upon contact of the printhead with the printing surface may be reduced by controlling the torque applied to the printhead motor 21, or by shaping of the acceleration profile applied to the printhead motor 21. For example, the printhead motor 21 may be controlled to generate a predetermined torque, with the torque generated being reduced during movement (e.g. as the printhead 4 approaches the printing surface 11). However, this action may not entirely remove such oscillations in printhead pressure. Further, even once a printhead force has stabilised, variations or oscillations may be triggered subsequently, for example by acceleration (or deceleration) of the printhead carriage 13.

Therefore, in some embodiments, a form of active damping may be used to suppress unwanted oscillations of the printhead further. Such active damping relies upon the use of information relating to the actual angular position of the rotor of the printhead motor 21, which information may be provided by the presence of an encoder (as also described above). Such active damping may be controlled by the active damping block 64 operating in combination with the print force controller 67.

It will be understood that during the movement of the printhead carriage 13, assuming that a constant angle of the arm 26 is maintained (and thus a constant printhead positon relative to the printing surface 11 in a direction perpendicular to the printing surface 11), and also assuming that each of the pulleys 18, 22 are of an equal diameter, any rotation of the printhead motor 21 will correspond to an equal rotation of the carriage motor 17. Moreover, given that the speed of the printhead carriage 13 is known (by control of the printhead carriage motor 17 in a position or speed controlled manner), it is possible to generate a speed error signal which is indicative of the variation between the speed of rotation of the printhead carriage motor 17 and the printhead motor 21. Any such variation will correspond generally to the above described oscillation in position of the printhead 4 with respect to the printing surface 11. This speed error signal is generated by the carriage speed adder 63.

Once this error signal has been generated, it is possible to control the printhead motor 21 in order to damp the oscillations, for example by applying an amount of torque (in addition to the torque expected to be required, which is specified by the print force controller 67) which is based upon the error signal, the additional torque being specified by the active damping block 64. For example, the additional torque may be applied in proportion to the magnitude of the speed error signal. The additional torque may be positive or negative in magnitude, such that the total torque applied to the printhead motor 21 comprises a fixed portion, which is based upon the torque expected to be required, and a variable portion, which varies in proportion to the speed error signal. Alternatively, the additional (variable) applied torque may be derived from the error signal in some other way (e.g. using integral and/or derivative control terms in a PID control loop). The gain input provided to the active damping block allows the various gain parameters to be specified as required.

It will be understood that in addition to the speed of rotation of each of the motors 17, 21, directional information may be provided such that the velocity of rotation of each of the motors 17, 21 is known. Such velocity data may be included in any error signal generation. The speed error signal may thus comprise a velocity error signal.

Figure 14:
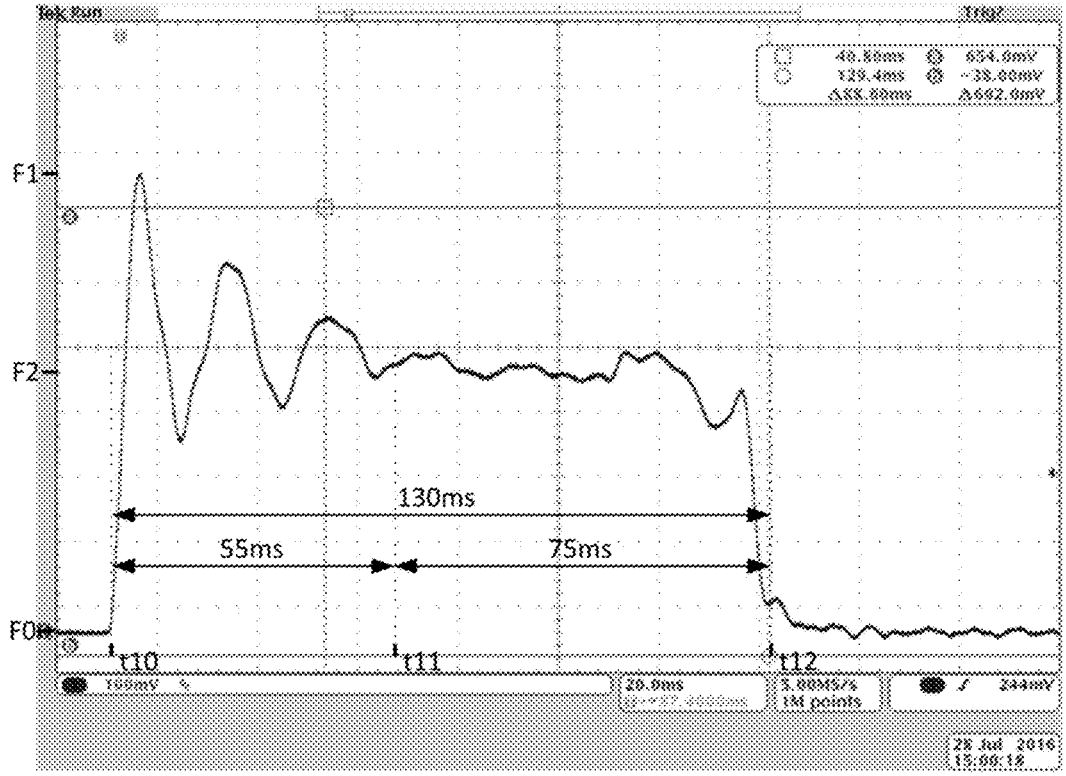
FIG. 14 is a graph showing the force generated by the printhead during printing operations.

FIG. 14 illustrates a print force recorded throughout an intermittent printing operation as measured by a load cell which is provided in the place of a printing surface 11. The x-axis shows time, with a voltage generated by the load cell in proportion to the applied printing force shown on the y-axis. In the plot shown, the full duration of the x-axis is around 200 ms, with a printing force being applied for around 130 ms in total. It can be seen that the printing force initially rises sharply at time t10 from a zero force F0 to a peak force F1, before oscillating significantly until around time t11. After time t11 there is a relatively stable phase during which the force is approximately equal to a force F2. At time t12, the print force again reduces to zero.

It can be seen that the oscillations which follow the initial application of the printing force last for a significant duration of time, which duration amounts to a significant proportion of the printing cycle duration. That is, the time t10 to t11 (which is around 55 ms in duration) amounts to a significant proportion of the time from t10 to t12 (which is around 130 ms in duration). Thus, for a significant proportion (i.e. over 40% in this example) of the printing cycle duration, the force applied to the printing surface is incorrect.

Figure 15:
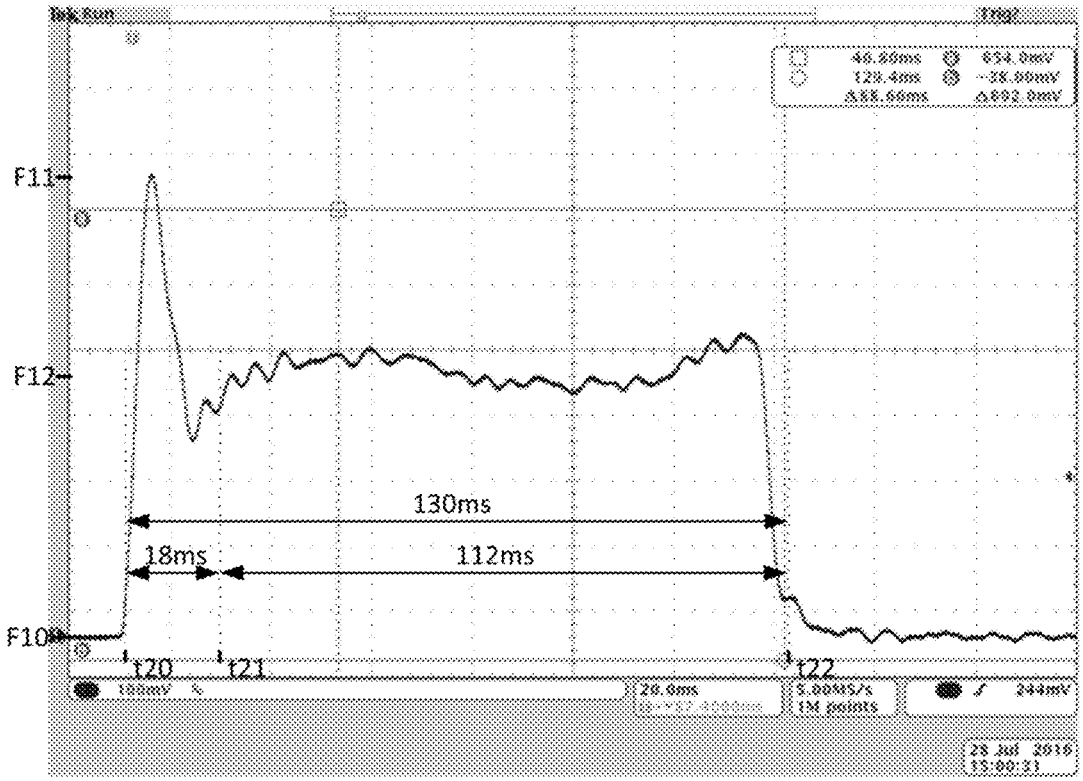
FIG. 15 is a graph showing the force generated by the printhead during printing operations when damping is applied.

However, FIG. 15 illustrates an alternative print force recorded throughout an intermittent printing operation during which active damping is used to reduce oscillations. As in FIG. 14, the x-axis shows time, with a voltage generated by the load cell in proportion to the applied printing force shown on the y-axis. The full plot again shows a total duration of 200 ms. It can be seen that the printing force initially rises sharply at time t20 from a zero force F10 to a peak force F11, before falling again and oscillating briefly until around time t21. After time t21 there is a relatively stable phase during which the force is approximately equal to a force F12. At time t22, the print force again reduces to zero.

It can be seen that the initial peak force F11 (as shown in FIG. 15) is of similar magnitude to the peak force F1 (as shown in FIG. 14) as seen where no damping is used.

However, after a single dip in force which follows the initial peak, the printing force is relatively stable at around the level of force F12 for a majority of the printing cycle. That is, the time t20 to t21 (which is around 18 ms in duration) amounts to a minority of the time from t20 to t22 (which is around 130 ms in duration). Thus, for a majority of the printing cycle duration (i.e. from the time t21 to t22, which lasts for around 112 ms, or around 86% of the printing cycle duration), the force applied to the printing surface is approximately correct.

It is noted that during the period from t21 to t22 there may be small fluctuations and oscillations in the printing force. However, these are generally smaller than those observed during the undamped operation. It will be understood that the printing force may vary during normal operation. However, it is desirable to maintain the printing force at a level which is sufficient for ink to be transferred from the ribbon to the substrate when required. Typically maintaining a minimum printing force (which, if not reached, may cause incomplete ink transfer) is considered to be more important than a maximum printing force (which, if exceeded, may cause increase wear). For example, a printing force which is within around 0.5 kgf of a target printing force may be considered to be an acceptable printing force.

In this way, it is possible to use positional feedback indicating the actual rotor position of the printhead motor 21 in order to accurately control the torque supplied to that motor, in order to reduce oscillations in printing force. That is, the controller is arranged to generate control signals for the printhead motor 21 so as to cause a predetermined torque to be generated by the printhead motor 21, and thereby cause a predetermined pressure to be exerted by the printhead 4 on the printing surface 11. The predetermined torque is varied based upon a signal indicative of a rotational position of the output shaft of the printhead motor 17 (e.g. an encoder output signal), and a signal indicative of a rotational position of an output shaft of the second motor (e.g. a control signal for that motor) so as to reduce the effect of oscillations.

It will be appreciated that where the motor 21 is a stepper motor, the torque may be controlled by varying the magnitude of current supplied to the motor windings, while maintaining the field angle at the optimal level (i.e. 90 electrical degrees), as described in detail above.

In parts of the foregoing description, references to force and pressure have been used interchangeable. Where the surface against which the printhead presses has constant area it will be appreciated that force and pressure are directly proportional, such that pressure may in practice be defined in terms of the force applied. However, the pressure applied will depend upon the width of the printing surface 11 (i.e. the dimension extending into the plane of the paper in FIG. 2) against which the print head 13 applies pressure. The pressure—for a given torque generated by the motor 21—is greater the narrower the printing surface 11, and so is the extent of compression of the printing surface, and vice versa. The printer may provide for several mounting positions for the printhead and the ability to vary the width of the printhead or printing surface. As such, the controller 30 may additionally process information indicating the width of the printing surface 11 against which the printhead presses and use this width information to determine the required torque to be generated by the motor 21.

Various controllers have been described in the foregoing description (particularly with reference to FIGS. 1, 5, 6, 9 and 10). It will be appreciated that functions attributed to those controllers can be carried out by a single controller or by separate controllers as appropriate. It will further be appreciated that each described controller can itself be provided by a single controller device or by a plurality of controller devices. Each controller device can take any suitable form, including ASICS, FPGAs, or microcontrollers which read and execute instructions stored in a memory to which the controller is connected.

While embodiments of the invention described above generally relate to thermal transfer printing, it will be appreciated that in some embodiments the techniques described herein can be applied to other forms of printing, such as, for example, direct thermal printing. In such embodiments no ink carrying ribbon is required and a printhead is energised when in direct contact with a thermally sensitive substrate (e.g. a thermally sensitised paper) so as to create a mark on the substrate.

Moreover, while embodiments of the invention described above generally relate to control of a motor associated with a printhead, it will be appreciated that the above described techniques may also be applied to alternative uses of stepper motors in a field controlled manner. For example, one or both of the stepper motors 6, 7 may be controlled by varying the magnitude of current supplied to the motor windings, while maintaining the field angle at the optimal level (i.e. 90 electrical degrees), as described in detail above.

In particular, the use of the an encoder associated with the output shaft of a stepper motor enables the stepper motor to be controlled in a field controlled manner so as to deliver a predetermined torque, thereby allowing a predetermined tension to be established in the ribbon being transported between the takeup and supply spools 3, 5, the torque being determined based upon the desired tension (e.g. based upon ribbon width, spool diameters, and so on).

In an embodiment, when operating in a continuous printing mode (i.e. where the ribbon is advanced at a substantially constant speed during printing), the motor 7 which is associated with takeup spool 5 may be controlled in a field controlled way so as to maintain ribbon tension during printing, while the motor 6 (which is associated with the supply spool 3) is operated in a position controlled way so as to pay out ribbon. This allows both the rate of movement and the tension of ribbon 2 to be controlled. Moreover, by controlling the takeup spool 5 in a torque controlled manner, the tension in the ribbon 2 can be accurately controlled as it passes the printhead, so as to maintain an optimal peel angle, thereby allowing ink to be peeled from the ribbon in a controlled and optimal way.

On the other hand, between printing operations, when the printhead is spaced apart from the printing surface (e.g. during carriage return), both motors 6, 7 may be controlled in a position (or speed) controlled manner, so as to accelerate or decelerate the ribbon 2 in a controlled manner, or to rewind ribbon from the takeup spool 5 to the supply spool 3. During such operations, it will be appreciated that maintaining a predetermined the tension in the ribbon may be less important than during printing operations.

While various embodiments of the invention have been described above, it will be appreciated that modifications can be made to those embodiments without departing from the spirit and scope of the present invention. In particular, where reference has been made above to printing onto a label web, it will be appreciated that the techniques described above can be applied to printing on any substrate.

The invention claimed is:

1. A printer comprising:

a printhead configured to selectively cause a mark to be created on a substrate;

a stepper motor comprising an output shaft coupled to the printhead, the stepper motor being arranged to vary a position of the printhead relative to a printing surface against which printing is carried out, and to control a pressure exerted by the printhead on the printing surface;

a sensor configured to generate a signal indicative of an angular position of the output shaft of the stepper motor; and a controller arranged to generate control signals for the stepper motor so as to control the stepper motor in a torque controlled manner to cause a predetermined torque to be generated by the stepper motor; said control signals being at least partially based upon an output of said sensor.

2. A printer according to claim 1, wherein:

said control signals for the stepper motor are arranged to cause a magnetic field to be generated by windings of the stepper motor, a field angle being defined between the angular position of the output shaft of the stepper motor, and an orientation of the generated magnetic field; and said generation of control signals is controlled so as to cause said field angle to have a predetermined value.

3. A printer according to claim 2, wherein the predetermined value of the field angle is based upon a motor output characteristic.

4. A printer according to claim 3, wherein the motor output characteristic comprises a maximum torque output.

5. A printer according to claim 2, wherein the generated magnetic field comprises a predetermined angular orientation with respect to a housing of said stepper motor.

6. A printer according to claim 2, wherein the control signals may be generated based upon the signal indicative of the angular position of the output shaft of the stepper motor so as to cause the field angle to have said predetermined value.

7. A printer according to claim 2, wherein the control signals are generated so as to cause said magnetic field to have a predetermined magnitude.

8. A printer according to claim 1, wherein the controller is arranged to control the stepper motor so as to cause a predetermined pressure to be exerted by the printhead on the printing surface.

9. A printer according to claim 1, wherein the controller is arranged to control the stepper motor in first and second operating modes, and wherein:

in the first operating mode, the controller is arranged to control the stepper motor in the torque controlled manner to cause a predetermined pressure to be exerted by the printhead on the printing surface; and, in the second operating mode, the controller is arranged to control the angular position of the output shaft of the stepper motor so as to control the position of the printhead relative to the printing surface.

10. A printer according to claim 9, wherein in the second operating mode the printhead is spaced apart from the printing surface.

11. A printer according to claim 10, further comprising a printhead drive mechanism for transporting the printhead along a track extending generally parallel to the printing surface.

12. A printer according to claim 11, wherein the controller is configured to control the stepper motor in the second operating mode to cause the printhead to maintain a position in which it is spaced apart from the printing surface by a predetermined separation during transport of the printhead along the track extending generally parallel to the printing surface.

13. A printer according to claim 11, wherein the controller is configured to control the stepper motor in the first operating mode to cause said predetermined pressure to be exerted by the printhead on the printing surface during transport of the printhead along the track extending generally parallel to the printing surface.

14. A printer according to claim 11, wherein the printhead drive mechanism comprises a printhead drive belt operably connected to the printhead and a second motor for controlling movement of the printhead drive belt; wherein the movement of the printhead drive belt causes the printhead to be transported along the track extending generally parallel to the printing surface.

15. A printer according to claim 9, wherein, in the first operating mode, the stepper motor is controlled based upon said output of said sensor.

16. A printer according to claim 9 wherein, in the first operating mode, the controller is arranged to generate the control signals for the stepper motor so as to cause said predetermined torque to be generated by the stepper motor; said control signals being at least partially based upon said output of said sensor.

17. A printer according to claim 9, wherein said controller is configured to control the stepper motor in the second operating mode to cause the printhead to maintain a position in which it is spaced apart from the printing surface by a predetermined separation.

18. A printer according to claim 9, wherein said controller is configured to control the stepper motor in the first operating mode to cause the printhead to move from a position in which it is spaced apart from the printing surface towards the printing surface.

19. A printer according to claim 1, wherein generating control signals for the stepper motor so as to cause a predetermined torque to be generated by the stepper motor comprises generating control signals for the stepper motor so as to cause a predetermined magnitude of current to flow in windings of the stepper motor.

20. A printer according to claim 1, wherein the printhead is rotatable about a pivot and wherein the stepper motor is arranged to cause rotation of the printhead about the pivot to vary the position of the printhead relative to the printing surface.

21. A printer according to claim 20, further comprising a printhead assembly, the printhead assembly comprising a first arm and a second arm, the first arm being coupled to the stepper motor, and the printhead being disposed on the second arm, wherein the stepper motor is arranged to cause movement of the first arm, thereby causing rotation of the second arm about the pivot, and causing the position of the printhead relative to the printing surface to vary.

22. A thermal transfer printer, comprising:

a first spool support and a second spool support each being configured to support a respective spool of ink carrying ribbon;

a ribbon drive configured to cause movement of ribbon from the first spool support to the second spool support; and a printhead configured to be selectively energized so as to cause ink to be transferred from the ribbon to a substrate so as to cause a mark to be created on the substrate;

wherein the ribbon drive comprises:

a stepper motor comprising an output shaft operably associated with one of the first spool support and the second spool support, the stepper motor being arranged to cause said one of the first spool support and the second spool support to rotate to cause said movement of ribbon from the first spool support to the second spool support;

a sensor configured to generate a signal indicative of an angular position of the output shaft of the stepper motor; and a controller arranged to generate control signals for the stepper motor so as to control the stepper motor in a torque controlled manner to cause a predetermined torque to be generated by the stepper motor; said control signals being at least partially based upon an output of said sensor.

23. A printer comprising:

a printhead configured to selectively cause a mark to be created on a substrate;

a stepper motor comprising an output shaft coupled to the printhead, the stepper motor being arranged to vary a position of the printhead relative to a printing surface against which printing is carried out, and to control a pressure exerted by the printhead on the printing surface;

an angular position sensor configured to generate a signal indicative of an angular position of the output shaft of the stepper motor; and a controller arranged to generate control signals for the stepper motor so as to cause a predetermined torque to be generated by the stepper motor; said control signals being at least partially based upon the signal indicative of the angular position of said output shaft; wherein the control signals are updated for different angular positions of the output shaft to ensure the predetermined torque is generated irrespective of the angular position.

* * * * *